US011014139B2

(12) United States Patent
Kubo et al.

(10) Patent No.: US 11,014,139 B2
(45) Date of Patent: May 25, 2021

(54) PRESSED COMPONENT MANUFACTURING METHOD, PRESSED COMPONENT, AND PRESSING APPARATUS

(71) Applicant: NIPPON STEEL & SUMITOMO METAL CORPORATION, Tokyo (JP)

(72) Inventors: Masahiro Kubo, Tokyo (JP); Hiroshi Yoshida, Tokyo (JP); Takashi Miyagi, Tokyo (JP); Toshiya Suzuki, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 389 days.

(21) Appl. No.: 15/567,571

(22) PCT Filed: Apr. 21, 2016

(86) PCT No.: PCT/JP2016/062682

§ 371 (c)(1),
(2) Date: Oct. 18, 2017

(87) PCT Pub. No.: WO2016/171229

PCT Pub. Date: Oct. 27, 2016

(65) Prior Publication Data

US 2018/0117655 A1 May 3, 2018

(30) Foreign Application Priority Data

Apr. 22, 2015 (JP) ..... JP2015-087504
Apr. 22, 2015 (JP) ..... JP2015-087505
(Continued)

(51) Int. Cl.
*B21D 22/26* (2006.01)
*B21D 5/01* (2006.01)
*B21D 53/88* (2006.01)

(52) U.S. Cl.
CPC ..... *B21D 22/26* (2013.01); *B21D 5/01* (2013.01); *B21D 53/88* (2013.01)

(58) Field of Classification Search
CPC ..... B21D 22/26; B21D 22/08; B21D 22/20; B21D 22/21; B21D 22/22; B21D 22/30; B21D 53/88; B21D 5/01
(Continued)

(56) References Cited

U.S. PATENT DOCUMENTS 5,211,047 A * 5/1993 Kaneyuki ..... B21D 11/10 72/313
2009/0160217 A1 6/2009 Kimura et al.
(Continued)

FOREIGN PATENT DOCUMENTS

EP 3 275 566 A1 1/2018
FR 2941635 A1 * 8/2010 ..... B21D 53/88
(Continued)

OTHER PUBLICATIONS

English translate (FR2941635A1), retrieved date Dec. 30, 2019.*
(Continued)

*Primary Examiner* — Adam J Eiseman
*Assistant Examiner* — Mohammed S. Alawadi
(74) *Attorney, Agent, or Firm* — Birch, Stewart, Kolasch & Birch, LLP

(57) ABSTRACT

A process of pressing a blank to form an intermediate formed component configured including a top plate, the ridge lines at short direction ends of the top plate, and vertical walls facing each other in a state extending from the respective ridge lines and at least one of the vertical walls configuring a curved wall curving as viewed from an upper side of the top plate, such that a step projecting toward an opposite side to a side on which the vertical walls face each other is formed to the curved wall so as to run along a length
(Continued)

direction of the top plate. The method includes pressing the intermediate formed component to narrow a projection width of the step, or to move a portion of the curved wall where the vertical walls face each other.

4 Claims, 53 Drawing Sheets

(30) Foreign Application Priority Data

Mar. 18, 2016 (JP) ..... JP2016-056041
Mar. 22, 2016 (JP) ..... JP2016-057267

(58) Field of Classification Search
USPC ..... 72/379.2
See application file for complete search history.

(56) References Cited

U.S. PATENT DOCUMENTS

| | | | | |
|---|---|---|---|---|
| 2010/0096765 | A1 | 4/2010 | Kuwayama et al. | |
| 2012/0297853 | A1* | 11/2012 | Tanaka | B21D 22/02 72/350 |
| 2013/0104618 | A1* | 5/2013 | Daimaru | B21D 22/00 72/362 |
| 2013/0199258 | A1* | 8/2013 | Naitou | B21D 24/02 72/342.5 |
| 2015/0343514 | A1* | 12/2015 | Inoue | B23K 31/02 228/173.7 |
| 2015/0367392 | A1 | 12/2015 | Nishimura et al. | |
| 2015/0367397 | A1 | 12/2015 | Uchiyama et al. | |
| 2017/0014886 | A1* | 1/2017 | Shinmiya | B21D 22/26 |
| 2018/0065164 | A1* | 3/2018 | Sumikawa | B21D 22/26 |

FOREIGN PATENT DOCUMENTS

| | | | | |
|---|---|---|---|---|
| JP | 7-185663 | A | | 7/1995 |
| JP | H07185663 | A | * | 7/1995 |
| JP | 3379595 | B2 | | 2/2003 |
| JP | 3442122 | B2 | | 9/2003 |
| JP | 2004-314123 | A | | 11/2004 |
| JP | 2006255747 | A | * | 9/2006 |
| JP | 4021793 | B2 | | 12/2007 |
| JP | 2008-280609 | A | | 11/2008 |
| JP | 5382281 | B1 | | 1/2014 |
| TW | I330556 | B | | 9/2010 |
| TW | 201429577 | A | | 8/2014 |
| TW | 201501830 | A | | 1/2015 |

OTHER PUBLICATIONS

English translate (JPH07185663A), retrieved date Dec. 30, 2019.*
English translate (JP2006255747A), retrieved date Apr. 15, 2020.*
International Search Report for PCT/JP2016/062682 dated Aug. 2, 2016.
Written Opinion of the International Searching Authority for PCT/JP2016/062682 (PCT/ISA/237) dated Aug. 2, 2016.
Brazilian Preliminary Office Action and Search Report dated Feb. 27, 2020, for Brazilian Patent Application No. BR112017022456-9, with partial English translation.

* cited by examiner

FIG. 15

| STEEL TYPE | PLATE THICKNESS | STRENGTH | CURVE-INSIDE OFFSET AMOUNT | CURVE-OUTSIDE OFFSET AMOUNT | EVALUATION OF BENDING AT CROSS-SECTION 1 | EVALUATION OF BENDING AT CROSS-SECTION 2 | AVERAGE BEND AMOUNT |
|---|---|---|---|---|---|---|---|
| | mm | MPa | mm | mm | mm | mm | mm |
| COMPARATIVE EXAMPLE 1A | 1.2 | 1310 | 0.00 | 0.00 | 11.45 | 4.95 | 8.20 |
| COMPARATIVE EXAMPLE 2A | 1.2 | 980 | 0.00 | 0.00 | 8.81 | 3.81 | 6.31 |
| COMPARATIVE EXAMPLE 3A | 1.2 | 590 | 0.00 | 0.00 | −3.52 | 1.52 | −1.00 |
| COMPARATIVE EXAMPLE 4A | 1.0 | 1310 | 0.00 | 0.00 | 13.74 | 5.94 | 9.84 |
| COMPARATIVE EXAMPLE 5A | 1.2 | 1470 | 0.00 | 0.00 | 4.38 | 5.85 | 5.12 |
| EXAMPLE 1A | 1.2 | 1310 | 0.00 | 2.00 | 10.23 | −1.12 | 4.56 |
| EXAMPLE 2A | 1.2 | 1310 | 3.00 | 0.00 | 5.85 | 3.49 | 4.67 |
| EXAMPLE 3A | 1.2 | 1310 | 3.00 | 2.00 | 5.27 | −0.52 | 2.38 |
| EXAMPLE 4A | 1.2 | 1310 | 2.00 | 1.00 | 8.63 | 2.19 | 5.41 |
| EXAMPLE 5A | 1.2 | 980 | 3.00 | 2.00 | 4.05 | −0.40 | 1.83 |
| EXAMPLE 6A | 1.2 | 590 | 3.00 | 2.00 | −1.62 | −0.16 | −0.89 |
| EXAMPLE 7A | 1.2 | 1470 | 3.00 | 2.00 | 1.25 | 6.10 | 3.68 |
| EXAMPLE 8A | 1.0 | 1310 | 3.00 | 2.00 | 6.32 | −0.62 | 2.85 |

FIG. 16

| STEEL TYPE | PLATE THICKNESS | STRENGTH | CURVE-INSIDE OFFSET AMOUNT | CURVE-OUTSIDE OFFSET AMOUNT | EVALUATION OF BENDING AT CROSS-SECTION 1 | EVALUATION OF BENDING AT CROSS-SECTION 2 | AVERAGE BEND AMOUNT |
|---|---|---|---|---|---|---|---|
| | mm | MPa | mm | mm | mm | mm | mm |
| COMPARATIVE EXAMPLE 6A | 1.2 | 1310 | 0.00 | 0.00 | 4.17 | 10.63 | 7.40 |
| COMPARATIVE EXAMPLE 7A | 1.2 | 980 | 0.00 | 0.00 | 2.13 | 8.87 | 5.50 |
| COMPARATIVE EXAMPLE 8A | 1.2 | 590 | 0.00 | 0.00 | 3.21 | 1.86 | 2.54 |
| COMPARATIVE EXAMPLE 9A | 1.0 | 1310 | 0.00 | 0.00 | 4.44 | 11.19 | 7.82 |
| COMPARATIVE EXAMPLE 10A | 1.2 | 1470 | 0.00 | 0.00 | 5.52 | 0.86 | 3.19 |
| EXAMPLE 9A | 1.2 | 1310 | 0.00 | 2.00 | 2.85 | 8.38 | 5.62 |
| EXAMPLE 10A | 1.2 | 1310 | 3.00 | 0.00 | 1.52 | 4.62 | 3.07 |
| EXAMPLE 11A | 1.2 | 1310 | 3.00 | 2.00 | 1.45 | 4.78 | 3.12 |
| EXAMPLE 12A | 1.2 | 1310 | 2.00 | 1.00 | 1.51 | 7.98 | 4.75 |
| EXAMPLE 13A | 1.2 | 980 | 3.00 | 2.00 | −2.20 | 5.58 | 1.69 |
| EXAMPLE 14A | 1.2 | 590 | 3.00 | 2.00 | 0.77 | 1.43 | 1.10 |
| EXAMPLE 15A | 1.0 | 1310 | 3.00 | 2.00 | 2.14 | 7.80 | 4.97 |
| EXAMPLE 16A | 1.2 | 1470 | 3.00 | 2.00 | 2.42 | 2.52 | 2.47 |

FIG. 25
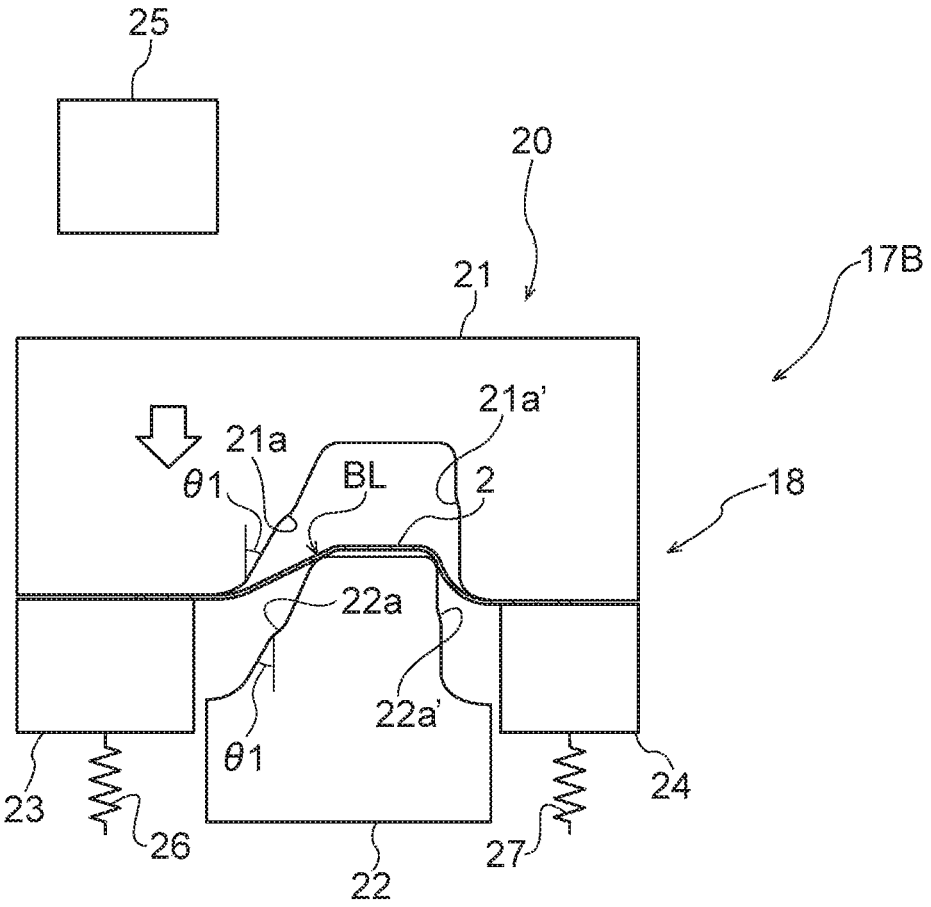
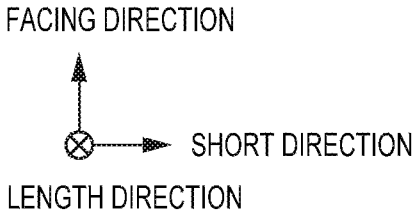

FIG. 32

| EXAMPLE | PLATE THICKNESS | STRENGTH | OUTSIDE VERTICAL WALL CHANGE START POINT | INSIDE VERTICAL WALL CHANGE START POINT | LEADING END PORTION BENDING | REAR END PORTION BENDING | AVERAGE BEND AMOUNT EVALUATION |
|---|---|---|---|---|---|---|---|
| | mm | MPa | % | % | mm | mm | mm |
| COMPARATIVE EXAMPLE 1B | 1.2 | 1310 | - | - | 11.12 | 5.07 | 8.10 |
| COMPARATIVE EXAMPLE 2B | 1.2 | 980 | - | - | 8.74 | 3.98 | 6.36 |
| COMPARATIVE EXAMPLE 3B | 1.2 | 590 | - | - | 3.97 | 1.81 | 2.89 |
| COMPARATIVE EXAMPLE 4B | 1.0 | 1310 | - | - | 13.74 | 5.94 | 9.84 |
| COMPARATIVE EXAMPLE 5B | 1.2 | 1470 | - | - | 4.38 | 5.85 | 5.12 |
| COMPARATIVE EXAMPLE 6B | 1.4 | 590 | - | - | 1.92 | 2.65 | 2.29 |
| EXAMPLE 1B | 1.2 | 1310 | 0 | 0 | 9.55 | 3.28 | 6.42 |
| EXAMPLE 2B | 1.2 | 1180 | 0 | 0 | 7.50 | 2.58 | 5.04 |
| EXAMPLE 3B | 1.2 | 980 | 0 | 0 | 5.46 | 1.87 | 3.67 |
| EXAMPLE 4B | 1.2 | 590 | 0 | 0 | -3.41 | 1.17 | -1.12 |
| EXAMPLE 5B | 1.2 | 1470 | 0 | 0 | 1.71 | 4.91 | 3.31 |
| EXAMPLE 6B | 1.4 | 1310 | 0 | 0 | 4.43 | 2.10 | 3.27 |
| EXAMPLE 7B | 1.2 | 1470 | 20 | 20 | 2.11 | 4.97 | 3.54 |
| EXAMPLE 8B | 1.2 | 980 | 50 | 50 | 3.21 | 2.65 | 2.93 |
| EXAMPLE 9B | 1.2 | 1470 | 0 | - | 5.02 | 4.34 | 4.68 |
| EXAMPLE 10B | 1.2 | 980 | - | 0 | 2.14 | 3.97 | 3.06 |
| EXAMPLE 11B | 1.4 | 1310 | 20 | 50 | 1.53 | 3.91 | 2.72 |
| EXAMPLE 12B | 1.2 | 590 | 50 | 20 | 1.32 | 1.30 | 1.31 |
| EXAMPLE 13B | 1.2 | 980 | 0 | 20 | 4.43 | 0.23 | 2.33 |
| EXAMPLE 14B | 1.2 | 1470 | - | 50 | 2.48 | 5.07 | 3.78 |
| EXAMPLE 15B | 1.2 | 590 | 20 | 0 | 1.22 | 1.01 | 1.12 |
| EXAMPLE 16B | 1.2 | 590 | 0 | 50 | 0.52 | 0.20 | 0.36 |
| EXAMPLE 17B | 1.4 | 1310 | - | 20 | 2.93 | 3.67 | 3.30 |
| EXAMPLE 18B | 1.2 | 980 | 20 | - | 2.39 | 3.22 | 2.81 |
| EXAMPLE 19B | 1.2 | 1470 | 50 | 0 | 1.86 | 6.35 | 4.11 |

FIG. 33

| EXAMPLE | PLATE THICKNESS | STRENGTH | OUTSIDE VERTICAL WALL CHANGE START POINT | INSIDE VERTICAL WALL CHANGE START POINT | LEADING END PORTION BENDING | REAR END PORTION BENDING | AVERAGE BEND AMOUNT EVALUATION |
|---|---|---|---|---|---|---|---|
| | mm | MPa | % | % | mm | mm | mm |
| COMPARATIVE EXAMPLE 7B | 1.2 | 1310 | - | - | 4.17 | 10.63 | 7.40 |
| COMPARATIVE EXAMPLE 8B | 1.2 | 980 | - | - | 2.13 | 8.87 | 5.50 |
| COMPARATIVE EXAMPLE 9B | 1.2 | 590 | - | - | 3.21 | 1.86 | 2.54 |
| COMPARATIVE EXAMPLE 10B | 1.0 | 1310 | - | - | 4.44 | 11.19 | 7.82 |
| COMPARATIVE EXAMPLE 11B | 1.2 | 1470 | - | - | 5.52 | 0.86 | 3.19 |
| COMPARATIVE EXAMPLE 12B | 1.4 | 590 | - | - | 1.95 | 2.25 | 2.10 |
| EXAMPLE 20B | 1.2 | 1310 | 0 | 0 | 1.45 | 4.78 | 3.12 |
| EXAMPLE 21B | 1.2 | 980 | 0 | 0 | -2.20 | 5.58 | 1.69 |
| EXAMPLE 22B | 1.2 | 590 | 0 | 0 | 0.77 | 1.43 | 1.10 |
| EXAMPLE 23B | 1.0 | 1310 | 0 | 0 | 2.14 | 7.80 | 4.97 |
| EXAMPLE 24B | 1.2 | 1470 | 0 | 0 | 2.42 | 2.52 | 2.47 |
| EXAMPLE 25B | 1.2 | 1310 | 0 | 0 | 0.40 | 6.84 | 3.62 |
| EXAMPLE 26B | 1.2 | 1470 | 20 | 20 | 2.41 | 5.72 | 4.07 |
| EXAMPLE 27B | 1.2 | 980 | 50 | 50 | 1.07 | 5.03 | 3.05 |
| EXAMPLE 28B | 1.2 | 980 | - | 0 | 3.17 | 3.63 | 3.40 |
| EXAMPLE 29B | 1.2 | 1310 | 20 | 50 | 3.75 | 6.50 | 5.13 |
| EXAMPLE 30B | 1.2 | 980 | 0 | 20 | 1.45 | 5.20 | 3.33 |
| EXAMPLE 31B | 1.2 | 1470 | - | 50 | 1.88 | 3.67 | 2.78 |
| EXAMPLE 32B | 1.2 | 590 | 20 | 0 | 0.48 | 2.54 | 1.51 |
| EXAMPLE 33B | 1.2 | 1310 | 50 | - | 2.51 | 7.16 | 4.84 |
| EXAMPLE 34B | 1.2 | 590 | 0 | 50 | 1.36 | 2.47 | 1.92 |
| EXAMPLE 35B | 1.2 | 1310 | - | 20 | 2.96 | 6.05 | 4.51 |
| EXAMPLE 36B | 1.2 | 980 | 20 | - | 1.15 | 5.17 | 3.16 |
| EXAMPLE 37B | 1.2 | 1470 | 50 | 0 | 1.13 | 1.46 | 1.30 |

PRESSED COMPONENT MANUFACTURING METHOD, PRESSED COMPONENT, AND PRESSING APPARATUS

TECHNICAL FIELD

The present disclosure relates to a manufacturing method for a pressed component, a pressed component, and a press apparatus.

BACKGROUND ART

Automotive bodies are assembled by superimposing edges of multiple formed panels, joining the formed panels together by spot welding to configure a box body, and joining structural members to required locations on the box body by spot welding. Examples of structural members employed at a side section of an automotive body (body side) include side sills joined to the two sides of a floor panel, an A-pillar lower and an A-pillar upper provided standing upward from a front portion of the side sill, a roof rail joined to an upper end portion of the A-pillar upper, and a B-pillar joining the side sill and the roof rail together.

Generally speaking, configuration elements (such as respective outer panels) of structural members including A-pillar lowers, A-pillar uppers, and roof rails often have a substantially hat-shaped lateral cross-section profile configured by a top plate extending in a length direction, two convex ridge lines respectively connected to the two sides of the top plate, two vertical walls respectively connected to the two convex ridge lines, two concave ridge lines respectively connected to the two vertical walls, and two flanges respectively connected to the two concave ridge lines.

SUMMARY OF INVENTION

Technical Problem

The configuration elements described above have comparatively complex lateral cross-section profiles and are elongated. In order to suppress an increase in manufacturing costs, the above configuration elements are generally manufactured by cold pressing. Moreover, in order to both increase strength and achieve a reduction in vehicle body weight in the interests of improving fuel consumption, thickness reduction of the above structural members through the use of, for example, high tensile sheet steel having a tensile strength of 440 MPa or greater is being promoted.

However, when a high tensile sheet steel blank is cold pressed in an attempt to manufacture configuration elements that curve along their length direction, such as roof rail outer panels (referred to below as "roof members"; roof members are automotive structural members), spring-back occurs during press mold release, leading to concerns of twisting in the top plate. This gives rise to issues with regard to shape fixability, whereby roof members cannot be formed in a desired shape.

For example, Japanese Patent Application Laid-Open (JP-A) No. 2004-314123 (referred to below as "Patent Document 1") describes an invention in which a pressed component having a uniform hat-shaped lateral cross-section along its length direction is applied with a step during manufacture in order to suppress opening-out, and thus improve the shape fixability.

Moreover, the specification of Japanese Patent No. 5382281 (referred to below as "Patent Document 2") describes an invention in which, during the manufacture of a pressed component that includes a top plate, vertical walls, and flanges, and that curves along its length direction, a flange formed in a first process is bent back in a second process so as to reduce residual stress in the flange, thereby improving the shape fixability.

When the invention described in Patent Document 1 is used to manufacture pressed components shaped so as to curve along a length direction, for example in configuration elements of configuration members such as A-pillar lowers, A-pillar uppers, or roof rails, bending occurs in curved walls as a result of spring-back after removal from the mold, such that the desired shape cannot be formed.

According to the invention described in Patent Document 2, when manufacturing pressed components that curve along their length direction and height direction and that include a bent portion in the vicinity of the length direction center, residual stress arises in the flange, residual stress arises at inner faces of the vertical walls and the top plate, and deviatoric residual stress arises at inner faces of the vertical walls and the top plate. As a result, as viewed from the top plate side, bending occurs as a result of spring-back in the pressed component after removal from the mold, such that the desired shape cannot be formed.

An object of the present disclosure is to provide a manufacturing method for a specific pressed component in which the occurrence of bending as viewed from a top plate side is suppressed. Note that in the present specification, a "specific pressed component" refers to a pressed component configured including an elongated top plate, ridge lines at both short direction ends of the top plate, and vertical walls facing each other in a state extending from the respective ridge lines and at least one of the vertical walls configuring a curved wall curving as viewed from an upper side of the top plate.

Solution to Problem

A pressed component manufacturing method of a first aspect according to the present disclosure is a manufacturing method for a pressed component configured including an elongated top plate, ridge lines at both short direction ends of the top plate, and vertical walls facing each other in a state extending from the respective ridge lines and at least one of the vertical walls configuring a curved wall curving as viewed from an upper side of the top plate. The manufacturing method includes a first process of pressing a blank to form an intermediate formed component configured including the top plate, the ridge lines at both ends, and the vertical walls, and in which a step projecting toward an opposite side to a side on which the vertical walls face each other is formed to the curved wall so as to run along a length direction of the top plate. The manufacturing method further includes a second process of performing at least one out of pressing the intermediate formed component so as to narrow a projection width of the step, or pressing the intermediate formed component so as to move a portion of the curved wall on an opposite side of the step to a portion of the curved wall on the top plate side of the step toward the opposite side to the side on which the vertical walls face each other.

A pressed component manufacturing method of a second aspect according to the present disclosure is the pressed component manufacturing method of the first aspect according to the present disclosure, wherein, in the first process, taking a position of the top plate as a reference, a portion of the curved wall at a distance of not less than 40% of a height from the top plate position to a lower end of the curved wall is formed with a step having the projection width of not more than 20% of a short direction width of the top plate.

A pressed component manufacturing method of a third aspect according to the present disclosure is the pressed component manufacturing method of either the first aspect or the second aspect according to the present disclosure, wherein, in cases in which at least the projection width of the step is narrowed in the second process, in the second process an angle of a portion of the curved wall further to the top plate side than the step is changed in order to narrow the projection width of the step formed in the first process.

A pressed component according to the present disclosure is configured including: an elongated top plate; ridge lines at both short direction ends of the top plate; and vertical walls facing each other in a state extending from the respective ridge lines and at least one of the vertical walls configuring a curved wall curving as viewed from an upper side of the top plate. In the pressed component according to the present disclosure, a portion of the curved wall at a distance of not less than 40% of a height of the curved wall from a position of the top plate is formed with a step running along a length direction of the top plate, the step projecting out with a projection width of not more than 20% of a short direction width of the top plate on an opposite side to a facing side on which the vertical walls face each other. Moreover, a Vickers hardness value of an end portion on the facing side of the step is greater than a Vickers hardness value of an end portion on the opposite side of the step.

A press apparatus of a first aspect according to the present disclosure includes a first press device and a second press device. The first press device presses a blank to form an intermediate formed component that is configured including an elongated top plate, ridge lines at both short direction ends of the top plate, and vertical walls facing each other in a state extending from the respective ridge lines and at least one of the vertical walls configuring a curved wall curving as viewed from an upper side of the top plate, with a step projecting out toward an opposite side to the side on which the vertical walls face each other being formed to the curved wall so as to run along a length direction of the top plate. The second press device presses the intermediate formed component so as to narrow a projection width of the step.

A press apparatus of a second aspect according to the present disclosure includes a first press device that presses a blank using a first die and a first punch so as to form an intermediate formed component, and a second press device that presses the intermediate formed component with a second die and a second punch. In the first press device, an elongated first groove configured including an elongated first groove-bottom face and first side faces connected to both short direction ends of the first groove-bottom face is formed in the first die. Moreover, in the first press device, at least one of the first side faces configures a first curved face that is curved as viewed along a mold closing direction, and that is formed with a first step at a position at a specific depth at a distance of not less than 40% of a depth of the first groove from the first groove-bottom face, the first step having a width of not more than 20% of a short direction width of the first groove-bottom face and running along a length direction of the first side face, and the shape of the first punch is a shape that fits together with the shape of the first groove during mold closure. In the second press device, an elongated second groove configured including an elongated second groove-bottom face and second side faces connected to both short direction ends of the second groove-bottom face is formed in the second die. Moreover, in the second press device, at least one of the second side faces configures a second curved face that is curved as viewed along the mold closing direction, and that is formed with a second step at a position at the specific depth from the second groove-bottom face, the step running along a length direction of the second side face. Furthermore, the second step is narrower in width than the first step, and a separation distance between the second groove-bottom face and the second step in the short direction of the second groove-bottom face is longer than a separation distance between the first groove-bottom face and the first step in the short direction of the first groove-bottom face. The shape of the second punch is a shape that fits together with the shape of the second groove during mold closure.

A press apparatus of a third aspect according to the present disclosure is the press apparatus of the second aspect according to the present disclosure, wherein, in a cross-section of the second die projected onto a cross-section of the first die, at least part of a portion of the second curved face at an opposite side of the second step to a portion on the second groove-bottom face side is located further outside than a portion of the first curved face at an opposite side of the first step to a portion on the second groove-bottom face side.

Advantageous Effects of Invention

Employing the pressed component manufacturing method according to the present disclosure enables a specific pressed component to be manufactured in which the occurrence of bending is suppressed as viewed from the top plate side.

The pressed component according to the present disclosure undergoes little bending as viewed from the top plate side.

Employing the press apparatus according to the present disclosure enables a specific pressed component to be manufactured in which the occurrence of bending is suppressed as viewed from the top plate side.

BRIEF DESCRIPTION OF DRAWINGS

FIG. 15 is a table illustrating evaluation results for simulations of bending of roof members of Examples (Examples 1A to 8A) of the first exemplary embodiment and bending of roof members of Comparative Examples (Comparative Examples 1A to 5A).

FIG. 16 is a table illustrating evaluation results for simulations of bending of roof members of Examples (Examples 10A to 16A) of the second exemplary embodiment and bending of roof members of Comparative Examples (Comparative Examples 6A to 10A).

FIG. 25 is a lateral cross-section of a first press device employed in the first process of the roof member manufacturing method of the third exemplary embodiment, and a blank.

FIG. 32 is a table illustrating evaluation results of a simulation for bending of roof members of Examples 1B to 19B, these being Examples of the third exemplary embodiment, and for bending of roof members of Comparative Examples 1B to 6B, these being Comparative Examples relating to the third exemplary embodiment.

FIG. 33 is a table illustrating evaluation results of a simulation for bending of roof members of Examples 20B to 37B, these being Examples of the fourth exemplary embodiment, and for bending of roof members of Comparative Examples 7B to 12B, these being Comparative Examples relating to the fourth exemplary embodiment.

DESCRIPTION OF EMBODIMENTS

Summary

Explanation follows regarding four exemplary embodiments (a first to a fourth exemplary embodiment) and Examples thereof as embodiments for implementing the present disclosure. First, explanation follows regarding the first and second exemplary embodiments and Examples of the first and second exemplary embodiments. This will be followed by explanation regarding the third and fourth exemplary embodiments and Examples of the third and fourth exemplary embodiments. Note that in the present specification, exemplary embodiments refer to embodiments for implementing the present disclosure.

First Exemplary Embodiment

Explanation follows regarding the first exemplary embodiment. First, explanation follows regarding configuration of a roof member 1 of the present exemplary embodiment illustrated in FIG. 1A, FIG. 1B, FIG. 1C, and FIG. 1D. Next, explanation follows regarding configuration of a press apparatus 17 of the present exemplary embodiment, illustrated in FIG. 2A, FIG. 2B, FIG. 3A, and FIG. 3B. This will be followed by explanation regarding a manufacturing method of the roof member 1 of the present exemplary embodiment. This will then be followed by explanation regarding advantageous effects of the present exemplary embodiment.

Roof Member Configuration

First, explanation follows regarding configuration of the roof member 1 of the present exemplary embodiment, with reference to the drawings. Note that the roof member 1 is an example of a pressed component and a specific pressed component.

As illustrated in FIG. 1A, FIG. 1B, FIG. 1C, and FIG. 1D, the roof member 1 is an elongated member integrally configured including a top plate 2, two convex ridge lines 3*a*, 3*b*, two vertical walls 4*a*, 4*b*, two concave ridge lines 5*a*, 5*b*, and two flanges 6*a*, 6*b*, and having a substantially hat-shaped cross-section profile. Note that the convex ridge lines 3*a*, 3*b* are an example of ridge lines. The roof member 1 is, for example, configured by a component cold pressed from a high tensile steel stock sheet having 1310 MPa grade tensile strength. Namely, the roof member 1 of the present exemplary embodiment is, for example, configured by a component cold pressed from a high tensile steel stock sheet having a tensile strength of from 440 MPa to 1600 MPa.

Figure 1A:
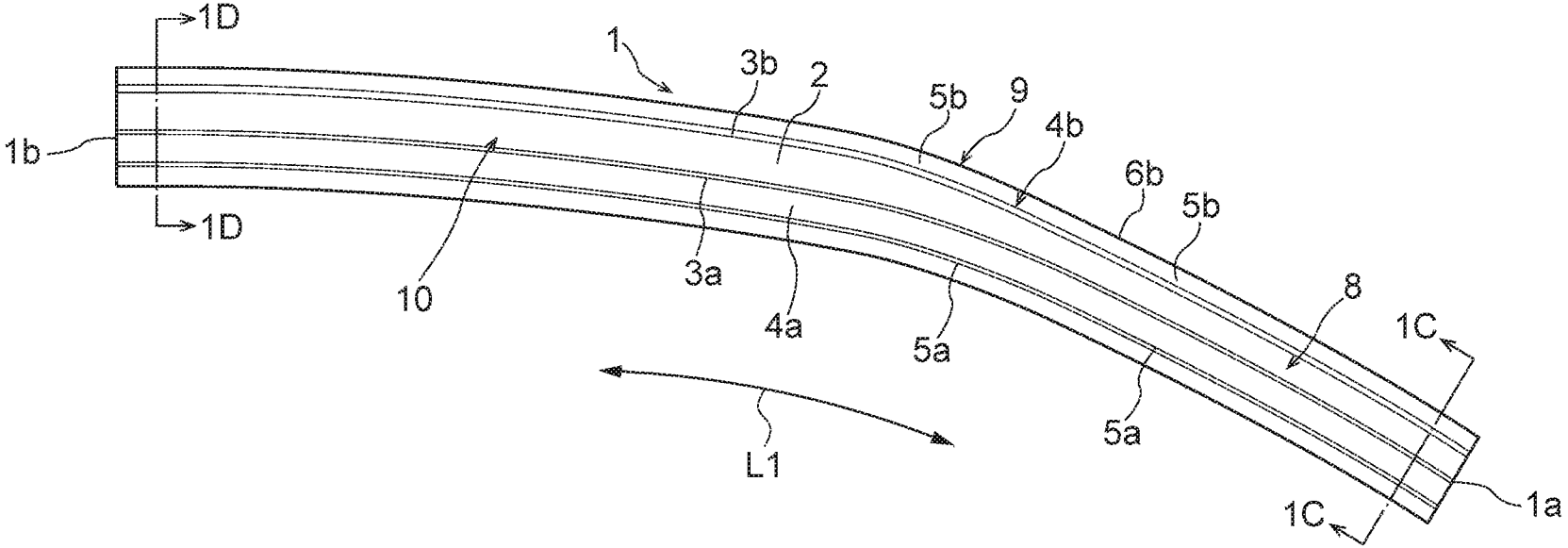
FIG. 1A is a plan view illustrating a roof member (pressed component) of a first exemplary embodiment.

As illustrated in FIG. 1A and FIG. 1, the top plate 2 is elongated. Moreover, as illustrated in FIG. 1A, as viewed from the upper side of the top plate 2, the top plate 2 is curved along its length direction. The two convex ridge lines 3*a*, 3*b* are formed at both short direction ends of the top plate 2. The two vertical walls 4*a*, 4*b* face each other in a state extending from the respective convex ridge lines 3*a*, 3*b*. Namely, the roof member 1 of the present exemplary embodiment is configured including the elongated top plate 2, the convex ridge lines 3*a*, 3*b* at both short direction ends of the top plate 2, and the vertical walls 4*a*, 4*b* facing each other in a state extending from the convex ridge lines 3*a*, 3*b*. Moreover, as illustrated in FIG. 1A, the two vertical walls 4*a*, 4*b* are curved along the length direction of the top plate 2 as viewed from the upper side of the top plate 2. Namely, the two vertical walls 4*a*, 4*b* of the present exemplary embodiment face each other in a state extending from the respective convex ridge lines 3*a*, 3*b*, and at least one out of the vertical walls 4*a*, 4*b* is configured as a curved wall curving as viewed from the upper side of the top plate 2. Note that the vertical walls 4*a*, 4*b* are an example of curved walls. Note that in the present exemplary embodiment, as an example, the vertical wall 4*a* is curved in a concave shape opening toward the opposite side to the vertical wall 4*b* side, namely the side facing the vertical wall 4*b* side, and the vertical wall 4*b* is curved in a convex shape bowing toward the opposite side to the vertical wall 4*a* side, namely the side facing the vertical wall 4*a* side. Note that in the present exemplary embodiment, the two vertical walls 4*a*, 4*b*, namely both the vertical walls 4*a*, 4*b*, are curved as viewed from the upper side of the top plate 2.

Figure 1B:
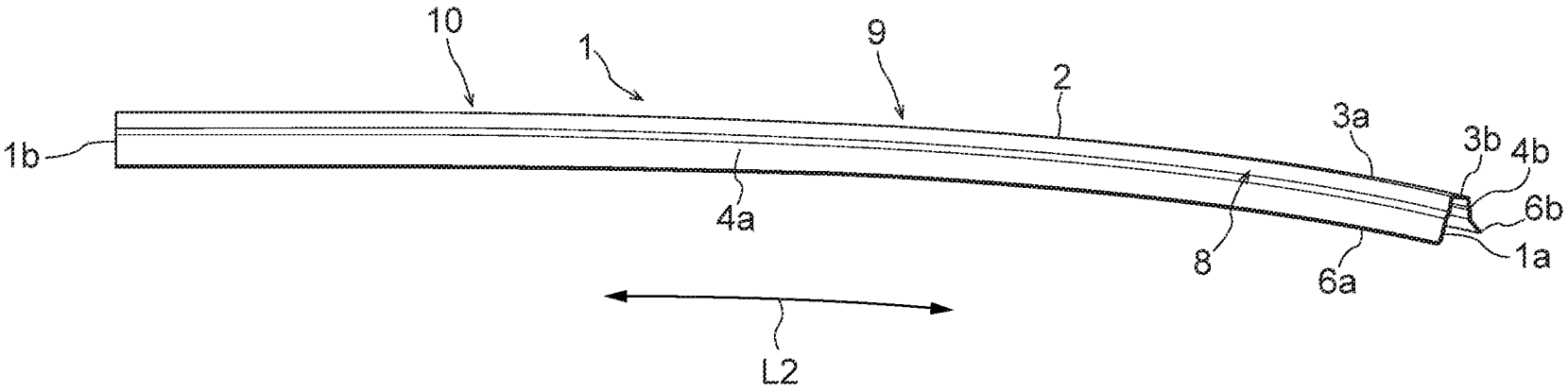
FIG. 1B is a side view illustrating a roof member of the first exemplary embodiment.
Figure 1C:
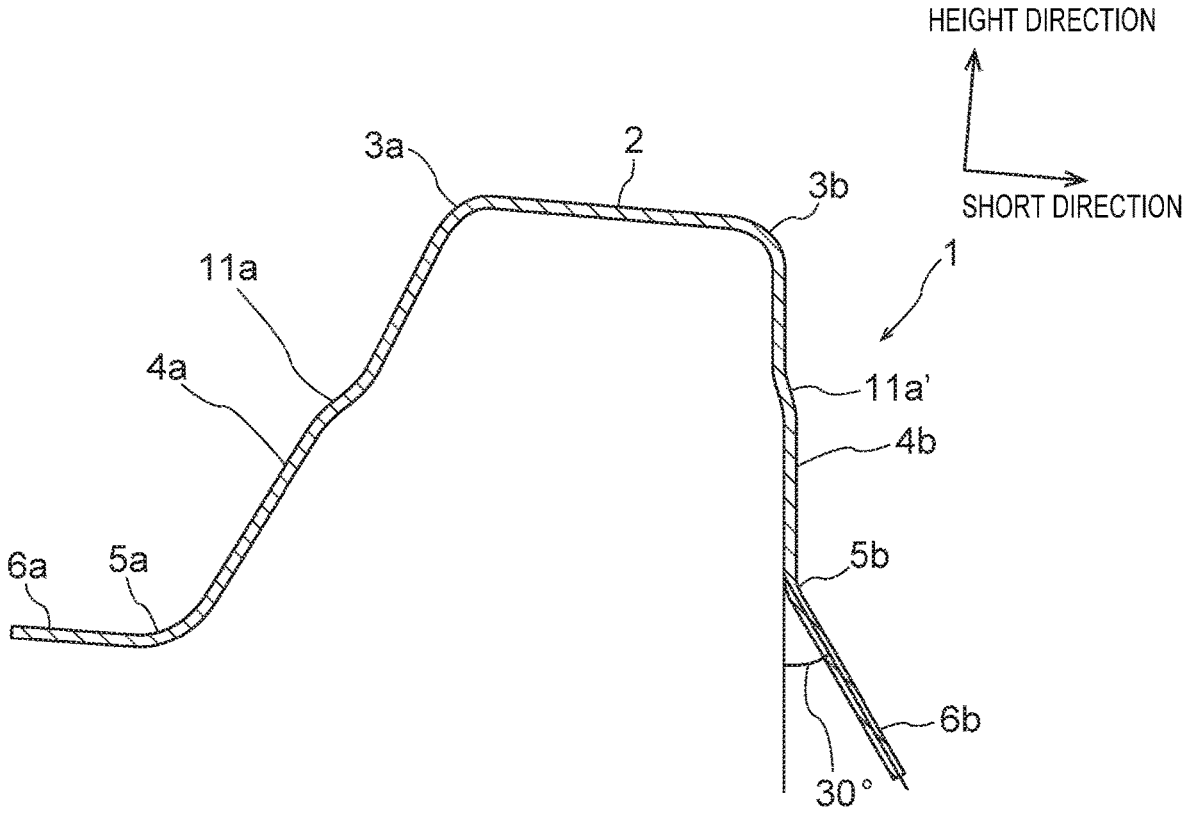
FIG. 1C is a cross-section along 1C-1C in FIG. 1A.
Figure 1D:
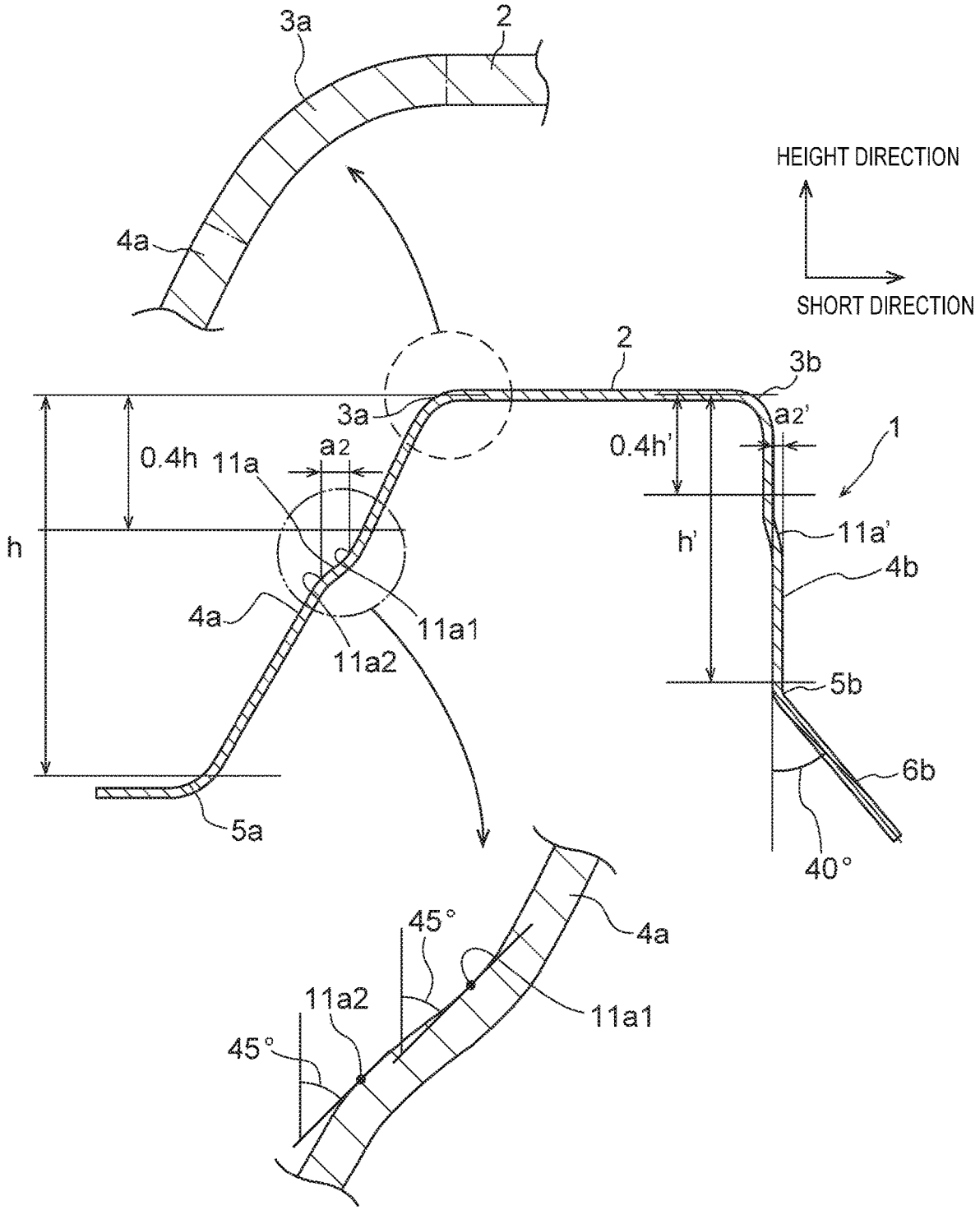
FIG. 1D is a cross-section along 1D-1D in FIG. 1A.

In the present exemplary embodiment, for example, respective cross-sections perpendicular to the length direction of the top plate 2 extend in a straight line shape along the short direction at each length direction position. Namely, when the top plate 2 of the present exemplary embodiment is viewed in respective cross-sections perpendicular to the length direction, as illustrated in FIG. 1C and FIG. 1D, the top plate 2 is flat at each length direction position. Moreover, as illustrated in FIG. 1B, the roof member 1 is curved in a convex shape bowing toward the top plate 2 side along its length direction. Note that as illustrated in FIG. 1D, the convex ridge line 3*a* is a portion that connects the top plate 2 and the vertical wall 4*a* together, and is a curved portion when viewed in the respective cross-sections taken perpendicularly to the length direction of the top plate 2. The two dashed lines in the drawings respectively indicate the two ends of the convex ridge line 3*a* connected to the top plate 2 and the vertical wall 4*a*. Illustration of the two ends of the convex ridge line 3*b* using dashed lines is omitted from the drawings; however, the convex ridge line 3*b* is a portion that connects the top plate 2 and the vertical wall 4*b* together, and is a curved portion when viewed in the respective cross-sections taken perpendicularly to the length direction of the top plate 2.

The two concave ridge lines 5*a*, 5*b* are respectively formed at end portions of the two vertical walls 4*a*, 4*b* on the opposite side to the side connected to the top plate 2. The two flanges 6*a*, 6*b* are connected to the two respective concave ridge lines 5*a*, 5*b*. Illustration of the two ends of the concave ridge line 5*a* using dashed lines is omitted from the drawings; however, the concave ridge line 5*a* is a portion that connects the vertical wall 4*a* and the flange 6*a* together, and is a curved portion when viewed in the respective cross-sections taken perpendicularly to the length direction of the top plate 2. Illustration of the two ends of the concave ridge line 5*b* using dashed lines is omitted from the drawings; however, the concave ridge line 5*b* is a portion that connects the vertical wall 4*b* and the flange 6*b* together, and is a curved portion when viewed in the respective cross-sections taken perpendicularly to the length direction of the top plate 2.

As illustrated in FIG. 1A, as viewed from the top plate 2 side in a state in which the top plate 2 is disposed so as to be orientated at a position on the upper side, the roof member 1 is curved from a front end portion 1*a* configuring one length direction end portion to a rear end portion 1*b* configuring another length direction end portion. From another perspective, as illustrated in FIG. 1A and FIG. 1B, the roof member 1 may be described as being integrally configured including a first portion 8 including the one end portion 1*a*, a third portion 10 including the other end portion 1*b*, and a second portion 9 connecting the first portion 8 and the third portion 10 together.

Note that in the present exemplary embodiment, in plan view, namely, as viewed from the upper side of the top plate 2, the radius of curvature R of the first portion 8 is, for example, set to from 2000 mm to 9000 mm, the radius of curvature R of the second portion 9 is, for example, set to from 500 mm to 2000 mm, and the radius of curvature R of the third portion 10 is, for example, set to from 2500 mm to 9000 mm. Moreover, as illustrated in FIG. 1B, in the present exemplary embodiment, in side view, namely as viewed from a width direction side of the top plate 2, the radius of curvature R of the first portion 8 is, for example, set to from 3000 mm to 15000 mm, the radius of curvature R of the second portion 9 is, for example, set to from 1000 mm to 15000 mm, and the radius of curvature R of the third portion 10 is, for example, set to from 3000 mm to 15000 mm. As described above, the radius of curvature R of the first portion 8 and the radius of curvature R of the third portion 10 are larger than the radius of curvature R of the second portion 9.

Note that as illustrated in FIG. 1D, the height of a plate thickness center of an arc end configuring an arc start point on the top plate 2 side of the convex ridge line 3*a*, namely from the plate thickness center of the top plate 2, to a lower end of the vertical wall 4*a* configuring a concave ridge line 5*a* side end of the vertical wall 4*a* configures a height h. At not less than 40% of the height h from the plate thickness center of the top plate 2, the vertical wall 4*a* is formed along its length direction with a step 11*a* having a projection width a2 (*mm*). Moreover, as illustrated in FIG. 1D, the height from a plate thickness center of an arc end configuring an arc start point on the top plate 2 side of the convex ridge line 3*b*, namely from the plate thickness center of the top plate 2, to a lower end of the vertical wall 4*b* configures a height h'. The vertical wall 4*b* is also formed along its length direction with a step 11*a*' having a projection width a2' (mm) at a portion at a distance of not less than 40% of the height h' from the plate thickness center of the top plate 2. In the present specification, the plate thickness center of the top plate 2 is taken as the height direction position of the top plate 2. Note that as illustrated in FIG. 1D, the projection widths a2, a2' of the steps 11*a*, 11*a*' are set to not more than 20% of a short direction width W of the top plate 2 at each position out of the respective positions in the length direction of the top plate 2.

Figure 18:
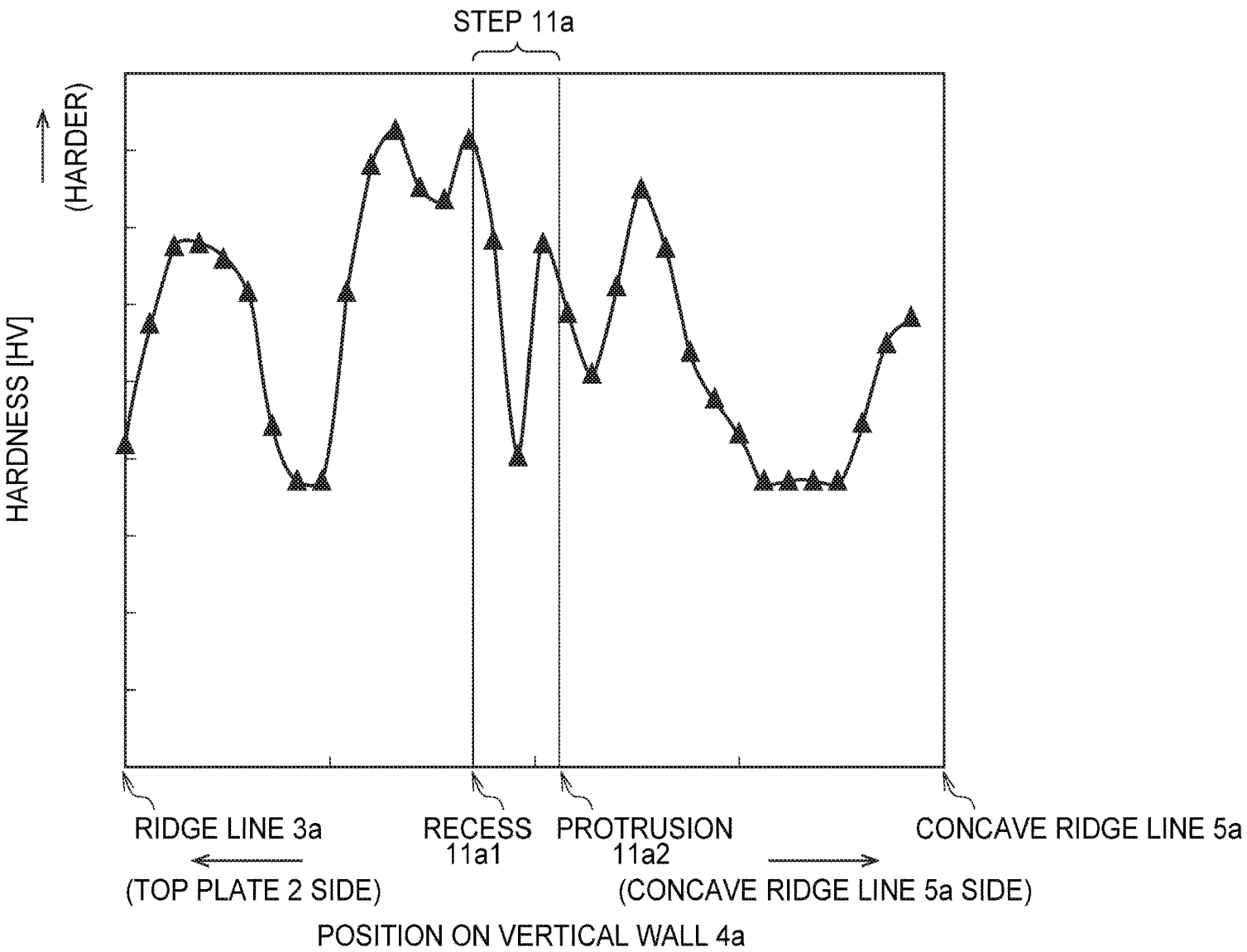
FIG. 18 is a graph illustrating evaluation results of Vickers hardness testing of a vertical wall for Example 4A.

Out of the two ends of the step 11*a*, the end on the side closer to the top plate 2, namely an upper side location of the step 11*a*, configures a recess 11*a*1, and the end on the side further from the top plate 2, namely a lower side location of the step 11*a*, configures a protrusion 11*a*2. Moreover, out of the two ends of the step 11*a*', the end on the side closer to the top plate 2, namely an upper side location of the step 11*a*', configures a recess 11*a*'1, and the end on the side further from the top plate 2, namely a lower side location of the step 11*a*', configures a protrusion 11*a*'2. Moreover, in the present exemplary embodiment, as can be seen in FIG. 18, described later, a Vickers hardness value of the protrusion 11*a*2 is lower than a Vickers hardness value of the recess 11*a*1 by 10 HV or greater at each position along the length direction of the vertical wall 4*a*. Moreover, as can be seen in FIG. 18, described later, a Vickers hardness value of the protrusion 11*a*'2 is lower than a Vickers hardness value of the recess 11*a*'1 by 10 HV or greater at each position along the length direction of the vertical wall 4*b*.

Note that the following generalized statements may also be made about the two ends of each of the steps 11*a*, 11*a*'. Namely, out of the two ends of the step 11*a*, the recess 11*a*1 configuring the end on the side closer to the top plate 2 is configured as a location formed with a radius of curvature that forms the largest protrusion toward an inner surface side of an inner surface of the vertical wall 4*a*. The protrusion 11*a*2 configuring the end on the side further from the top plate 2 is configured as a location formed with a radius of curvature that forms the largest protrusion toward an outer surface side of the inner surface of the vertical wall 4*a*. Moreover, out of the two ends of the step 11*a*', the recess 11*a*'1 configuring the end on the side closer to the top plate 2 is configured as a location formed with a radius of curvature that forms the largest protrusion toward an inner surface side of an inner surface of the vertical wall 4*b*. Out of the two ends of the step 11*a*', the protrusion 11*a*'2 configuring the end on the side further from the top plate 2 is configured as a location formed with a radius of curvature that forms the largest protrusion toward an outer surface side of the inner surface of the vertical wall 4*b*. Accordingly, it may be said that the two ends of each of the steps 11*a*, 11*a*' are defined even in cases in which, as viewed in cross-sections perpendicular to the length direction of the vertical wall 4*a*, there is no location with an incline of 45° at the two ends of the steps, or at one end out of the two ends of the steps, namely even in cases differing from that of the present exemplary embodiment.

Figure 11:
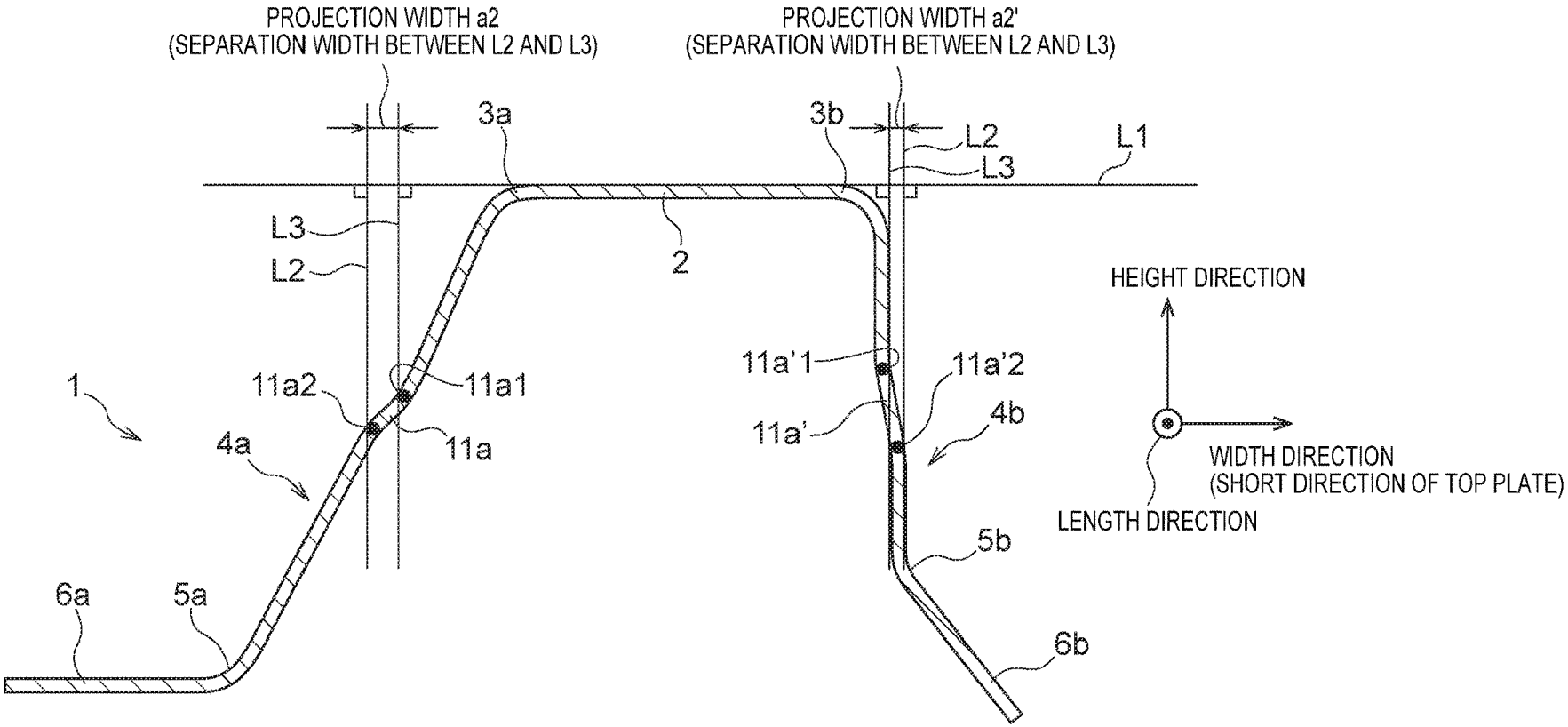
FIG. 11 is a diagram to explain the definition of a projection width of a step in the first exemplary embodiment.

FIG. 11 is a diagram to explain the projection width a2 of the steps 11*a*, 11*a*'. As illustrated in FIG. 11, the projection width a2 of the step 11*a* refers, for example, to a separation width between a vertical line L2 passing through the protrusion 11*a*2 and a vertical line L3 passing through the recess 11*a*1, with respect to a hypothetical line L1 joining together the two ends of the top plate 2 when viewed in cross-section perpendicular to the length direction of the roof member 1. Note that the hypothetical line L1 joining together the two ends of the top plate 2 is a hypothetical line L1 joining together the convex ridge line 3*a* and the convex ridge line 3*b*, as illustrated in FIG. 11.

As illustrated in FIG. 1C and FIG. 1D, in the roof member 1, the cross-section profile of the flanges 6*a*, 6*b* differs between the front end portion 1*a* and the rear end portion 1*b*. Specifically, the angle between the vertical wall 4*b* and the flange 6*b* is set to 30° at the front end portion 1*a*, and is set to 40° at the rear end portion 1*b*. Note that the respective angles between the flanges 6*a*, 6*b* and the vertical wall 4*a* change progressively along the length direction. Moreover, the short direction width of the top plate 2 changes so as to become progressively wider, namely larger, from the front end portion 1*a* to the rear end portion 1*b* along the length direction. Note that as illustrated in FIG. 1A to FIG. 1D, an angle formed between the vertical wall 4*b* and the flange 6*b* at the first portion 8 is preferably the angle formed between the vertical wall 4*b* and the flange 6*b* at the third portion 10 or greater.

The foregoing was an explanation regarding configuration of the roof member 1 of the present exemplary embodiment.

Press Apparatus Configuration

Next, explanation follows regarding the press apparatus 17 of the present exemplary embodiment, with reference to the drawings. The press apparatus 17 of the present exemplary embodiment is used to manufacture the roof member 1 of the present exemplary embodiment. As illustrated in FIG. 2A, FIG. 2B, FIG. 3A, and FIG. 3B, the press apparatus 17 is configured including a first press device 18 and a second press device 19. The press apparatus 17 of the present exemplary embodiment employs the first press device 18 to draw a blank BL, illustrated in FIG. 2B, for example, so as to press the blank BL to form an intermediate formed component 30, illustrated in FIG. 3B, for example, and then uses the second press device 19 to press the intermediate formed component 30 to manufacture a manufactured component, namely the roof member 1. Note that the blank BL is configured by elongated high tensile sheet steel as a base material for manufacturing the roof member 1.

Figure 3A:
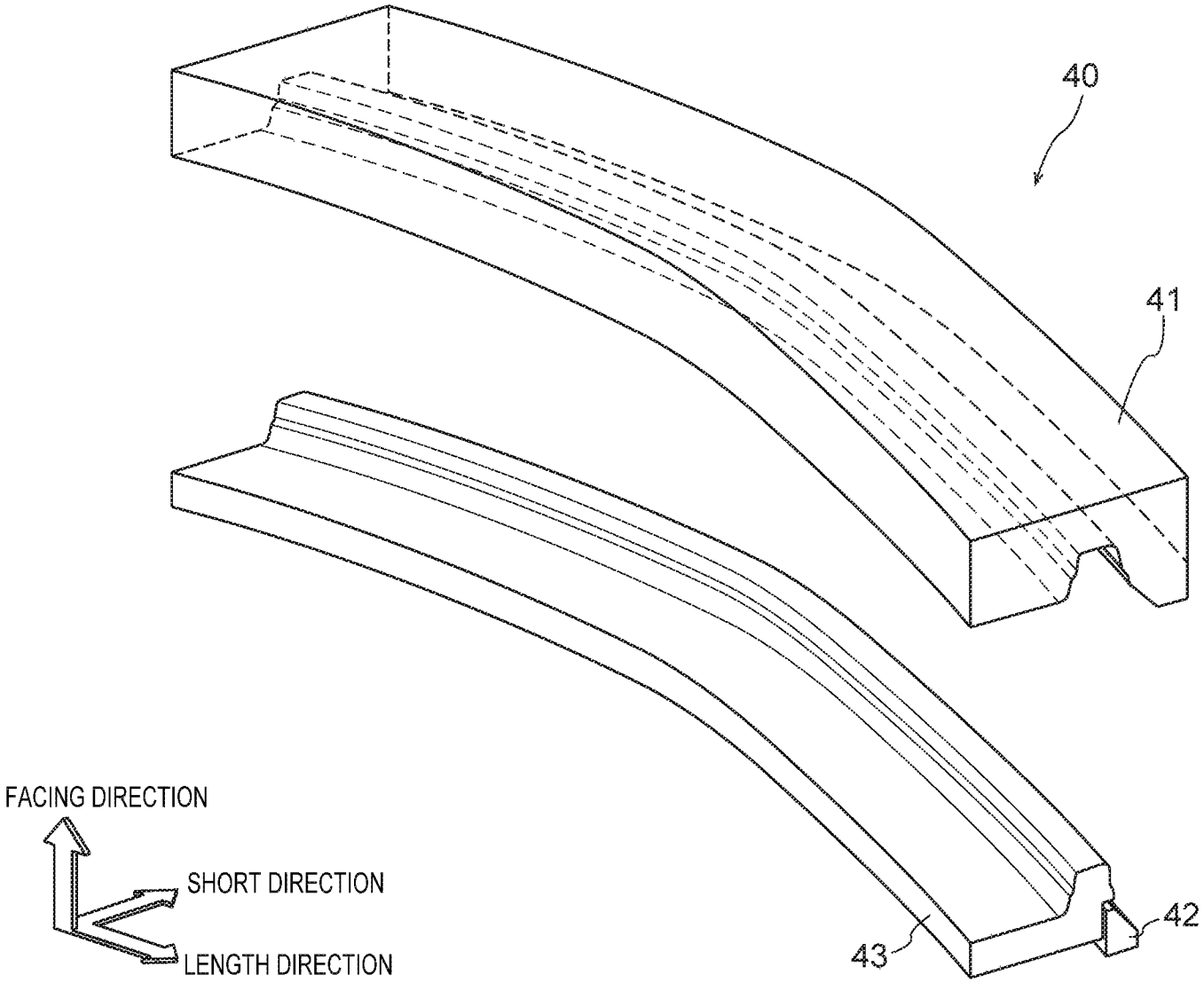
FIG. 3A is a perspective view of a mold of a second press device employed in a second process of the roof member manufacturing method of the first exemplary embodiment.
Figure 3B:
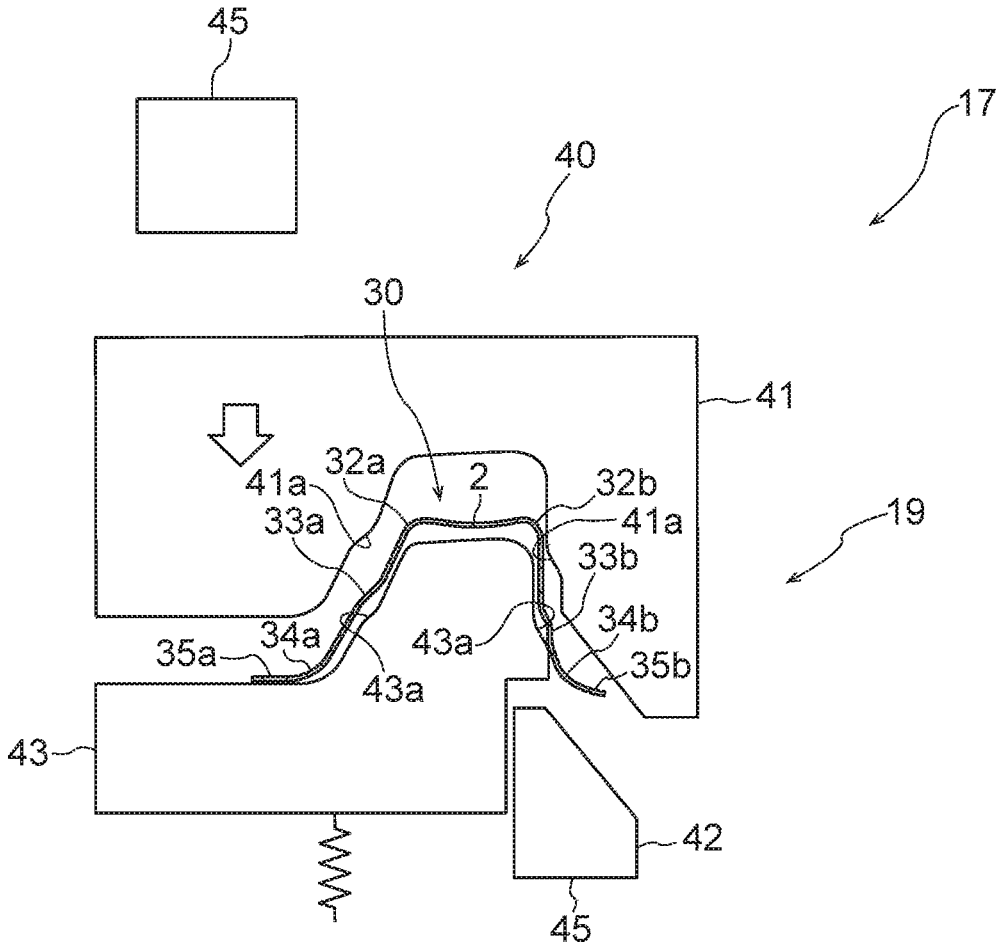
FIG. 3B is a vertical cross-section of a second press device employed in the second process of the roof member manufacturing method of the first exemplary embodiment.

Note that as illustrated in FIG. 3B, the intermediate formed component 30 is a substantially hat-shaped member configured including the top plate 2, two ridge lines 32*a*, 32*b*, two vertical walls 33*a*, 33*b*, two concave ridge lines 34*a*, 34*b*, and two flanges 35*a*, 35*b*. Moreover, in the present specification, "pressing" refers to a process spanning, for example, setting a forming target such as the blank BL or the intermediate formed component 30 in a mold such as a first mold 20 or a second mold 40, described later, closing the mold, and then opening the mold. Namely, in the present specification, "pressing" refers to forming by pressing (applying pressure to) a forming target.

First Press Device

The first press device 18 has a function of pressing the blank BL, this being the forming target, to form the intermediate formed component 30.

The first press device 18 is configured including the first mold 20 and a first moving device 25. As illustrated in FIG. 2B, the first mold 20 includes an upper mold 21, a lower mold 22, a first holder 23, and a second holder 24. Note that the upper mold 21 is an example of a first die. Moreover, the lower mold 22 is an example of a first punch. The upper mold 21 is disposed at the upper side, and the lower mold 22 is disposed at the lower side. When forming the blank BL into the intermediate formed component 30, the first press device 18 sandwiches a portion of the blank BL that will form the top plate 2 between the upper mold 21 and the lower mold 22, and indents the portion of the blank BL that will form the top plate 2 from the upper mold 21 side toward the lower mold 22 side.

Figure 2A:
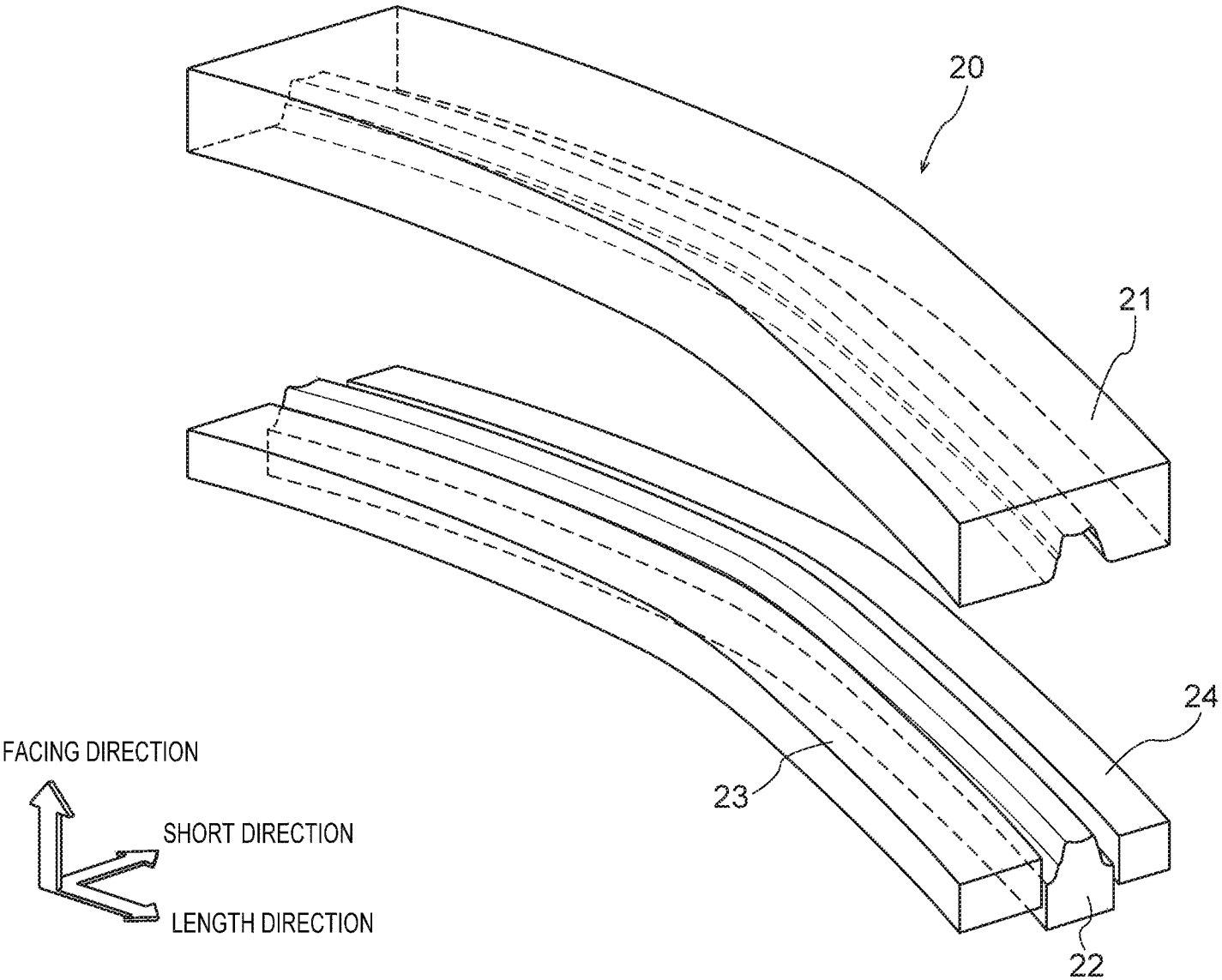
FIG. 2A is a perspective view of a mold of a first press device employed in a first process of a roof member manufacturing method of the first exemplary embodiment.
Figure 2B:
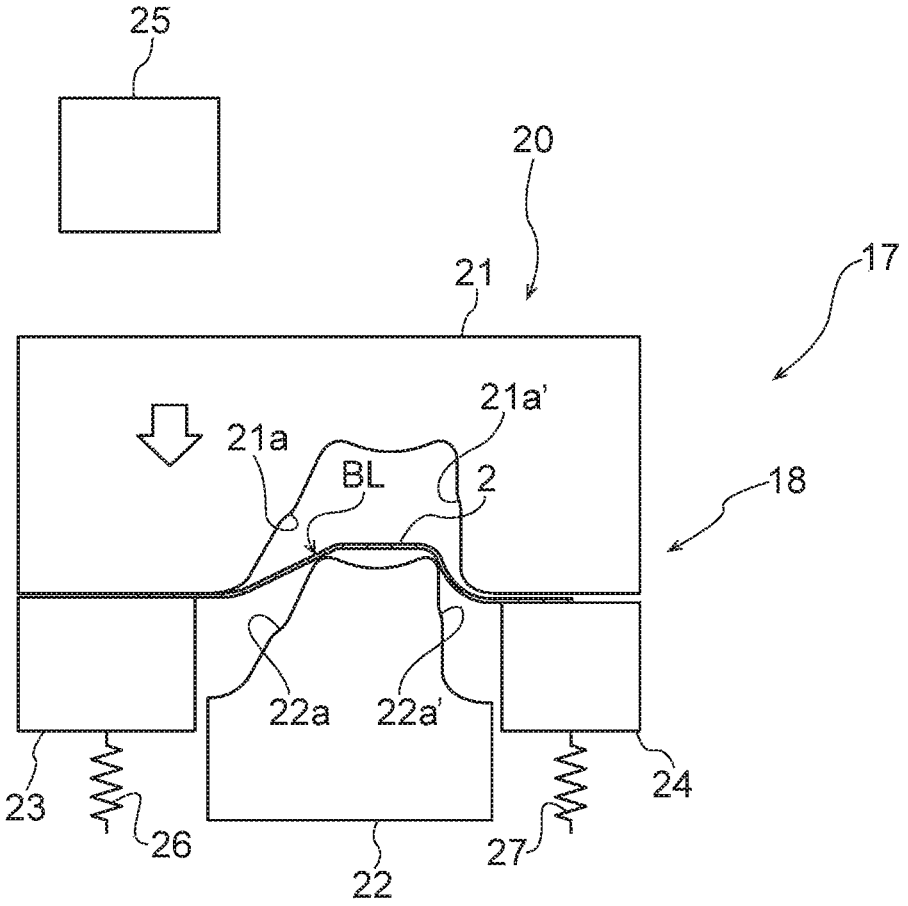
FIG. 2B is a vertical cross-section of a first press device employed in the first process of the roof member manufacturing method of the first exemplary embodiment.

As illustrated in FIG. 2A, the upper mold 21 and the lower mold 22 are both elongated. When the upper mold 21 and the lower mold 22 are viewed along the direction in which the upper mold 21 and the lower mold 22 face each other, as illustrated in FIG. 2A and FIG. 2B, the lower mold 22 projects out in a curve along its length direction, and the upper mold 21 is formed with a groove that curves following the lower mold 22. As illustrated in FIG. 2A and FIG. 2B, when the upper mold 21 and the lower mold 22 are viewed along a direction orthogonal to the direction in which the upper mold 21 and the lower mold 22 face each other, namely across the short direction of the upper mold 21 and the lower mold 22, the lower mold 22 is curved in a convex shape bowing toward the upper mold 21 side, and the upper mold 21 is formed with a groove that curves following the lower mold 22. Moreover, as illustrated in FIG. 2B, as viewed along its length direction, the bottom of the groove in the upper mold 21 projects toward the lower mold 22 side with a radius of curvature R (mm), and a portion of the lower mold 22 facing the bottom of the groove in the upper mold 21 is indented so as to open toward the upper mold 21 side with the radius of curvature R (mm). Note that the radius of curvature R (mm) of the present exemplary embodiment is, for example, set to 100 mm. Moreover, when viewed across the short direction of the upper mold 21, the width of the groove in the upper mold 21 becomes progressively wider from the groove bottom toward the open side of the groove, namely from the upper side toward the lower side. When the lower mold 22 is viewed across the short direction of the lower mold 22, the width of a first projection, described later, configuring the projecting portion becomes progressively narrower from the lower side toward the upper side.

Moreover, as illustrated in FIG. 2B, as viewed along the length direction of the lower mold 22, the two side faces of the lower mold 22 are respectively formed with steps 22*a*. The two side faces of the groove in the upper mold 21 are formed with steps 21*a* that respectively follow the steps 22*a*.

The first holder 23 and the second holder 24 are elongated so as to follow the upper mold 21 and the lower mold 22. As illustrated in FIG. 2B, the first holder 23 and the second holder 24 are respectively disposed at the two short direction sides of the lower mold 22. Moreover, the first holder 23 and the second holder 24 are biased toward the upper side by springs 26, 27.

The first moving device 25 is configured to move the upper mold 21 toward the lower mold 22. Namely, the first moving device is configured to move the upper mold 21 relative to the lower mold 22.

In a state in which the blank BL has been disposed at a predetermined position in a gap between the upper mold 21 and the lower mold 22, the first moving device 25 moves the upper mold 21 toward the lower mold 22, as illustrated in FIG. 2B, thereby pressing the blank BL to form the intermediate formed component 30 in a state in which the two short direction end sides of the blank BL are respectively sandwiched between the first holder 23 and the upper mold 21, and the second holder 24 and the upper mold 21. Moreover, the blank BL is pressed by the steps 22*a* and the steps 21*a* accompanying formation of the intermediate formed component 30, such that portions of the vertical walls 33*a*, 33*b* at a distance of not less than 40% of the height of the vertical walls 33*a*, 33*b* from the position of the top plate 2 are formed with the steps 11*a*, 11*a*' having the projection width a1 (*mm*), as illustrated in FIG. 5A, FIG. 5B, FIG. 6A, and FIG. 6B. Note that as a result configuring the shape of the groove in the upper mold 21 and the shape of the first projection configuring the projection of the lower mold 22 as described above, the steps 11*a*, 11*a*' are inclined such that a spacing across which the steps 11*a*, 11*a*' face each other is larger at the opening side than at the top plate 2 side as viewed across the short direction of the top plate 2. From another perspective, it may be said that since the steps 11*a*, 11*a*' are inclined such that the spacing across which the steps 11*a*, 11*a*' face each other is larger at the opening side than at the top plate 2 side, the intermediate formed component 30 formed with the steps 11*a*, 11*a*' is formed by pressing.

Explanation has been given above regarding the first press device 18. However, from another perspective, the first press device 18 may be described in the following manner. Namely, the upper mold 21 is formed with a first groove, this being an elongated groove configured including a first groove-bottom face configured as an elongated groove-bottom face, and first side faces configured by side faces connected to the two short direction ends of the first groove-bottom face. Moreover, each first side face is curved as viewed along a mold closing direction, namely the direction in which the upper mold 21 and the lower mold 22 face each other, and a first curved face configured by a curved face in which the steps 11*a*, 11*a*' having a width of not more than 20% of the short direction width of the first groove-bottom face are respectively formed along the length direction of the first side face at a position at a specific depth that is at a distance of not less than 40% of the depth of the first groove from the first groove-bottom face. Moreover, the lower mold 22 fits into the first groove during mold closure. Note that the steps 11*a*, 11*a*' are an example of a first step.

Second Press Device

The second press device 19 has a function of pressing the intermediate formed component 30, this being a forming target, so as to narrow the projection width of steps 36*a*, 36*a*' formed to the vertical walls 33*a*, 33*b* of the intermediate formed component 30 with the projection width a1. Namely, the second press device 19 has a function of setting the projection width of the steps 36*a*, 36*a*' to a projection width a2 that is narrower than the projection width a1.

The second press device 19 is configured including the second mold 40 and a second moving device 45. As illustrated in FIG. 3B, the second mold 40 includes an upper mold 41, a lower mold 43, and a holder 42. Note that the upper mold 41 is an example of a second die. Moreover, the lower mold 43 is an example of a second punch. The upper mold 41 is disposed at the upper side, and the lower mold 43 is disposed at the lower side. The lower mold 43 is biased from the lower side by a spring 46. Moreover, in the second press device 19, in a state in which the intermediate formed component 30 has been fitted onto the lower mold 43, the upper mold 41 is moved toward the lower mold 43 side by the second moving device so as to change the angles of the two flanges 35*a*, 35*b* of the intermediate formed component 30.

As illustrated in FIG. 3B, when the lower mold 43 is viewed across its short direction, steps 43*a* are respectively formed on the two side faces of the lower mold 43. The two side faces of a groove in the upper mold 41 are respectively formed with steps 41*a* that follow the steps 43*a*. The width of the steps 43*a*, namely the width in the short direction of the lower mold 43, is narrower than the width of the steps 22*a* of the first press device 18. Moreover, the width of the steps 41*a*, namely the width in the short direction of the lower mold 43, is narrower than the width of the steps 21*a* of the first press device 18. Note that when the upper mold 41 is viewed across the short direction of the upper mold 43, the groove width becomes progressively wider from the groove bottom toward the open side of the groove, namely from the upper side toward the lower side. When the lower mold 43 is viewed across the short direction of the lower mold 43, the width of a second projection, described later, configured by a projecting portion becomes progressively narrower from the lower side toward the upper side.

Moreover, when the first moving device moves the upper mold 41 toward the lower mold 43 in a state in which the blank BL has been disposed on the lower mold 43, the intermediate formed component 30 is pressed so as to form the roof member 1. Note that accompanying formation of the intermediate formed component 30, a portion of the vertical wall 33*a* further toward the upper side than the step 36*a*, namely a portion on the top plate 2 side, is bent toward the opposite side to the side on which the vertical walls 33*a*, 33*b* face each other, namely the opposite side to the facing side, namely, toward the outside. Moreover, the projection width of the step 36*a* having the projection width a1 is set to the projection width a2 that is narrower than the projection width a1. Moreover, accompanying formation of the intermediate formed component 30, a portion of the vertical wall 33*b* further toward the upper side than the step 36*a*', namely a portion on the top plate 2 side, is bent toward the opposite side to the side on which the vertical walls 33*a*, 33*b* face each other, namely the opposite side to the facing side, namely, toward the outside. Moreover, the projection width of the step 36*a*' having the projection width a1 is set to the projection width a2 that is narrower than the projection width a1. Note that as a result of configuring the shape of the groove in the upper mold 41 and the shape of the second projection configuring the projection of the lower mold 43 as described above, the steps 43*a*, 41*a* are inclined such that a spacing across which the steps 43*a*, 41*a* face each other is larger at the opening side than at the top plate 2 side as viewed across the short direction of the top plate 2. From another perspective, it may be said that since the steps 11*a*, 11*a*' are inclined such that the spacing across which the steps 11*a*, 11*a*' face each other is larger at the opening side than at the top plate 2 side, the roof member 1 formed with the steps 11*a*, 11*a*' is formed by pressing.

Explanation has been given above regarding the second press device 19. However, from another perspective, the second press device 19 may be described in the following manner. Namely, the upper mold 41 is formed with a second groove, this being an elongated groove configured including a second groove-bottom face configuring a groove-bottom face having the same shape as the first groove-bottom face configuring the groove-bottom face of the upper mold 21 of the first press device 18 as viewed along the mold closing direction, and second side faces configured by side faces connected to the two short direction ends of the second groove-bottom face. Moreover, each second side face is curved as viewed along the mold closing direction, namely the direction in which the upper mold 41 and the lower mold 43 face each other, and configures a second curved face formed with second steps along the length direction of the second side face at a position at the specific depth described above from the second groove-bottom face. Moreover, the second steps are narrower in width (here, "width" refers to the width in the short direction of the first groove-bottom face or the second groove-bottom face) than the first steps of the upper mold 21 of the first press device 18, and the separation distance from the second groove-bottom face in the short direction of the second groove-bottom face is longer than the separation distance between the first groove-bottom face and the first steps in the short direction of the first groove-bottom face. Moreover, the lower mold 43 is adapted so as to fit together with the shape of the second groove during mold closure. Namely, the shape of the lower mold 43 is configured as a shape that fits together with the second groove during mold closure.

The foregoing was an explanation regarding the configuration of the press apparatus 17 of the present exemplary embodiment.

Roof Member Manufacturing Method

Next, explanation follows regarding a manufacturing method of the roof member 1 of the present exemplary embodiment, with reference to the drawings. The manufacturing method of the roof member 1 of the present exemplary embodiment is performed employing the press apparatus 17. Moreover, the manufacturing method of the roof member 1 of the present exemplary embodiment includes a first process, this being a process performed using the first press device 18, and a second process, this being a process performed using the second press device 19.

First Process

In the first process, the blank BL is disposed at a predetermined position in the gap between the upper mold 21 and the lower mold 22. Next, an operator operates the first press device 18 such that the upper mold 21 is moved toward the lower mold 22 side by the first moving device, and the blank BL is drawn so as to press the blank BL. Namely, in the first process, the upper mold 21 and the lower mold 22 are employed to press the blank BL, this being a forming target. The intermediate formed component 30 is formed from the blank BL as a result.

Specifically, in the first process, as illustrated in FIG. 5A, FIG. 5B, FIG. 6A, and FIG. 6B, the two vertical walls 33*a*, 33*b* of the intermediate formed component 30 are formed with the steps 36*a*, 36*a*' having the projection width a1 defined by Equation (1) and Equation (2) below, at a portion in a range of less than 60% of the height h from the respective flanges 35*a*, 35*b*. In other words, in the first process, the steps 11*a*, 11*a*' having the projection width a1 defined by Equation (1) and Equation (2) below, are formed at portions of the two vertical walls 33*a*, 33*b* of the intermediate formed component 30 at a distance of not less than 40% of the height of the vertical walls 33*a*, 33*b* from the position of the top plate 2. Namely, according to Equation (1) below, the projection width a1 of the steps 36*a*, 36*a*' formed in the first process is wider than the projection width a2 in the roof member 1 configuring a manufactured component, and is a width that is not more than 20% of the width W of the roof member 1 in the short direction of the top plate 2.

$$a1 \geq a2 \quad (1)$$

$$a1 \leq 0.2W \quad (2)$$

Note that the reference sign a1 is the projection width (mm) of the steps 33*a*, 33*b* of the intermediate formed component 30, the reference sign a2 is the projection width (mm) of the steps 11*a*, 11*a*' of the roof member 1, and the reference sign W is the width (mm) of the roof member 1 in the short direction of the top plate 2.

Figure 7A:
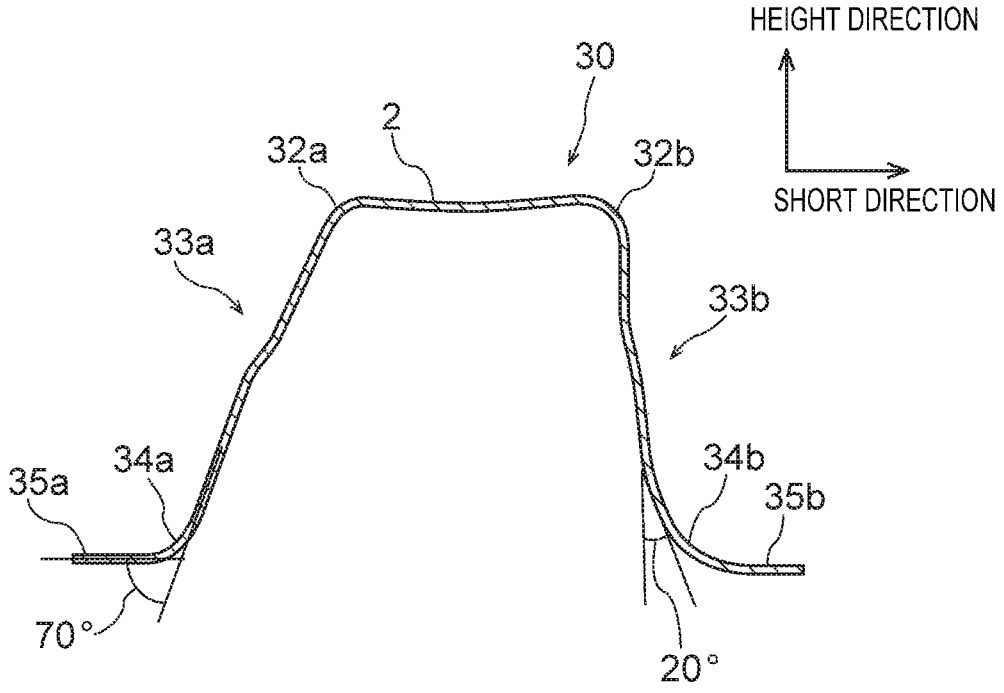
FIG. 7A is a cross-section along 1C-1C in FIG. 1A for an intermediate formed component formed by the first process of the first exemplary embodiment, and is a cross-section illustrating an angle formed between a vertical wall and a flange in detail.
Figure 7B:
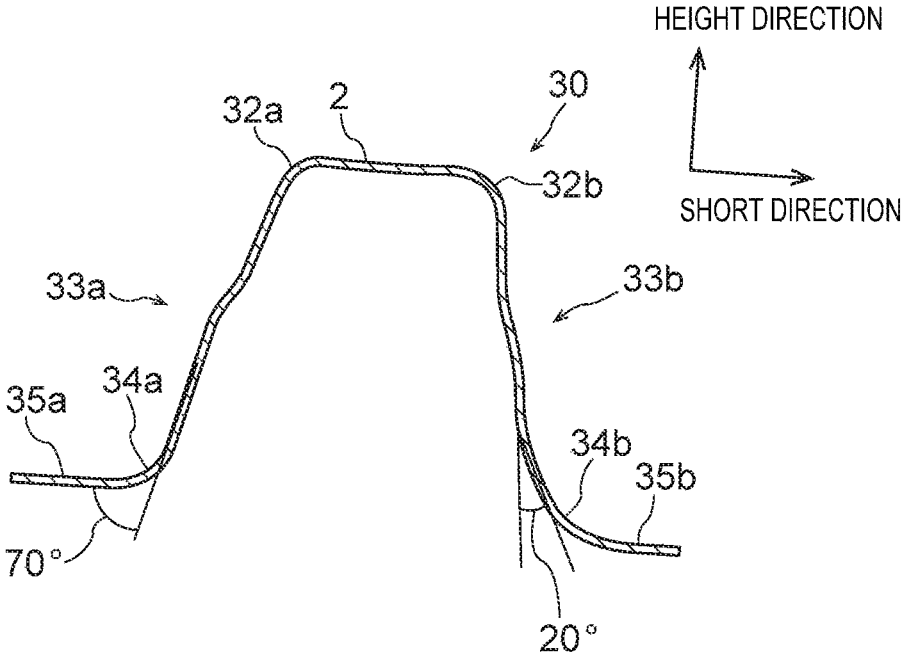
FIG. 7B is a cross-section along 1D-1D in FIG. 1A for an intermediate formed component formed by the first process of the first exemplary embodiment, and is a cross-section illustrating an angle formed between a vertical wall and a flange in detail.
Figure 7C:
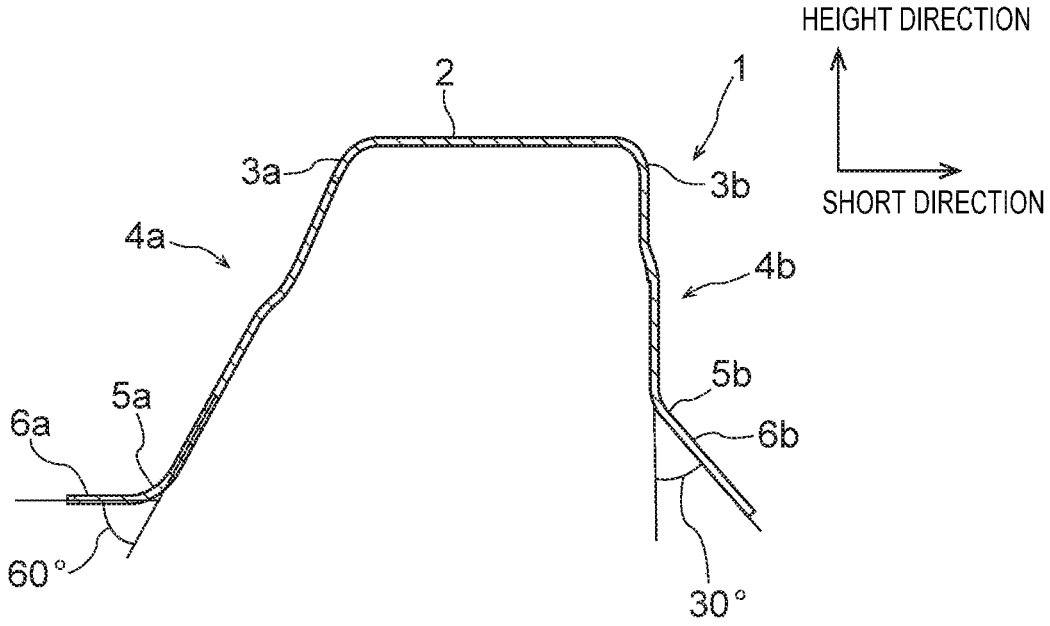
FIG. 7C is a cross-section along 1C-1C in FIG. 1A for a roof member manufactured by undergoing the second process of the first exemplary embodiment, and is a cross-section illustrating an angle formed between a vertical wall and a flange in detail.
Figure 7D:
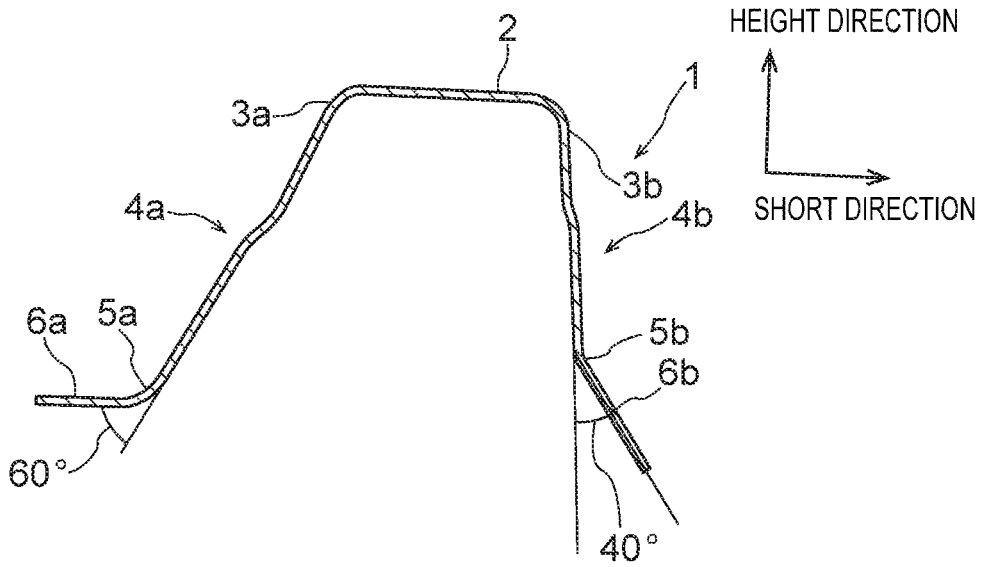
FIG. 7D is a cross-section along 1D-1D in FIG. 1A for a roof member manufactured by undergoing the second process of the first exemplary embodiment, and is a cross-section illustrating an angle formed between a vertical wall and a flange in detail.
Figure 8A:
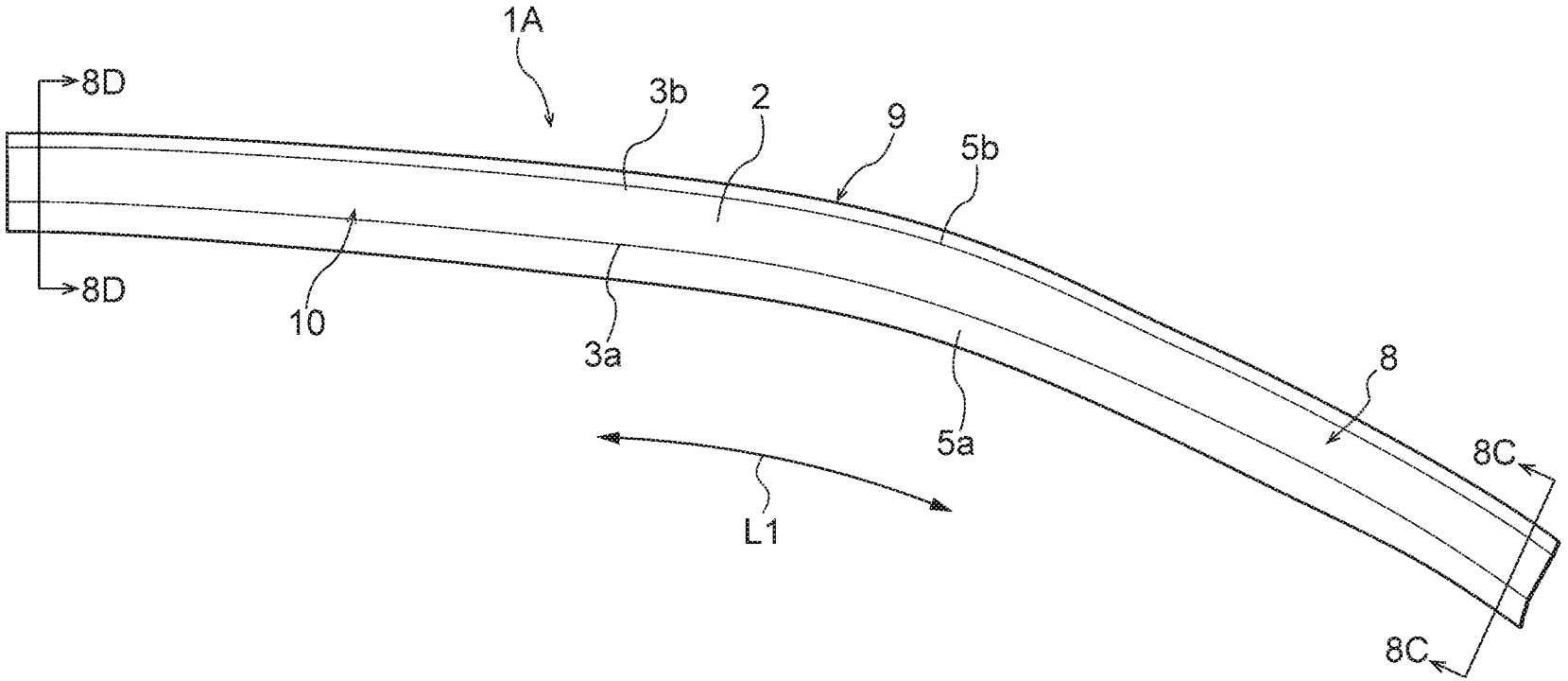
FIG. 8A is a plan view illustrating a roof member of a second exemplary embodiment.
Figure 8B:
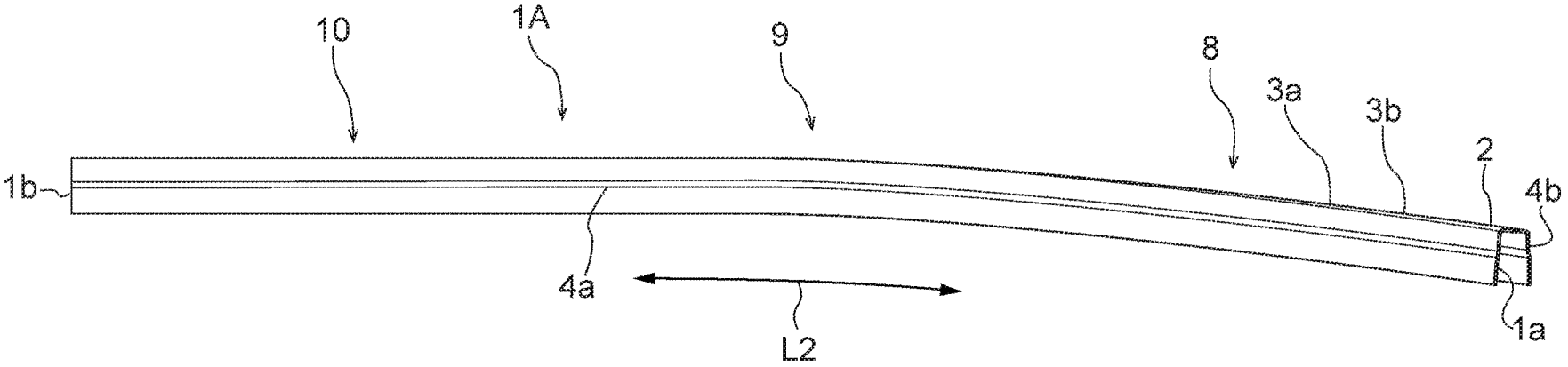
FIG. 8B is a side view illustrating a roof member of the second exemplary embodiment.
Figure 8C:
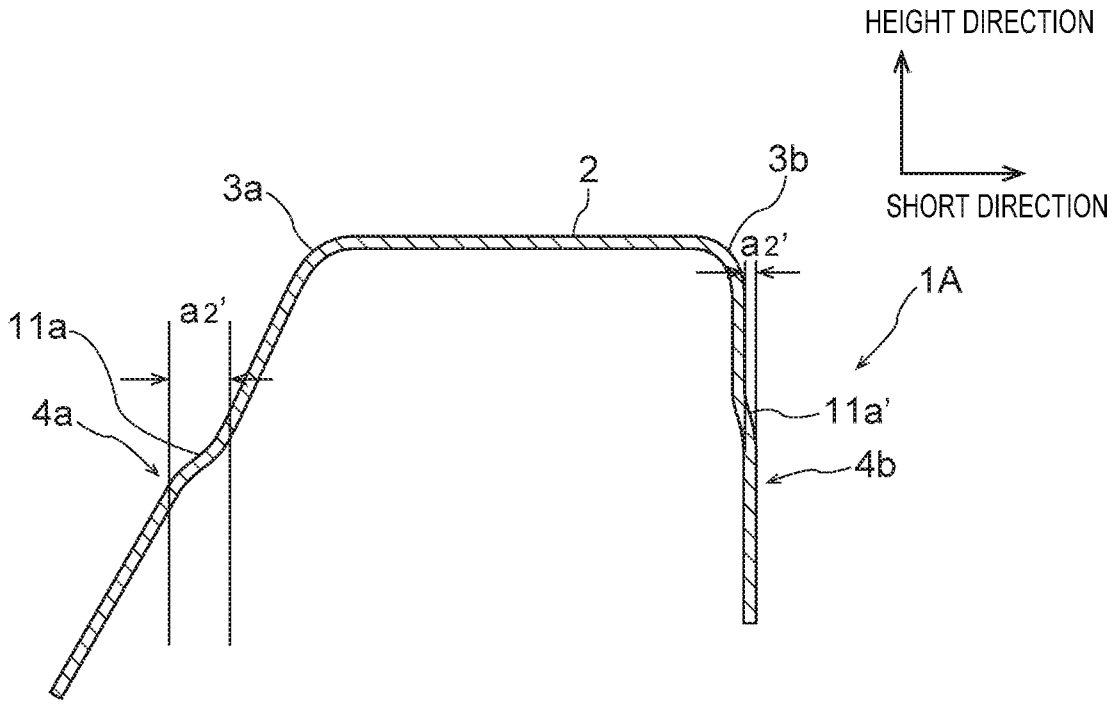
FIG. 8C is a cross-section along 8C-8C in FIG. 8A.
Figure 8D:
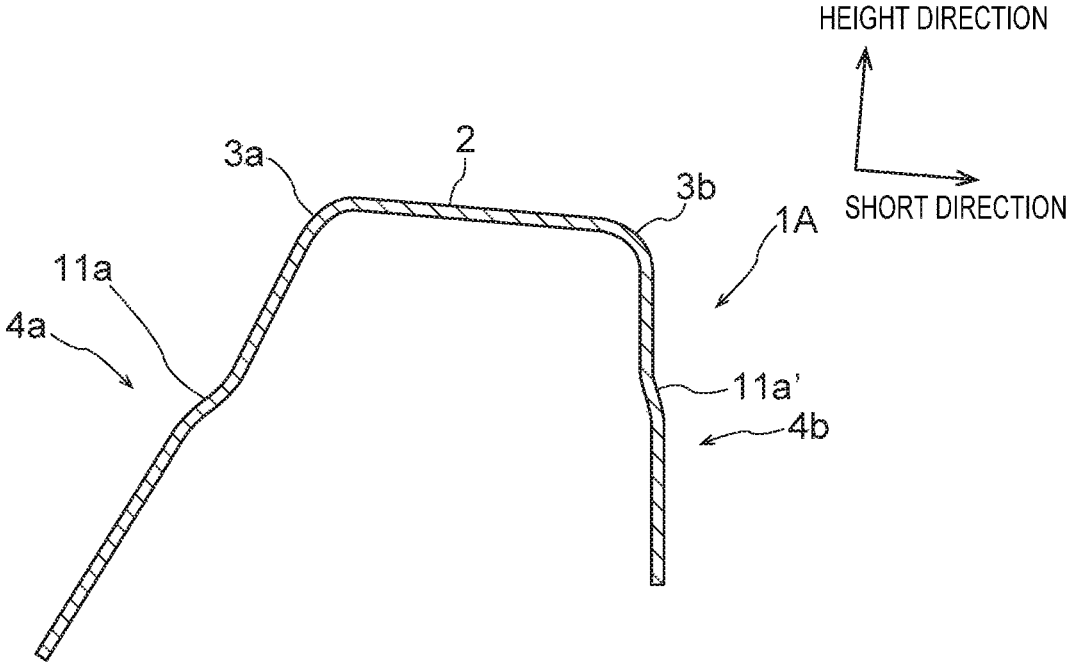
FIG. 8D is a cross-section along 8D-8D in FIG. 8A.

Moreover, in the first process, as illustrated in FIG. 7A and FIG. 7B, the vertical wall 33*a* and the flange 35*a* are formed such that an angle DI1 formed between the vertical wall 33*a* and the flange 35*a* of the intermediate formed component 3 satisfies the following Equation (3).

$$1.0 \times DI2 \leq DI1 \leq 1.2 \times DI2 \quad (3)$$

The reference sign DI1 is the angle formed between the vertical wall 33*a* and the flange 35*a* of the intermediate formed component 30, and the reference sign DI2 is the angle formed between the vertical wall 4*a* and the flange 6*a* of the roof member 1.

Moreover, in the first process, the vertical wall 33*b* and the flange 35*b* of the intermediate formed component 30 are formed so as to satisfy the following Equation (4).

$$0.9 \leq DOF1/DOR1 \leq 1 \quad (4)$$

Note that DOF1 is the angle formed between the flange 35*b* and the vertical wall 33*b* at the front end portion 1*a* of the intermediate formed component 30, and DOR1 is the angle formed between flange 35*b* and the vertical wall 33*b* at the rear end portion 1*b* of the intermediate formed component 30.

Moreover, in the first process, an edge of the material of the blank BL flows in and the blank BL is flexed so as to form the flange 35*b* at the outside of the intermediate formed component 30.

The intermediate formed component 30 is then removed from the first mold 20, thereby completing the first process.

Figure 4A:
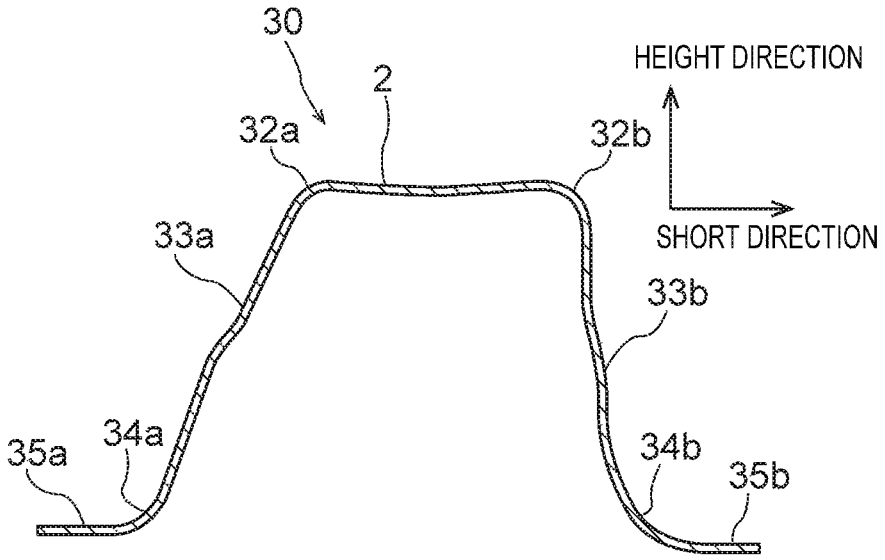
FIG. 4A is a cross-section along 1C-1C in FIG. 1A for an intermediate formed component formed by the first process of the first exemplary embodiment.
Figure 4B:
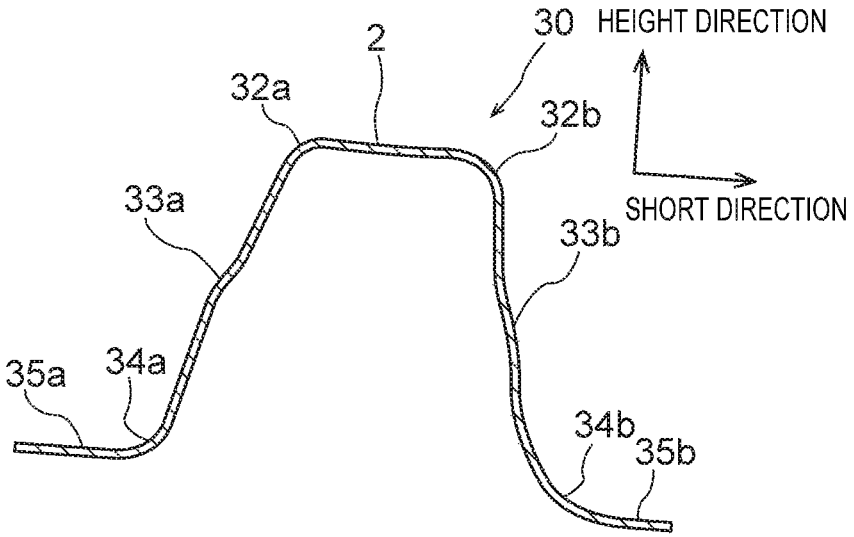
FIG. 4B is a cross-section along 1D-1D in FIG. 1A for an intermediate formed component formed by the first process of the first exemplary embodiment.

Note that when the first mold 20 is opened, namely, when the first process is completed, as illustrated in FIG. 4A and FIG. 4B, a cross-section of the intermediate formed component 30 orthogonal to the length direction of the top plate 2 deforms into a flatter shape than when the mold was closed, namely, in a state in which the radius of curvature has been enlarged. In other words, in the first process, the blank BL is deformed so as to protrude toward the upper side by the time that the mold closes, and then the portion of the blank BL that will form the top plate 2 is deformed so as to protrude toward the lower side when the mold is closed. The intermediate formed component 30 is then formed when the mold is opened. Accordingly, the top plate 2 and the convex ridge lines 3*a*, 3*b* of the intermediate formed component 30 of the present exemplary embodiment are subjected to a load from the upper side toward the lower side after being plastically deformed toward the upper side, thereby attaining a state in which the Bauschinger effect acts.

Second Process

The intermediate formed component 30 is then fitted onto the lower mold 43 of the second mold 40 of the second press device 19. Next, the operator operates the second press device 19 such that the upper mold 41 is moved toward the lower mold 43 side by the second moving device, thereby pressing the intermediate formed component 30. Namely, in the second process, the blank BL that has been formed using the upper mold 21 and the lower mold 22 in the first process is pressed. The roof member 1 is thereby formed from the intermediate formed component 30 as a result.

Figure 12:
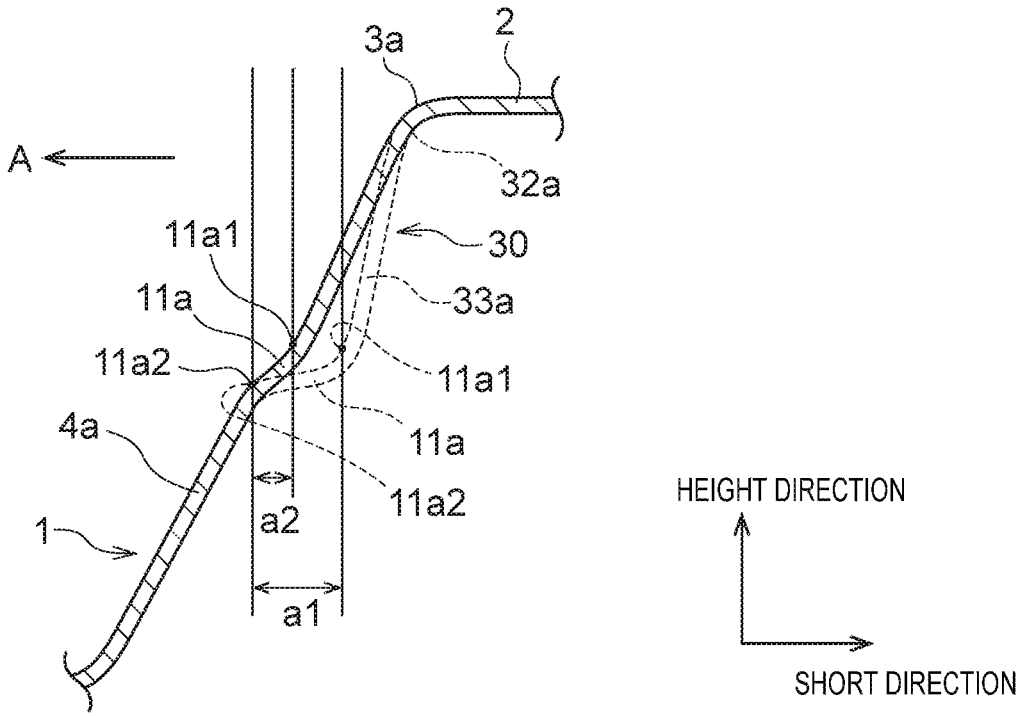
FIG. 12 is a schematic diagram illustrating a state in which part of a vertical cross-section of a length direction central portion of an intermediate formed component 30 of the first exemplary embodiment is overlaid on part of a vertical cross-section of a length direction central portion of a roof member 1.
Figure 13:
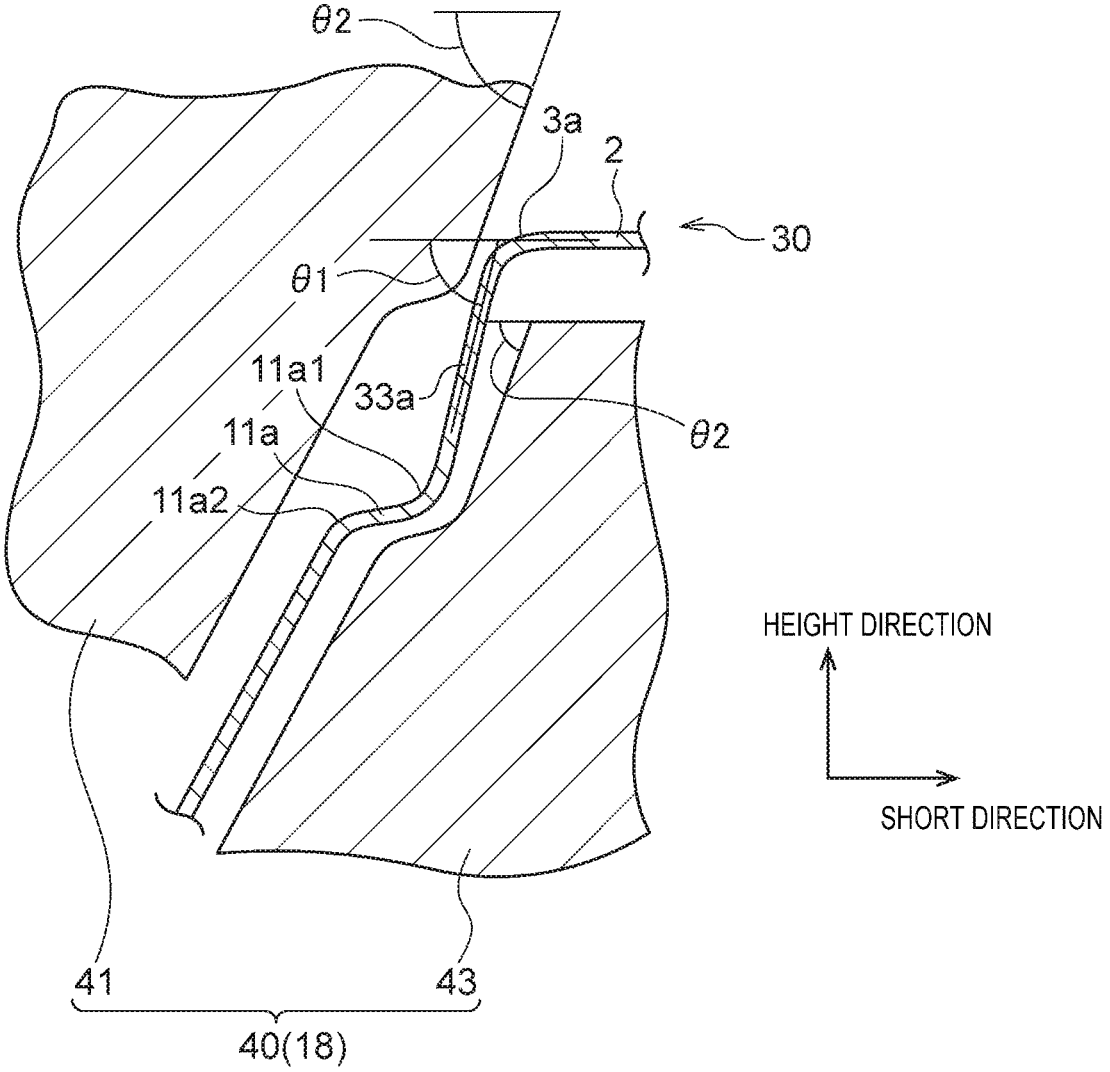
FIG. 13 is a schematic diagram illustrating a state in which an intermediate formed component has been set in a mold in the second process of the first exemplary embodiment, prior to mold closure.

Specifically, in the second process, the angles of the two flanges 35*a*, 35*b* of the intermediate formed component 30 are changed. Moreover, in the second process, as illustrated in FIG. 6A, FIG. 6B, FIG. 6C, FIG. 6D, and FIG. 12, the angles of respective portions of the vertical walls 33*a*, 33*b* of the intermediate formed component 30 further toward the upper side than the steps 36*a*, 36*a*', namely of portions on the top plate 2 side of the vertical walls 33*a*, 33*b*, are changed such that the projection width of the steps 36*a*, 36*a*' is set to the projection width a2 that is narrower than the projection width a1. Note that in the present exemplary embodiment, as illustrated in FIG. 12, in the vertical wall 33*a* of the intermediate formed component 30 formed in the first process, the portion further toward the upper side than the step 36*a* is rotated about an axis of the convex ridge line 3*a* or the convex ridge line 32*a* toward the opposite direction to the direction in which the vertical walls 33*a*, 33*b* face each other, namely toward the arrow A direction side illustrated in FIG. 12. As a result, in the second process, the recess 11*a*1 is moved toward the arrow A direction side by the upper mold 41 without moving the protrusion 11*a*2 of the step 11*a* while the intermediate formed component 30 is restrained by the lower mold 43. Although not illustrated in the drawings, in the vertical wall 33*b* of the intermediate formed component 30 formed in the first process, a portion further toward the upper side than the step 36*b* is rotated toward the opposite side to the arrow A direction about an axis of the convex ridge line 3*b* or the convex ridge line 32*b*. As a result, in the second process, the recess 11*a*1 is moved toward the opposite side to the arrow A direction without moving the protrusion 11*a*2 of the step 11*a*' of the intermediate formed component 30. In the above manner, in the second process, the projection widths of the steps 11*a*, 11*a*' of the intermediate formed component 30 are respectively set to the projection widths a2, a2', these being narrower than the projection widths a1, a1'. Accompanying this process, in the second process, in the vertical wall 33*a* of the intermediate formed component 30, a portion further toward the upper side than the recess 11*a*1, namely than the step 36*a*, is moved in the opposite direction to the direction facing the vertical wall 33*b*. Moreover, in the second process, in the vertical wall 33*b* of the intermediate formed component 30, a portion further toward the upper side than the recess 11*a*'1, namely than the step 36*a*', is moved in the opposite direction to the direction facing the vertical wall 33*a*. Note that FIG. 13 schematically illustrates a state in which the intermediate formed component 30 has been fitted onto the lower mold 43 prior to closing the second mold 40 in the second process. Here, when the angle of inclination, namely the angle between the top plate 2 and the portion of the vertical wall 33*a* further toward the upper side than the step 36*a* is taken to be θ1, then an angle of inclination θ2 of portions of the upper mold 41 and the lower mold 43 on either side of the portion of the vertical wall 33*a* further toward the upper side than the step 36*a* is larger than the angle of inclination θ1. Moreover, although not illustrated in the drawings, the angle of inclination of portions of the upper mold 41 and the lower mold 43 on either side of the portion of the vertical wall 33*b* further toward the upper side than the step 36*b* is larger than the angle between the portion of the vertical wall 33*b* further toward the upper side than the step 36*b* and the top plate 2. As a result, in the second process of the present exemplary embodiment, the angles of the portions of the vertical walls 33*a*, 33*b* of the intermediate formed component 30 further toward the upper side than the steps 36*a*, 36*a*' are changed such that the projection width of the steps 36*a*, 36*a*' is set to the projection width a2, this being narrower than the projection width a1. Moreover, as illustrated in FIG. 7A, FIG. 7B, FIG. 7C, and FIG. 7D, in the second process, the intermediate formed component 30 is pressed such that the vertical wall 33*a* and the flange 35*a* of the intermediate formed component 30 become the vertical wall 4*a* and the flange 6*a* of the roof member 1. Moreover, as illustrated in FIG. 7A, FIG. 7B, FIG. 7C, and FIG. 7D, in the second process, the intermediate formed component 30 is pressed such that the vertical wall 33*b* and the flange 35*b* of the intermediate formed component 30 become the vertical wall 4*b* and the flange 6*b* of the roof member 1.

The foregoing was an explanation regarding the manufacturing method of the roof member 1 of the present exemplary embodiment.

Advantageous Effects

Next, explanation follows regarding advantageous effects of the present exemplary embodiment, with reference to the drawings.

First Advantageous Effect

Generally, when pressing a blank to manufacture a formed component, not illustrated in the drawings, configured including a curved wall that curves in a concave shape opening toward the side of another wall as viewed from an upper side, namely as viewed from a top plate side, residual compressive stress is liable to occur in the curved wall that is formed. The formed component is then liable to bend as viewed from the top plate side when the residual compressive stress in the curved wall of the formed component is released. Note that in the present specification, "residual stress", namely residual compressive stress and residual tensile stress, refer to stress that remains in the material at the pressing bottom dead center.

Figure 4C:
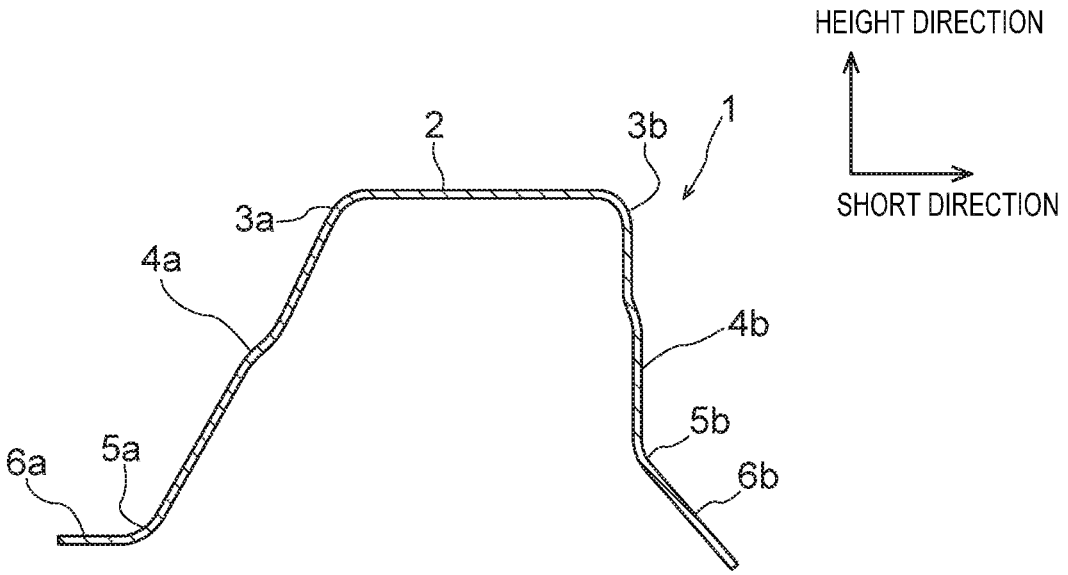
FIG. 4C is a cross-section along 1C-1C in FIG. 1A for a roof member manufactured by undergoing the second process of the first exemplary embodiment.
Figure 4D:
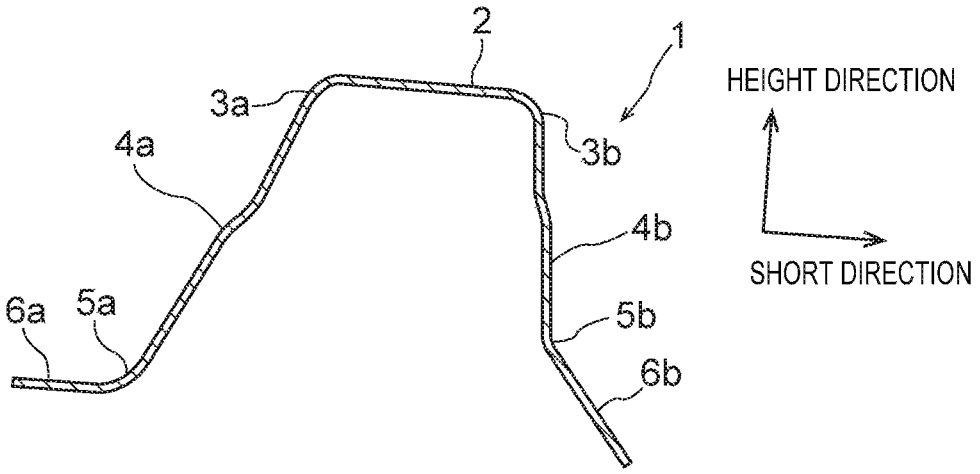
FIG. 4D is a cross-section along 1D-1D in FIG. 1A for an intermediate formed component formed by the second process of the first exemplary embodiment.
Figure 5A:
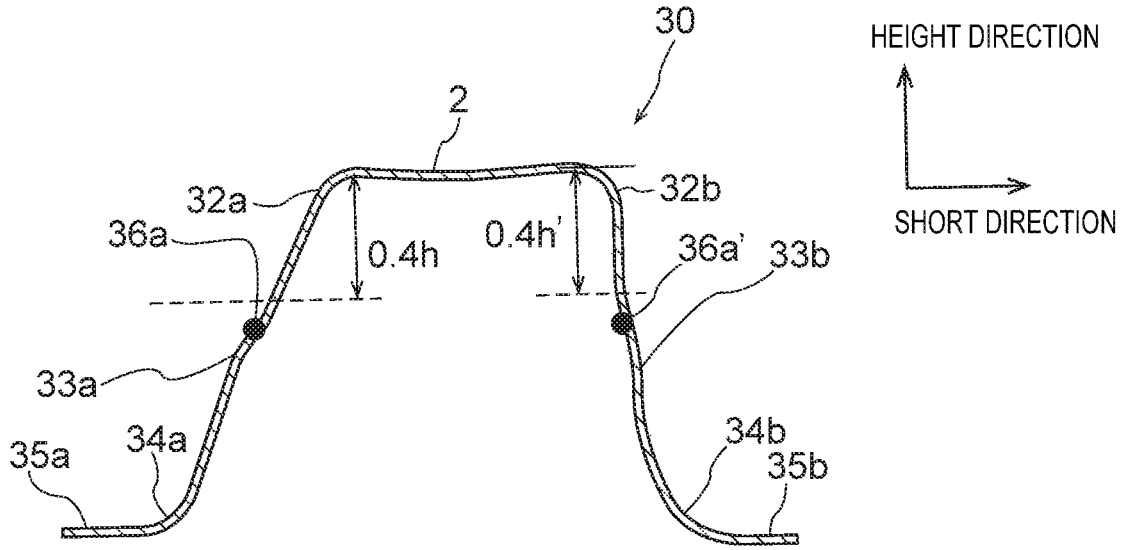
FIG. 5A is a cross-section illustrating the cross-section along 1C-1C in FIG. 1A for the intermediate formed component formed by the first process of the first exemplary embodiment in more detail.
Figure 5B:
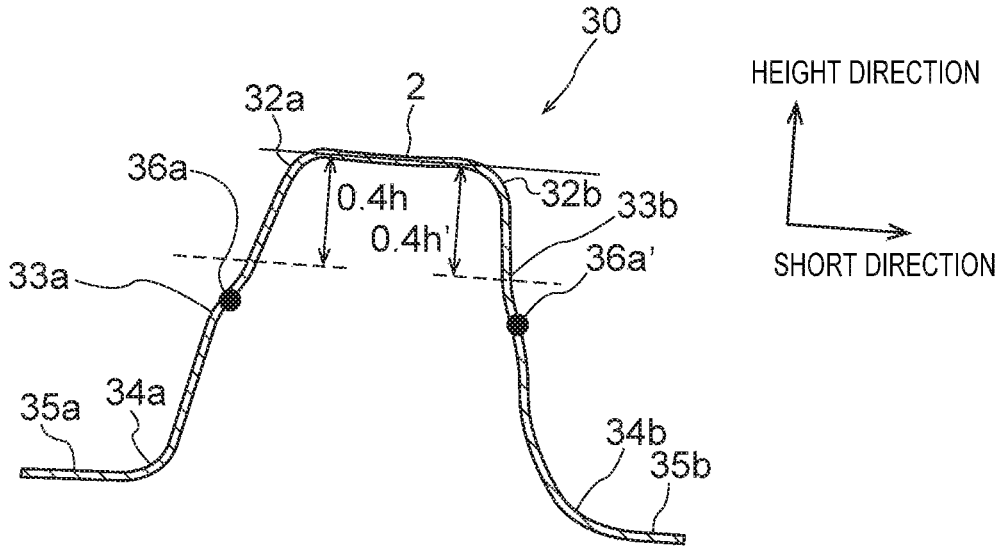
FIG. 5B is a cross-section illustrating the cross-section along 1D-1D in FIG. 1A for the intermediate formed component formed by the first process of the first exemplary embodiment in more detail.
Figure 5C:
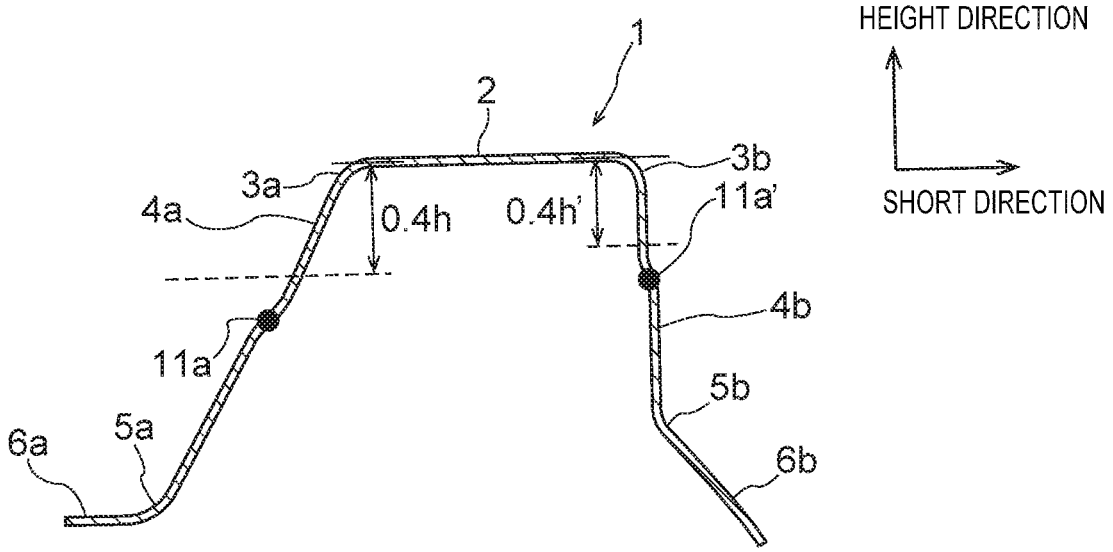
FIG. 5C is a cross-section illustrating the cross-section along 1C-1C in FIG. 1A for the roof member manufactured by undergoing the second process of the first exemplary embodiment in more detail.
Figure 5D:
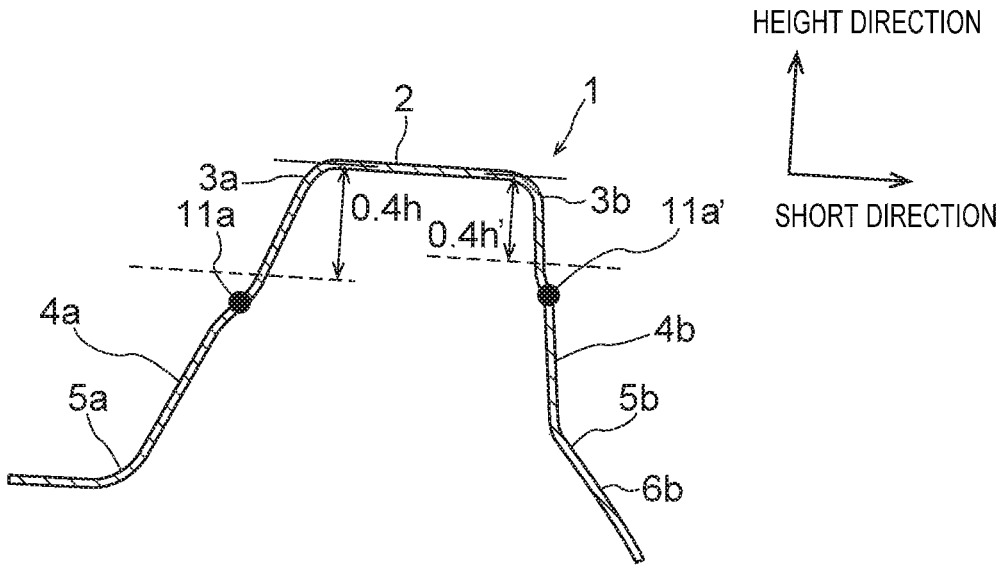
FIG. 5D is a cross-section illustrating the cross-section along 1D-1D in FIG. 1A for the roof member manufactured by undergoing the second process of the first exemplary embodiment in more detail.
Figure 6A:
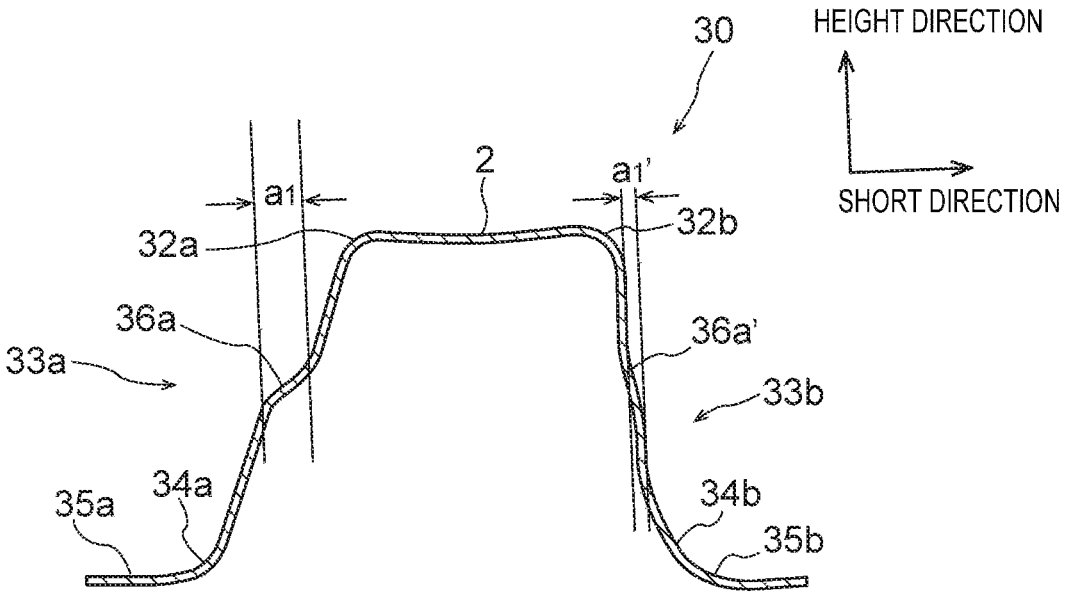
FIG. 6A is a cross-section of a length direction central portion of an intermediate formed component formed by the first process of the first exemplary embodiment.
Figure 6B:
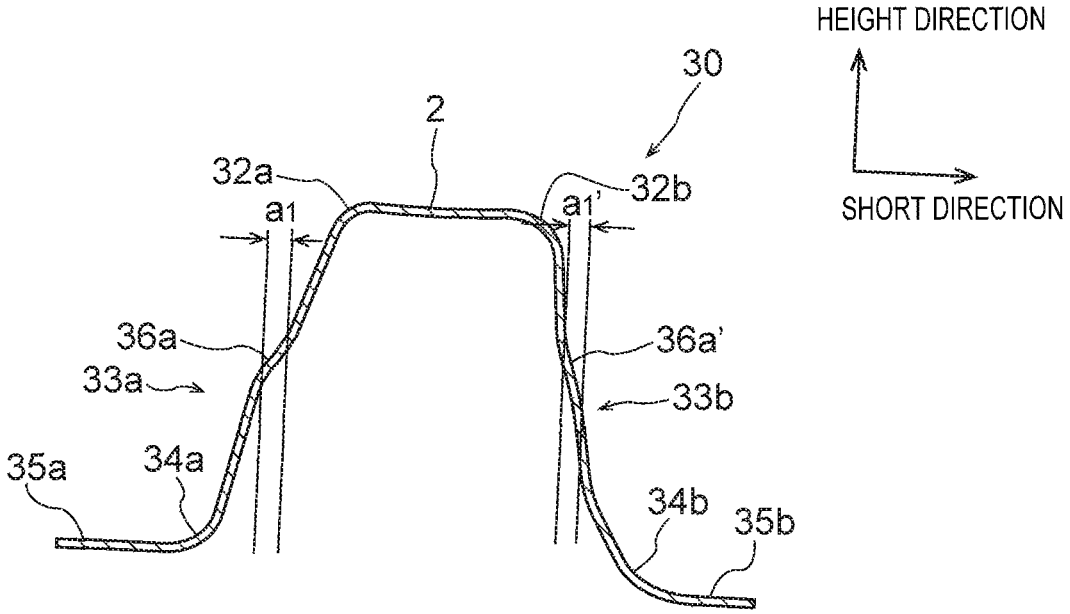
FIG. 6B is a cross-section of a portion corresponding to the cross-section along 1C-1C in FIG. 1A for the intermediate formed component formed by the first process of the first exemplary embodiment.
Figure 6C:
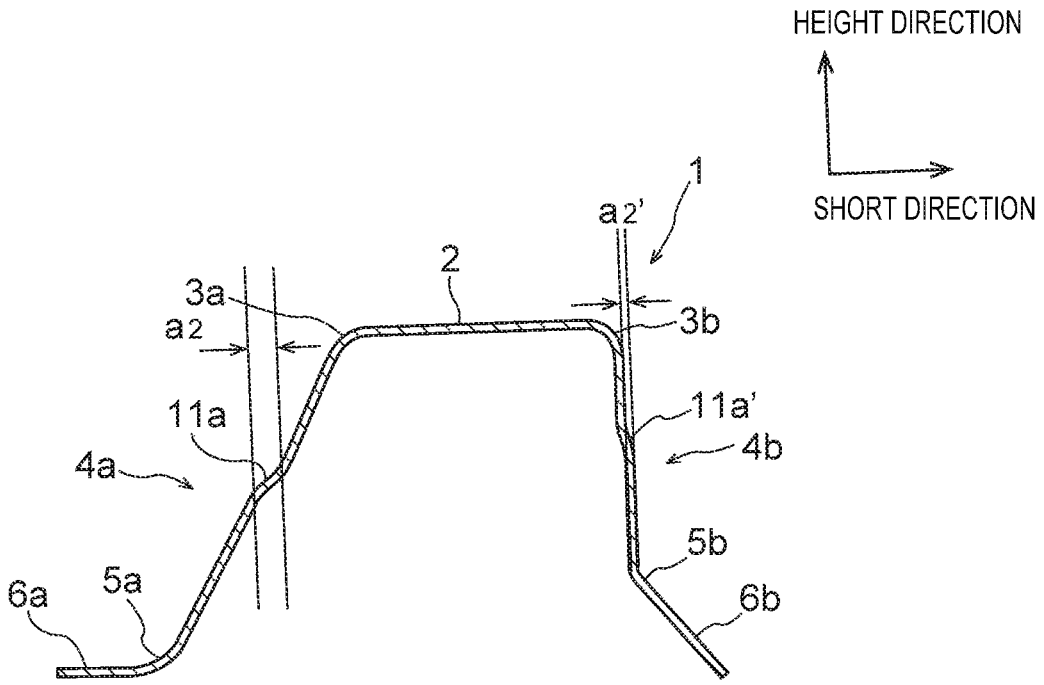
FIG. 6C is a cross-section of a length direction central portion of a roof member manufactured by undergoing the second process of the first exemplary embodiment.
Figure 6D:
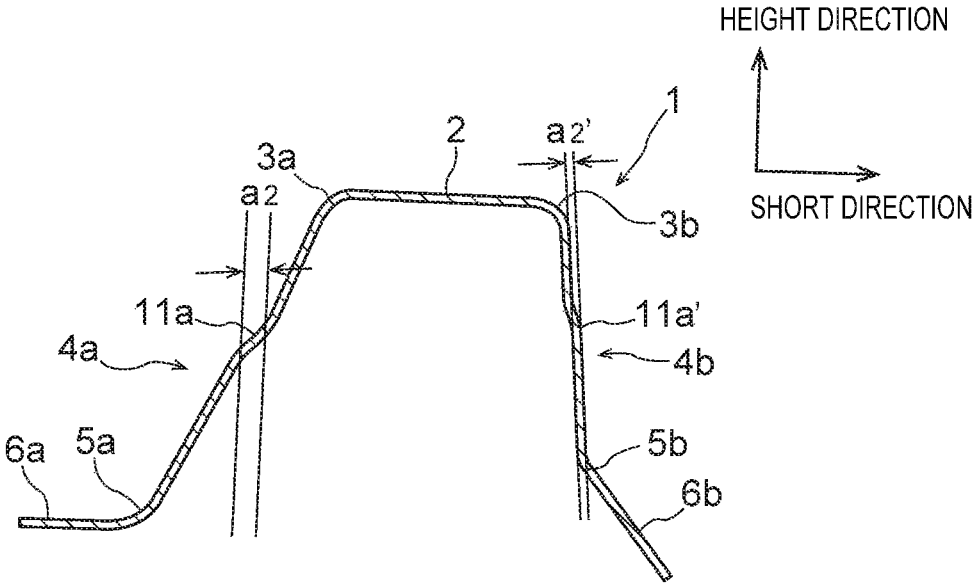
FIG. 6D is a cross-section along 1C-1C in FIG. 1A for a roof member manufactured by undergoing the second process of the first exemplary embodiment.

By contrast, in the present exemplary embodiment, as illustrated in FIG. 2B, FIG. 4A, and FIG. 4B, in the first process, the step 36*a* having the projection width a1 is formed in the vertical wall 33*a* that curves in a concave shape opening toward the vertical wall 33*b* side, and then, as illustrated in FIG. 3B, FIG. 4C, and FIG. 4D, in the second process, the projection width of the step 36*a* is changed from the projection width a1 to a2, this being narrower than a1. Note that in the roof member 1 manufactured by performing the second process, the vertical wall 33*a* and the step 33*a* respectively become the vertical wall 4*a* and the step 11*a*.

Moreover, as illustrated in the table of FIG. 15, described later, as viewed from the top plate 2 side, the roof member 1 of the present exemplary embodiment may be said to be less prone to bending, and exhibit a smaller bend amount, than Comparative Examples 1A to 4A in the table of FIG. 15, these being configured by a comparative embodiment in which steps are not formed. This is speculated to be due to the following mechanism. Namely, in the present exemplary embodiment, in the first process, the vertical wall 33*a* undergoes plastic deformation as a result of forming the vertical wall 33*a* with the step 36*a*. Then, in the second process, the projection width of the step 36*a* is narrowed. Accordingly, it is speculated that since the step 11*a* of the roof member 1 is formed as a result of being subjected to a load in the opposite direction to that of the first process, a state is attained in which the Bauschinger effect acts on the step 11*a* of the roof member 1.

Therefore, according to the present exemplary embodiment, the occurrence of bending in the roof member 1 is suppressed in comparison to cases in which the curved wall of a formed component configured including a curved wall curved in a concave shape opening toward the side of another wall as viewed from the upper side of the top plate is not formed with a step.

Moreover, in the present exemplary embodiment, as illustrated in FIG. 11, in the second process, accompanying the narrowing of the projection width of the step 36*a*, the portion of the vertical wall 33*a* further toward the top plate 2 side than the step 36*a*, namely the upper side portion of the vertical wall 33*a*, is moved in the opposite direction to the direction facing the vertical wall 33*b* such that the vertical wall 33*a* becomes the two vertical wall 4*a*. Moreover, in the second process, accompanying the narrowing of the projection width of the step 36*a*, the portion of the vertical wall 33*b* further toward the top plate 2 side than the step 36*a*', namely the upper side portion of the vertical wall 33*b*, is moved in the opposite direction to the direction facing the vertical wall 33*a*, such that the vertical wall 33*b* becomes the vertical wall 4*b*. Accordingly, in the present exemplary embodiment, residual tensile stress in a portion of the vertical wall 4*a* further toward the upper side than the step 11*a* can be reduced in comparison to cases in which a step is not formed to the curved wall of a formed component configured including a curved wall curved in a concave shape opening toward the side of another wall as viewed from the upper side of the top plate. Moreover, according to the present exemplary embodiment, residual compressive stress in a portion of the vertical wall 4*b* further toward the upper side than the step 11*a*' can be reduced in comparison to cases in which a step is not formed to the curved wall of a formed component configured including a curved wall curved in a concave shape opening toward the side of another wall as viewed from the upper side of the top plate. From another perspective, for example, in the case of an intermediate formed component in which the vertical walls are not formed with steps, when the vertical walls are moved in the opposite direction to the direction in which the vertical walls face each other in the second process, residual stress cannot be selectively reduced at specific portions of the vertical walls 4*a*, 4*b* (portions at the top plate side, for example). However, it may be said that the present exemplary embodiment is capable of reducing residual stress in the portions of the vertical walls 4*a*, 4*b* further toward the upper side than the steps 11*a*, 11*a*', namely in specific portions of the vertical walls 4*a*, 4*b*. In particular, the present exemplary embodiment may be said to be effective in the point that residual stress can be selectively reduced in the upper side portions of the overall vertical walls 4*a*, 4*b* in cases in which a large residual stress arises in the portions further toward the upper side than the steps 11*a*, 11*a*'. Note that in the present exemplary embodiment, in the second process, the projection width of the step 36*a* is narrowed by changing the angle of the portion of the vertical wall 33*a* further toward the top plate 2 side than the step 36*a*. Accordingly, the present exemplary embodiment may be said to suppress the occurrence of bending of the roof member 1 without changing the angle of the portion of the vertical wall 33*a* on the opposite side of the step 36*a* to the top plate 2 side, namely a lower end side portion of the vertical wall 33*a*.

Second Advantageous Effect

Moreover, generally, when pressing a blank to manufacture a formed component, not illustrated in the drawings, configured including a curved wall that curves in a convex shape bowing toward the side of another wall as viewed from an upper side, namely as viewed from a top plate side, residual tensile stress is liable to occur in the curved wall that is formed. The formed component is then liable to bend as viewed from the top plate side when the residual tensile stress in the curved wall of the formed component is released.

By contrast, in the present exemplary embodiment, in the first process, as illustrated in FIG. 2B, FIG. 4A, and FIG. 4B, the step 36*a*' having the projection width a1 is formed in the vertical wall 33*b* that curves in a convex shape bowing toward the vertical wall 33*a* side, and then, in the second process, as illustrated in FIG. 3B, FIG. 4C, and FIG. 4D, the projection width of the step 36*a*' is changed from the projection width a1 to a2, this being narrower than a1. Note that in the roof member 1 manufactured by performing the second process, the vertical wall 33*b* and the step 36*a*' respectively become the vertical wall 4*b* and the step 11*a*'.

Moreover, as illustrated in the table of FIG. 15, described later, the roof member 1 of the present exemplary embodiment may be said to be less prone to bending and have a smaller bend amount than Comparative Examples 1A to 4A in the table of FIG. 15, these being configured by the comparative embodiment in which a step is not formed. This is speculated to be due to the following mechanism. Namely, in the present exemplary embodiment, in the first process, the vertical wall 33*b* undergoes plastic deformation as a result of forming the vertical wall 33*b* with the step 36*a*'. Then, in the second process, the angle of the portion of the vertical wall 33*b* further toward the top plate 2 side than the step 36*a*' is changed so as to narrow the projection width of the step 36*a*'. Accordingly, it is speculated that since the step 11*a*' of the roof member 1 is formed as a result of being subjected to a load in the opposite direction to that of the first process, a state is achieved in which the Bauschinger effect acts on the step 11*a*' of the roof member 1.

Accordingly, according to the present exemplary embodiment, the occurrence of bending in the roof member 1 is suppressed in comparison to cases in which a step is not formed in the curved wall of a formed component configured including a curved wall curved in a convex shape bowing toward the side of another wall as viewed from the upper side of a top plate.

Third Advantageous Effect

The first and second advantageous effects have been explained separately above for the two vertical walls 4*a*, 4*b* configuring the curved walls. However, in the present exemplary embodiment, the two vertical walls 4*a*, 4*b* are respectively formed with the steps 11*a*, 11*a*' through the first process and the second process.

Accordingly, in the present exemplary embodiment, as illustrated in the table in FIG. 15, residual stress is easily reduced in the two vertical walls 4*a*, 4*b*, and deviatoric residual stress is easily reduced in the two vertical walls 4*a*, 4*b*. The occurrence of bending in the roof member 1 is suppressed as a result.

The foregoing was an explanation regarding the advantageous effect of the present exemplary embodiment.

Second Exemplary Embodiment

Next, explanation follows regarding the second exemplary embodiment. First, explanation follows regarding configuration of a roof member 1A of the present exemplary embodiment illustrated in FIG. 8A, FIG. 8B, FIG. 8C, and FIG. 8D. Explanation then follows regarding configuration of a press apparatus 17A of the present exemplary embodiment illustrated in FIG. 9 and FIG. 10. This will be followed by explanation regarding a manufacturing method of the roof member of the present exemplary embodiment. This will then be followed by explanation regarding advantageous effects of the present exemplary embodiment. Note that the following explanation concerns portions of the present exemplary embodiment differing from those of the first exemplary embodiment.

Roof Member Configuration

First, explanation follows regarding configuration of the roof member 1A of the present exemplary embodiment, with reference to the drawings. Note that the roof member 1A is an example of a pressed component and a specific pressed component.

As illustrated in FIG. 8A, FIG. 8B, FIG. 8C, and FIG. 8D, the roof member 1A of the present exemplary embodiment is not provided with the flanges 6*a*, 6*b* of the first exemplary embodiment illustrated in FIG. 1A, FIG. 1B, FIG. 1C, and FIG. 1D. The roof member 1A of the present exemplary embodiment has the same configuration as the roof member 1 of the first exemplary embodiment with the exception of this point.

Press Apparatus Configuration

Explanation follows regarding the press apparatus 17A of the present exemplary embodiment, with reference to the drawings. The press apparatus 17A of the present exemplary embodiment is used to manufacture the roof member 1A of the present exemplary embodiment.

Figure 9:
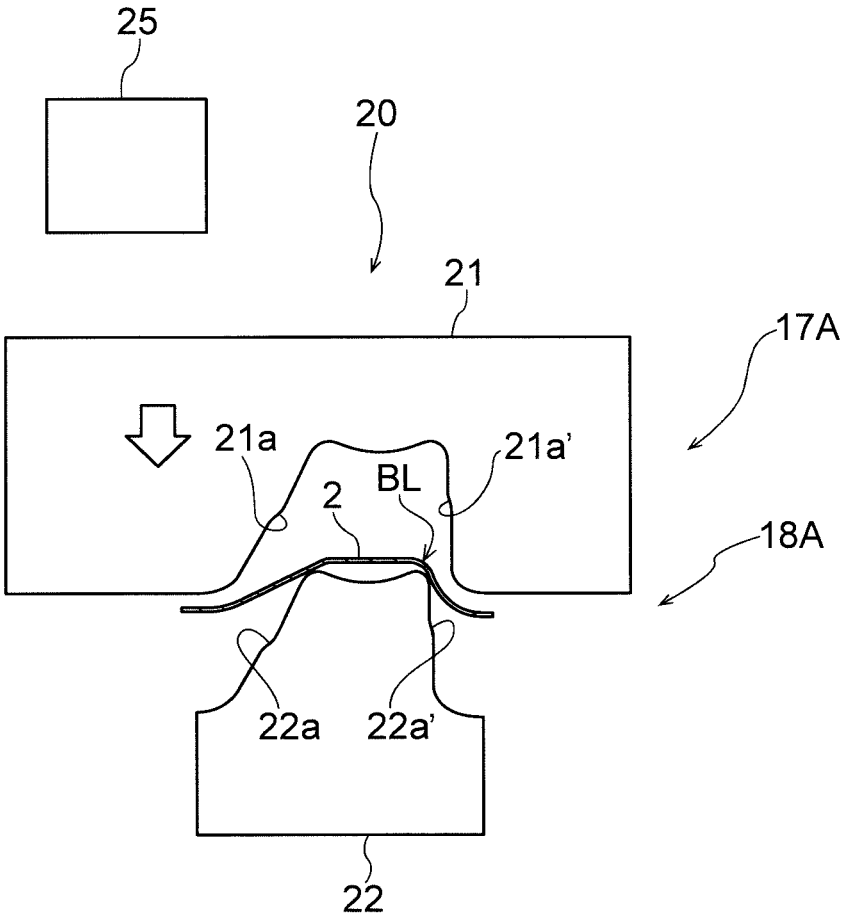
FIG. 9 is a vertical cross-section of a first press device employed in a first process of a roof member manufacturing method of the second exemplary embodiment.
Figure 10:
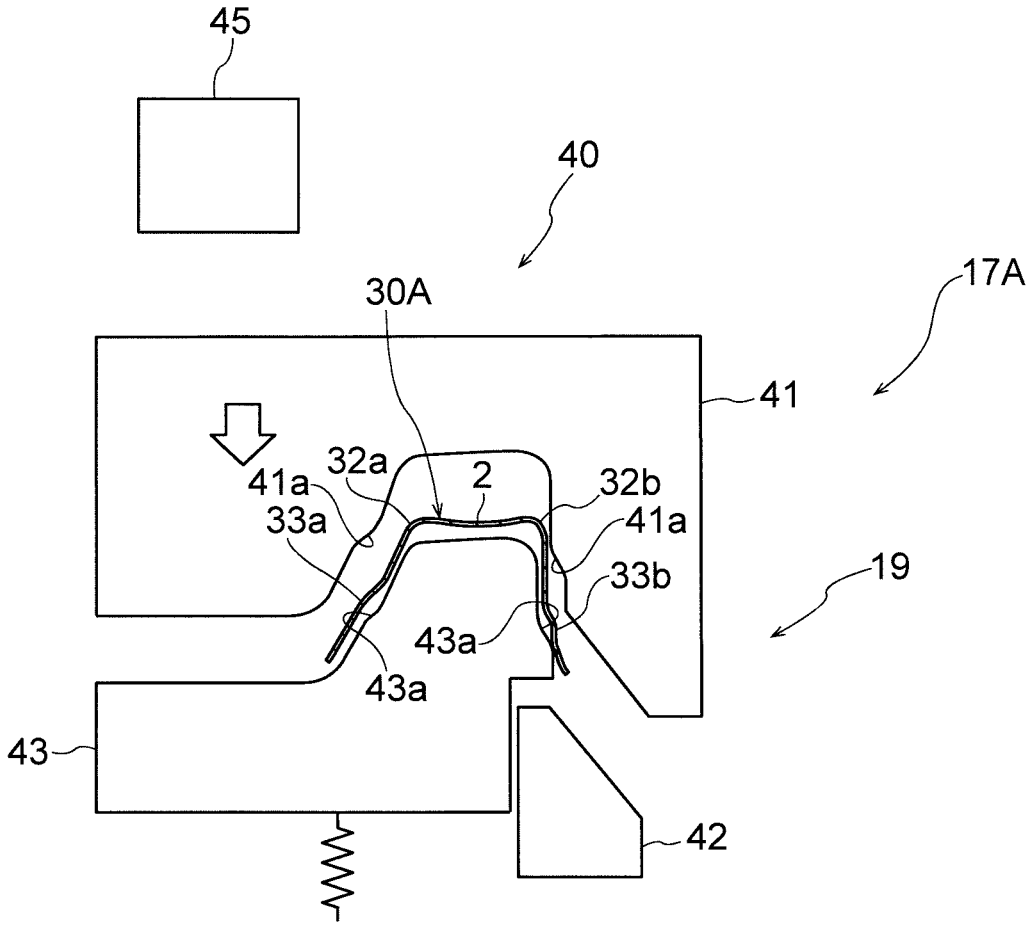
FIG. 10 is a vertical cross-section of a second press device employed in a second process of the roof member manufacturing method of the second exemplary embodiment.

A first press device 18A of the present exemplary embodiment, illustrated in FIG. 9, is not provided with the holders 23, 24 illustrated in FIG. 2B. Note that the first press device 18A is an example of a press device. The press apparatus 17A of the present exemplary embodiment has the same configuration as the press apparatus 17 of the first exemplary embodiment with the exception of this point. An intermediate formed component 30A has the same configuration as the intermediate formed component 30 of the first exemplary embodiment, with the exception of the point that the two flanges 35*a*, 35*b* are not provided. Namely, the intermediate formed component 30A of the present exemplary embodiment is configured as a gutter-shaped member.

Roof Member Manufacturing Method

Next, explanation follows regarding a manufacturing method of the roof member 1A of the present exemplary embodiment. The manufacturing method of the roof member 1A of the present exemplary embodiment is performed employing the press apparatus 17A. Moreover, in the manufacturing method of the roof member 1A of the present exemplary embodiment, a first process is the same as that of the first exemplary embodiment, with the exception of the point that it is performed using the first press device 18A. Note that in the present exemplary embodiment, in the first process, the blank BL is pressed by bending to form the intermediate formed component 30A illustrated in FIG. 10.

Advantageous Effects

Advantageous effects of the present exemplary embodiment are similar to the advantageous effects of the first exemplary embodiment.

Examples of the First and Second Exemplary Embodiments

Next, explanation follows regarding first and second simulations, and a third test, of Examples of the first and second exemplary embodiments and of Comparative Examples, with reference to the drawings. Note that in the following explanation, when the reference signs used for components and the like are similar to the reference signs used for components and the like in the first and second exemplary embodiments and the comparative embodiment thereof, the reference signs for these components and the like are carried over as-is.

First Simulation

Figure 14:
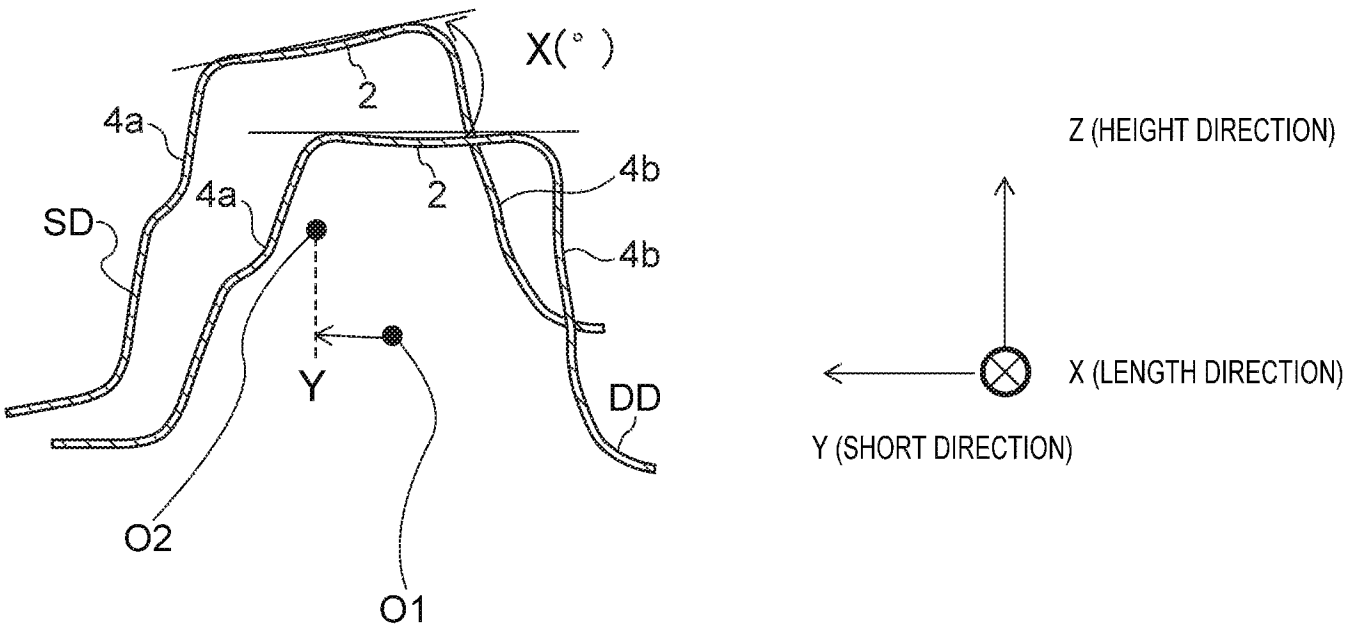
FIG. 14 is a diagram to explain evaluation methods for twisting and bending in the first exemplary embodiment.

In the first simulation, bending was evaluated at the front end 1*a* side and the rear end 1*b* side of roof members 1 of Examples 1A to 8A produced using simulations based on the roof member manufacturing method of the first exemplary embodiment, and for roof members of Comparative Examples 1A to 5A produced using simulations based on the roof member manufacture described below. Specifically, in the evaluation method of the present simulation, a computer, not illustrated in the drawings, was used to compare data SD for the roof members 1 of Examples 1A to 8A and for the roof members of Comparative Examples 1A to 5A against design data DD. Specifically, as illustrated in FIG. 14, the cross-sections length direction central portions of the top plate 2 were aligned, namely, a best fit was found, and bending was evaluated as the amount of offset in the width direction of center positions of the front end face and a rear end face in measured data with respect to the center position of a front end face and a rear end face in the design data DD.

Explanation Regarding Table of FIG. 15

The table of FIG. 15 lists simulation parameters and evaluation results for Examples 1A to 8A and Comparative Examples 1A to 5A. Note that in the table of FIG. 15, "plate thickness" is the thickness of the blank BL employed in the simulation. "Strength" is the tensile strength of the blank BL employed in the simulation. The "curve-inside offset amount" refers to a value obtained by subtracting the projection width a2 of the step 11*a* narrowed in the second process from the projection width a1 of the step 36*a* formed in the first process. The "curve-outside offset amount" refers to a value obtained by subtracting the projection width a2 of the step 11*a*' after narrowing in the second process from the projection width a1 of the step 36*a*' formed in the first process. The "evaluation of bending at cross-section 1 (mm)" is the bending of a portion 10 mm toward the length direction central side from the front end portion 1*a*. The "evaluation of bending at cross-section 2 (mm)" is the bending of a portion 10 mm toward the length direction central side from the rear end portion 1*b*. The "average bend amount" is the average of the evaluation of bending at cross-section 1 and the evaluation of bending at cross-section 2.

Roof Members of Comparative Examples 1A to 5A

In the roof members of Comparative Example 1A to 4A, the vertical walls 4*a*, 4*b* were not formed with steps. Specifically, the roof members of Comparative Examples 1A to 4A were not formed with steps in either the first process or the second process. With the exception of this point, the roof members of Comparative Examples 1A to 4A were produced by simulations assuming the manufacturing method of the roof member 1 of the first exemplary embodiment, namely assuming drawing. Moreover, in Comparative Example 5A, in the first process, the projection width a1 of the respective steps 36*a*, 36*b* was set to 5 mm, and in the second process, the projection width a2 of the respective steps 11*a*, 11*a*' remained at 5 mm. Namely, in Comparative Example 5A, in the second process, the steps 36*a*, 36*b* were left unchanged, with the same shape as that in which they were formed in the first process.

Roof Members of Examples 1A to 8A

The roof members of Examples 1A to 8A were produced by simulations assuming the manufacturing method of the roof member 1 of the first exemplary embodiment, namely assuming drawing. Note that in Examples 1A to 8A, in the first process, the projection width a1 of the steps 36*a*, 36*b* was set to 5 mm.

Evaluation Results and Interpretation

From the table of FIG. 15, it is apparent that the roof members of Examples 1A to 8A underwent less bending or experienced smaller amounts of bending than the roof members of Comparative Examples 1A to 5A. For example, Examples 1A to 4A and Comparative Example 1A each have the same simulation parameters for plate thickness and strength. When the simulation results for evaluation of bending at cross-section 1 are compared, it is apparent that the roof members of Examples 1A to 4A underwent less bending than the roof member of Comparative Example 1A. Moreover, when the simulation results for evaluation of bending at cross-section 2 are compared, it is apparent that the roof members of Examples 1A to 4A underwent less bending than the roof member of Comparative Example 1A. Note that the evaluation of bending at cross-section 2 for Example 1A was −1.12 mm. The minus sign is in reference to the fact that bending occurred in the opposite direction to that in FIG. 14, this being a diagram to explain bending. Accordingly, when the absolute values of the angles are compared, it can be said that the roof member of Example 1A underwent less bending than the roof member of Comparative Example 1A. It may therefore be considered that Examples 1A to 5A, these being Examples of the first exemplary embodiment, exhibit the third advantageous effect to a greater extent than Comparative Examples 1A to 4A in which the vertical walls were not formed with steps.

Moreover in Examples 1A and 2, in the second process, the projection width a1 was only narrowed in of one out of the steps 36*a*, 36*b* formed in the first process. However, Examples 1A and 2 still underwent less bending than Comparative Example 1A. It may therefore be considered that Examples 1A and 2, these being Examples of the first exemplary embodiment, underwent less bending, namely, exhibit the first and second advantageous effects to a greater extent, than the Comparative Example (Comparative Example 1A) in which the vertical walls were not formed with steps.

Moreover, it is apparent that Example 7A underwent less bending than Comparative Example 5A that has the same simulation parameters for plate thickness and strength. It may therefore be considered that Example 7A exhibits the first, second, and third advantageous effects to a greater extent than Comparative Example 5A.

Moreover, when comparing combinations having the same simulation parameters for plate thickness and strength, such as Example 1A and Comparative Example 1A, Example 5A and Comparative Example 2A, and the like, it is apparent that Example 1A and Example 5A have smaller average bend amounts than the respective Comparative Examples 1A and 2A. It may therefore be considered Examples 1A to 8A exhibit the first, second, and third advantageous effects to a greater extent than the Comparative Examples 1A to 5A, regardless of differences in the tensile strength of the blank BL.

Second Simulation

In the second simulation, bending was evaluated at a front end side and a rear end side for roof members 1 of Examples 9A to 16A produced using simulations based on the roof member manufacturing method of the second exemplary embodiment, and for roof members of Comparative Examples 6A to 10A produced using simulations based on the roof member manufacture described below.

Explanation Regarding Table of FIG. 16

The table of FIG. 16 lists simulation parameters and evaluation results for Examples 10A to 16A and Comparative Examples 6A to 10A. Note that interpretation of the table of FIG. 16 and the definition of bending are the same as those of the first simulation.

Roof Members of Comparative Examples 6A to 10A

In the roof members of Comparative Examples 6A to 10A, in the first process, the projection width a1 of the respective steps 36*a*, 36*b* was set to 5 mm, and in the second process, the projection width a2 of the respective steps 11*a*, 11*a*' was left unchanged at 5 mm. Namely, in Comparative Examples 6A to 10A, in the second process, the shapes of the steps 36*a*, 36*b* were left unchanged from when they were formed in the first process. Note that with the exception of the above point, Comparative Examples 6A to 10A are configured as gutter-shaped members formed by bending similarly to the roof member 1A of the second exemplary embodiment.

Roof Members of Examples 9A to 16A

The roof members of Examples 9A to 16A were produced by simulations assuming the bending of the manufacturing method of the roof member 1 of the first exemplary embodiment. Note that in Examples 9A to 16A, in the first process, the projection width a1 of the respective steps 36*a*, 36*b* was set to 5 mm.

Evaluation Results and Interpretation

From the table of FIG. 16, it is apparent that the roof members of Examples 9A to 12 underwent less bending or experienced a smaller amount of bending than the roof member of Comparative Example 6A that has the same simulation parameters for plate thickness and strength. It may therefore be considered that Examples 9A to 12, these being Examples of the first exemplary embodiment, exhibit the third advantageous effects to a greater extent than Comparative Examples 1A to 4A in which the vertical walls were not formed with steps.

Moreover, in Examples 9A and 10A, in the second process, the projection width a1 was only narrowed in of one out of the steps 36*a*, 36*b* formed in the first process. However, Examples 9A and 10A still underwent less bending than Comparative Example 6A. It may thereby be considered that Examples 9A and 10A, these being Examples of the second exemplary embodiment, underwent less bending, namely exhibited the first and second advantageous effects to a greater extent, than in Comparative Example 6A in which the steps formed in the vertical walls in the first process were not narrowed in the second process.

It is also apparent that Example 7A underwent less bending than Comparative Example 5A that has the same simulation parameters for plate thickness and strength. It may therefore be considered that Example 7A exhibits the first, second, and third advantageous effects to a greater extent than Comparative Example 5A.

Moreover, when comparing combinations having the same simulation parameters for plate thickness and strength, such as Example 9A and Comparative Example 6A, Example 13A and Comparative Example 7A, and so on, it is apparent that Examples 9A and 13A experienced smaller amounts of bending than the respective Comparative Examples 6A and 7A. It may therefore be considered that Examples 9A to 16A exhibit the first, second, and third advantageous effects to a greater extent than Comparative Examples 6A of the 10A, regardless of differences in the tensile strength of the blank BL.

Third Test

In a third test, Vickers hardness values for the vertical wall 4*a* of the roof member of Example 4A and Vickers hardness values for the vertical wall 4*a* of the roof member of Comparative Example 1A were measured and compared. Note that in the third test, the Vickers hardness values were measured in accordance with the Vickers hardness measurement method set out in Japanese Industrial Standard JIS Z 2244. However, the Vickers hardness values are not limited to the Vickers hardness measurement method set out in Japanese Industrial Standard JIS Z 2244, and measurements may be taken using another method and converted using a hardness conversion table, not illustrated in the drawings, in order to find the Vickers hardness values. Note that JIS Z 2244 corresponds to the International Standard ISO 6507-2:2005.

Figure 17:
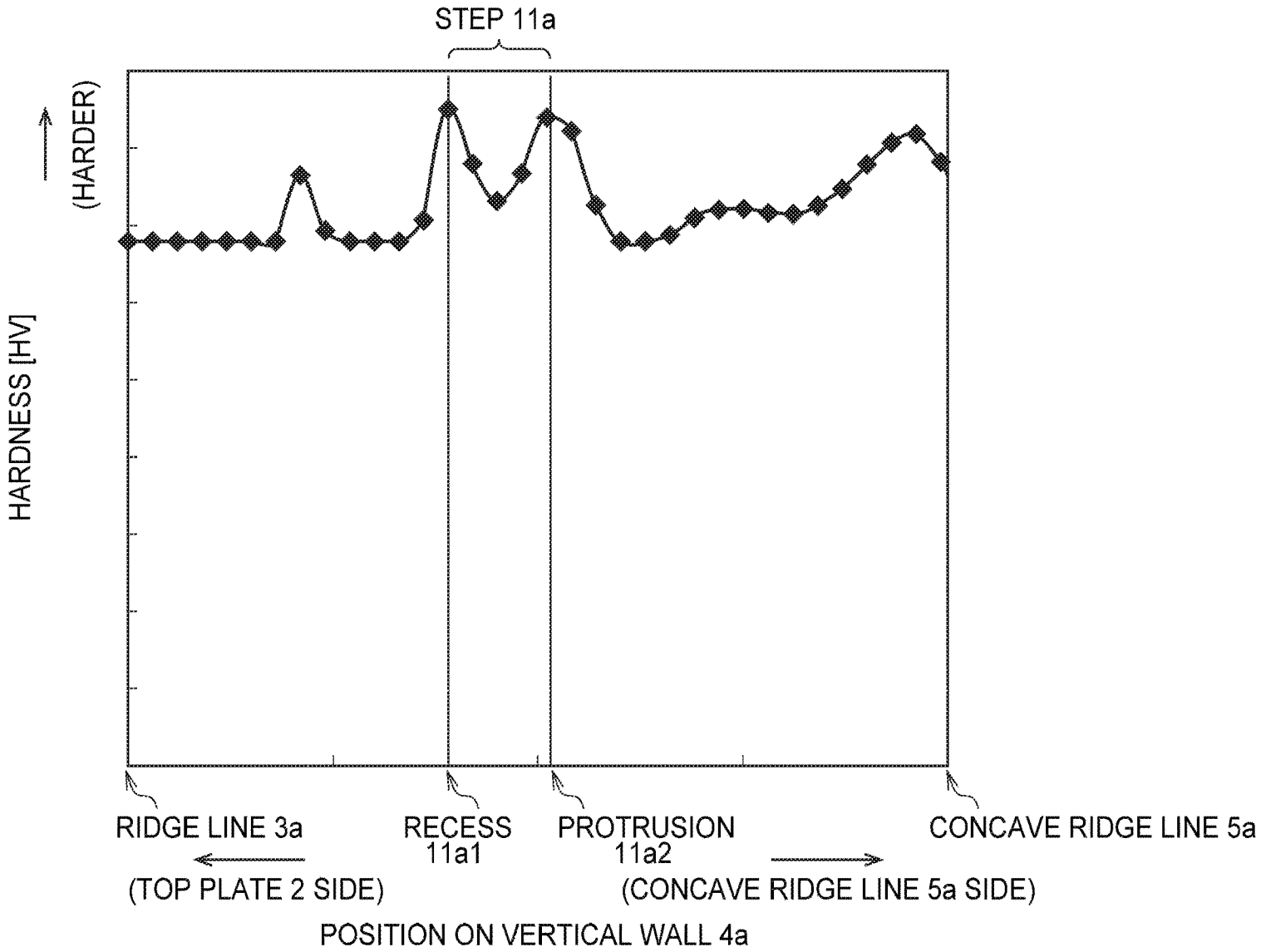
FIG. 17 is a graph illustrating evaluation results of Vickers hardness testing of a vertical wall for Comparative Example 1A.

According to the measurement results for Comparative Example 1A illustrated in the graph of FIG. 17 and the measurement results for Example 4A illustrated in the graph of FIG. 18, it is apparent that the Vickers hardness values of the protrusion 11*a*2 are lower than the Vickers hardness value for the recess 11*a*1 in each case, namely, for both Comparative Example 1A and Example 4A. Note that in the measurement results for Comparative Example 1A, the difference between the Vickers hardness value for the recess 11*a*1 and the Vickers hardness value for the protrusion 11*a*2 (the difference between the Vickers hardness value for the recess 11*a*1 and the Vickers hardness value for the protrusion 11*a*2 is denoted the "difference Δ" hereafter) was 7 HV. By contrast, in the measurement results for Example 4A, the difference Δ was 10 HV. The difference Δ in Example 4A was thus greater than the difference Δ in Comparative Example 1A. In other words, the protrusion 11*a*2 may be said to be softer than the recess 11*a*1 to a greater extent in Example 4A than in Comparative Example 1A. The reason for this is speculated to be as follows. Namely, when the blank BL is pressed in the first process, the step 36*a* is formed, and the protrusion 11*a*2 is pulled toward an outer surface side. Namely, tensile stress acts toward the outer side. Then, when the projection width of the step 36*a* of the intermediate formed component 30 narrows in the second process, the recess 11*a*1 moves toward the protrusion 11*a*2 side. This results in a more compressed state at the inner surface side of the protrusion 11*a*2 than in a state at a point in time following the first process and prior to the second process. However, the recess 11*a*1 is in a pulled state both following the first process and prior to the second process, and following the second process. The protrusion 11*a*2 is accordingly softened to a greater extent than the recess 11*a*1. From another perspective, it may be said that the recess 11*a*1 is harder than the protrusion 11*a*2, namely the roof members 1, 1A of the first exemplary embodiment and the second exemplary embodiment have higher precision, namely bending is better suppressed, than in Comparative Example 6A. Note that although the measurement results are not illustrated, the difference Δ measured for Comparative Example 2A was, for example, 8 HV. Moreover, the differences Δ measured for all of the Comparative Examples other than Comparative Example 1A and Comparative Example 2A were under 10 HV. By contrast, for example, the differences Δ measured for Example 5A and Comparative Example 7A were respectively 30 HV and 20 HV. Moreover, the differences Δ measured for all of the Examples other than Example 5A and Example 7A were all 10 HV or greater. Namely, it is apparent that the difference Δ is 10 HV or greater for the roof members 1, 1A of the first exemplary embodiment, the second exemplary embodiment, and each of the Examples.

Note that in the above results, the roof members 1, 1A of any of the Examples are results reflecting better dimensional precision than those for the roof members of any of the Comparative Examples. For example, when the roof member 1, 1A of any one Example is welded and joined to another member, not illustrated in the drawings, the roof member is not corrected during welding, or if the roof members were to be corrected, the correction amount, namely the deformation amount, would be smaller than when the roof members of any one of the Comparative Examples and the roof members of the respective Comparative Examples were welded and joined. Accordingly, the Examples have the advantageous effect of having higher dimensional precision than the Comparative Examples when joined to such other members. Moreover, in the Examples, in comparison to the Comparative Examples, stress does not remain, or is not liable to remain, in portions welded to such joined members, such that the Examples exhibit the advantageous effect of exhibiting good strength with such joined members.

The foregoing was an explanation regarding Examples of the first and second exemplary embodiments.

Third Exemplary Embodiment

Next, explanation follows regarding the third exemplary embodiment. First, explanation follows regarding configuration of a roof member 1B of the present exemplary embodiment, illustrated in FIG. 19 and FIG. 20. Explanation then follows regarding configuration of a press apparatus 17B of the present exemplary embodiment, illustrated in FIG. 24, FIG. 25, FIG. 26, and FIG. 27. This will be followed by explanation regarding a manufacturing method of the roof member 1B of the present exemplary embodiment. This will then be followed by explanation regarding advantageous effects of the present exemplary embodiment. Note that the roof member 1B of the present exemplary embodiment corresponds to Example 9B in FIG. 32, described later. In the following explanation of the present exemplary embodiment, when the reference signs used for components and the like are similar to the reference signs used for components and the like in the first and second exemplary embodiments, the reference signs for these components and the like are carried over as-is.

Roof Member Configuration

First, explanation follows regarding configuration of the roof member 1B of the present exemplary embodiment, with reference to the drawings. Note that the roof member 1B is an example of a pressed component and a specific pressed component.

Figure 19:
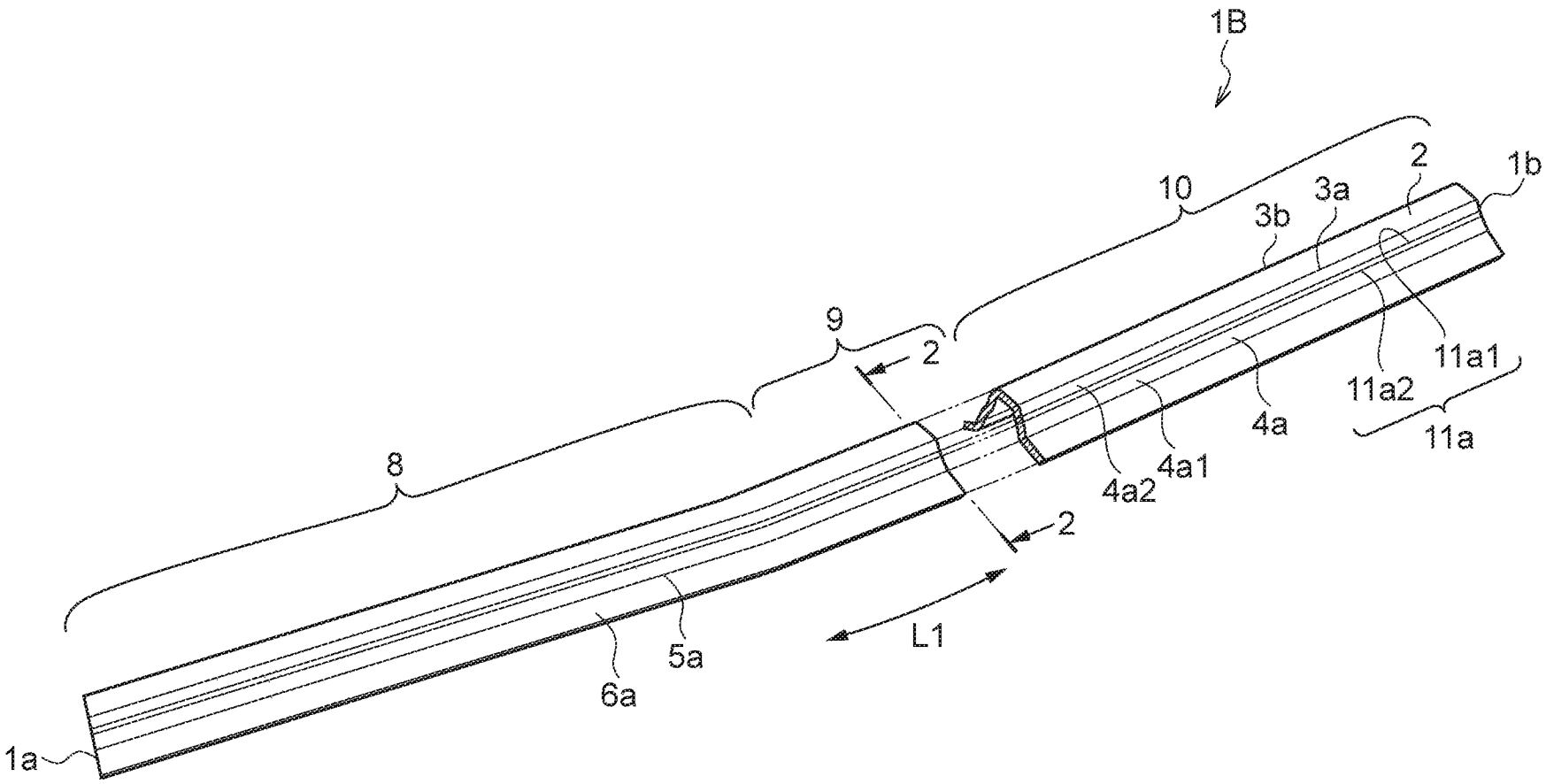
FIG. 19 is a perspective view illustrating a roof member of a third exemplary embodiment, and includes a lateral cross-section across a length direction.
Figure 20:
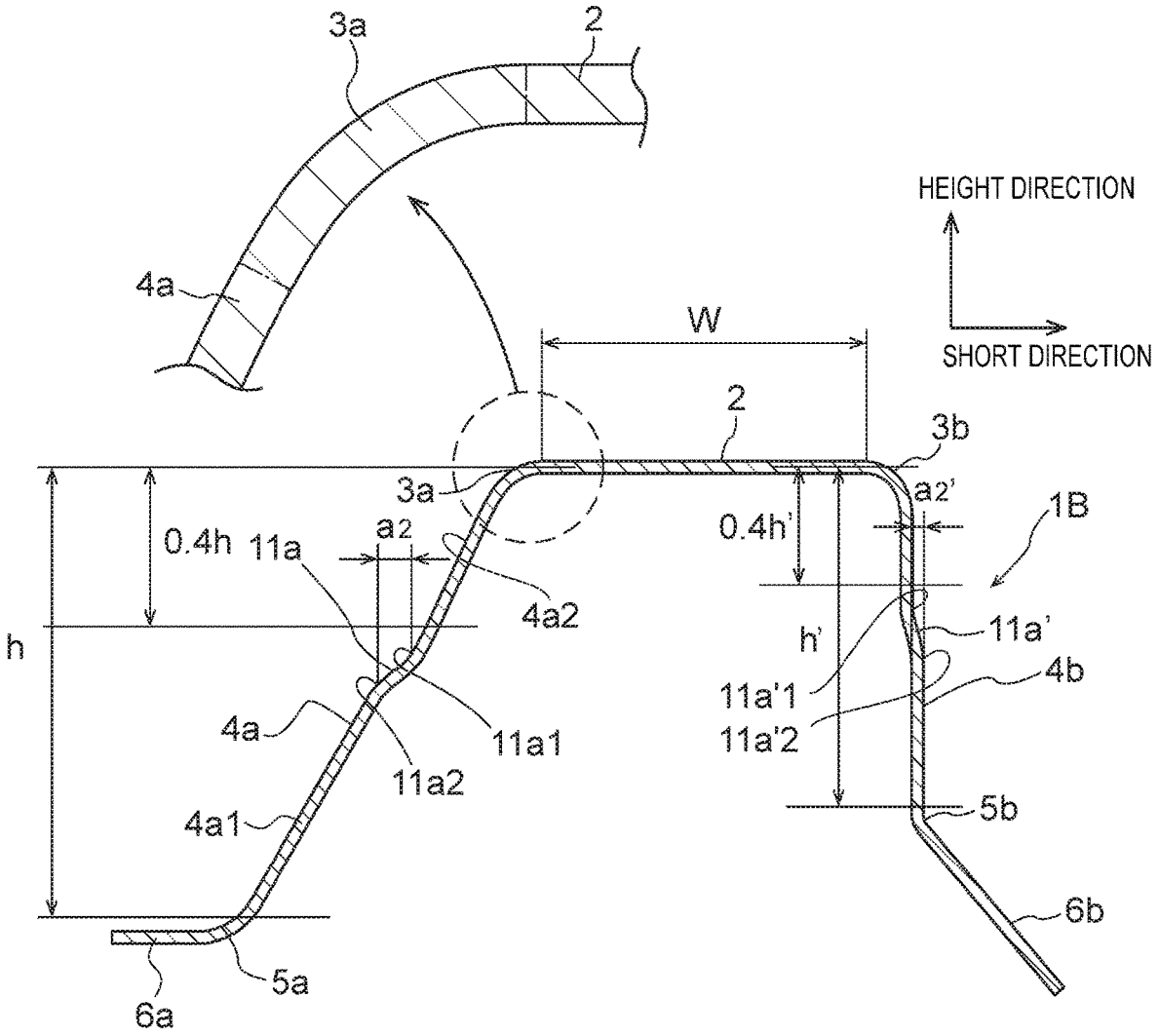
FIG. 20 is a cross-section along line 2-2 in FIG. 19, and illustrates a roof member of the third exemplary embodiment in cross-section.

As illustrated in FIG. 19 and FIG. 20, the roof member 1B is an elongated member integrally configured including a top plate 2, two convex ridge lines 3*a*, 3*b*, two vertical walls 4*a*, 4*b*, two concave ridge lines 5*a*, 5*b*, and two flanges 6*a*, 6*b*, and having a substantially hat-shaped cross-section profile. Note that the convex ridge lines 3*a*, 3*b* are an example of ridge lines. The roof member 1B is, for example, configured by a component cold pressed from a high tensile steel stock sheet having 1470 MPa grade tensile strength.

Note that the configuration of the roof member 1B of the present exemplary embodiment illustrated in FIG. 19 and FIG. 20 is the same as the configuration of the roof member 1 of the first exemplary embodiment illustrated in FIG. 1A, FIG. 1B, FIG. 1C, and FIG. 1D.

The foregoing was an explanation regarding configuration of the roof member 1B of the present exemplary embodiment.

Press Apparatus Configuration

Next, explanation follows regarding the press apparatus 17B of the present exemplary embodiment, with reference to the drawings. The press apparatus 17B of the present exemplary embodiment is used to manufacture the roof member 1B of the present exemplary embodiment. As illustrated in FIG. 24, FIG. 25, FIG. 26, and FIG. 27, the press apparatus 17B is configured including a first press device 18 and a second press device 19B. The press apparatus 17B of the present exemplary embodiment employs the first press device 18 to draw the blank BL illustrated in FIG. 25 so as to press the blank BL to form the intermediate formed component 30 illustrated in FIG. 21 and FIG. 22, and then uses the second press device 19B to press the intermediate formed component 30 to manufacture a manufactured component, namely the roof member 1B. Note that the blank BL is configured by an elongated high tensile sheet steel as a base material for manufacturing the roof member 1B.

First Press Device

The first press device 18 has a function of pressing the blank BL, this being the forming target, to form the intermediate formed component 30.

Figure 24:
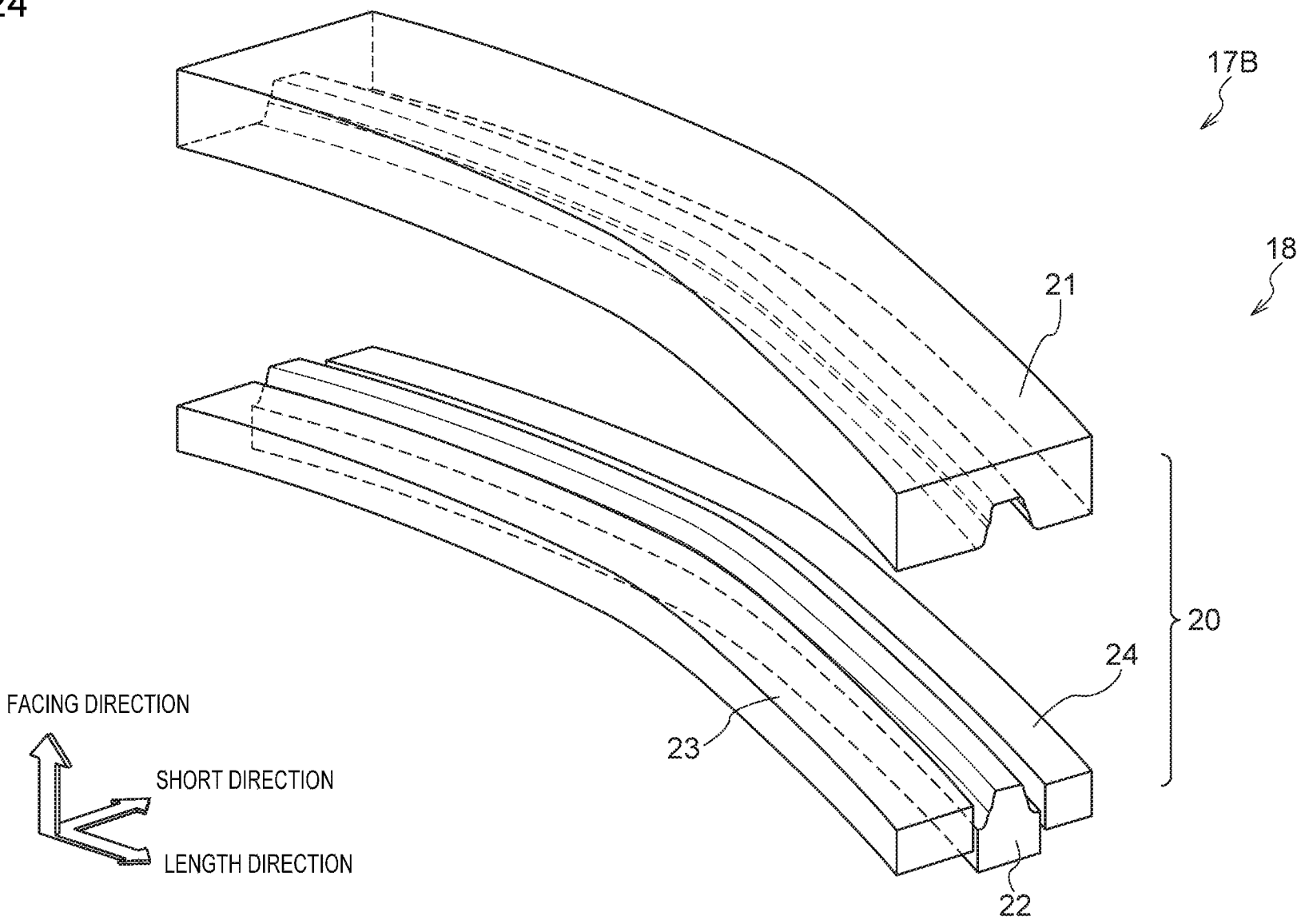
FIG. 24 is a perspective view of a mold of a first press device employed in a first process of the roof member manufacturing method of the third exemplary embodiment.

As illustrated in FIG. 25, the first press device 18 is configured including a first mold 20 and a first moving device 25. As illustrated in FIG. 24 and FIG. 25, the first mold 20 includes an upper mold 21, a lower mold 22, a first holder 23, and a second holder 24. Note that the upper mold 21 is an example of a first die. Moreover, the lower mold 22 is an example of a first punch. The upper mold 21 is disposed at an upper side, and the lower mold 22 is disposed at a lower side.

As illustrated in FIG. 24, the upper mold 21 and the lower mold 22 are both elongated. When the upper mold 21 and the lower mold 22 are viewed along the direction in which the upper mold 21 and the lower mold 22 face each other, the lower mold 22 projects out in a curve along its length direction, and the upper mold 21 is formed with a groove that curves following the lower mold 22. Moreover, when the upper mold 21 is viewed across the short direction of the upper mold 21, the groove width becomes progressively wider from the groove bottom toward the open side of the groove, namely from the upper side toward the lower side. When the lower mold 22 is viewed across the short direction of the lower mold 22, the width of the projecting portion becomes progressively narrower from the lower side toward the upper side. Moreover, the shape of the lower mold 22 is configured as a shape that fits together with the shape of the groove in the upper mold 21 during mold closure.

Moreover, as illustrated in FIG. 25, as viewed along the length direction of the lower mold 22, the two side faces of the lower mold 22 are respectively formed with steps 22*a*. The two side faces of the groove in the upper mold 21 are formed with steps 21*a*, 21*a*' that respectively follow the steps 22*a*. Moreover, an angle of inclination of a portion further toward the lower side than the step 21*a* in the side face formed with the step 21*a* with respect to the up-down direction, namely with respect to the direction in which the upper mold 21 and the lower mold 22 face each other, is taken to be θ1.

The first holder 23 and the second holder 24 are elongated so as to follow the upper mold 21 and the lower mold 22. As illustrated in FIG. 24 and FIG. 25, the first holder 23 and the second holder 24 are disposed at both short direction sides of the lower mold 22. Moreover, as illustrated in FIG. 25, the first holder 23 and the second holder 24 are respectively biased toward the upper side by springs 26, 27.

The first moving device 25 is configured to move the upper mold 21 toward the lower mold 22. Namely, the first moving device moves the upper mold 21 relative to the lower mold 22.

Figure 22:
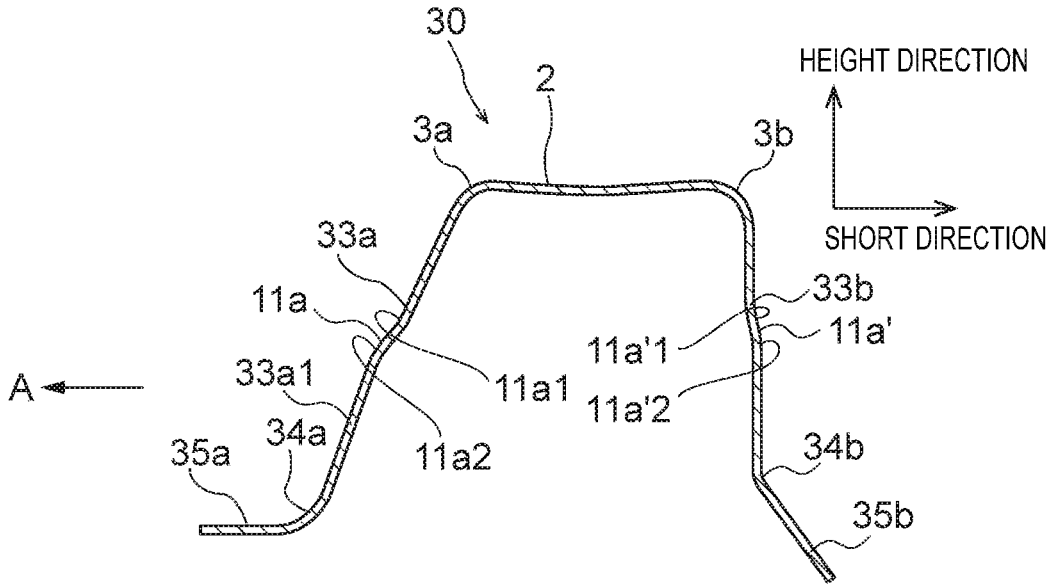
FIG. 22 is a cross-section along line 4-4 in FIG. 21, and illustrates a lateral cross-section of an intermediate formed component of the third exemplary embodiment in lateral cross-section.

In a state in which the blank BL has been disposed at a predetermined position in a gap between the upper mold 21 and the lower mold 22, the first moving device moves the upper mold 21 toward the lower mold 22, as illustrated in FIG. 25, thereby pressing the blank BL to form the intermediate formed component 30 in a state in which the two end sides in the short direction of the blank BL are respectively sandwiched between the first holder 23 and the upper mold 21, and the second holder 24 and the upper mold 21. Moreover, as illustrated in FIG. 22, the blank BL is pressed by the step 22*a* and the step 21*a* accompanying formation of the intermediate formed component 30, such that a portion of the vertical wall 33*a* at a distance of not less than 40% of the height of the vertical wall 33*a* from the position of the top plate 2 is formed with the step 11*a* having the projection width a1 (*mm*). Moreover, as illustrated in FIG. 22, the blank BL is pressed by the step 22*a*' and the step 21*a*' accompanying formation of the intermediate formed component 30, such that a portion of the vertical wall 33*b* at a distance of not less than 40% of the height of the vertical wall 33*b* from the position of the top plate 2 is formed with the step 11*a*' having the projection width a1 (*mm*). Note that as a result of configuring the shape of the groove in the upper mold 21 and the shape of the projection portion of the lower mold 22 as described above, the steps 21*a*, 21*a*' are inclined such that a spacing across which the steps 21*a*, 21*a*' face each other is wider at the opening side than at the top plate 2 side, namely, such that the gap facing width widens as viewed along the length direction of the top plate 2. From another perspective, the steps 21*a*, 21*a*' are inclined such that the spacing across which the steps 21*a*, 21*a*' face each other is larger at the opening side than at the top plate 2 side.

Explanation has been given above regarding the first press device 18. However, from another perspective, the first press device 18 may be described in the following manner. Namely, the upper mold 21 is formed with a first groove, this being an elongated groove configured including a first groove-bottom face configuring an elongated groove-bottom face, and first side faces configured by side faces facing each other in a state in which one end of each is connected at one end to one of the two short direction ends of the groove-bottom face. Moreover, each first side face is curved as viewed along the mold closing direction, namely the direction in which the upper mold 21 and the lower mold 22 face each other, and the respective first side faces are configured by first curved faces in which the steps 11*a*, 11*a*' having a width of not more than 20% of the short direction width of the first groove-bottom face are respectively formed along the length direction of the first side faces, at portions at a specific depth of not less than 40% of the depth of the first groove from the first groove-bottom face. Moreover, the lower mold 22 fits together with the first groove during mold closure. Namely, an angle of inclination of a portion of the lower mold 22 further toward the lower side than the step 22*a* with respect to the up-down direction, namely the direction in which the upper mold 21 and the lower mold 22 face each other, is taken as θ1. Note that the steps 11*a*, 11*a*' are an example of a first step.

Second Press Device

Figure 21:
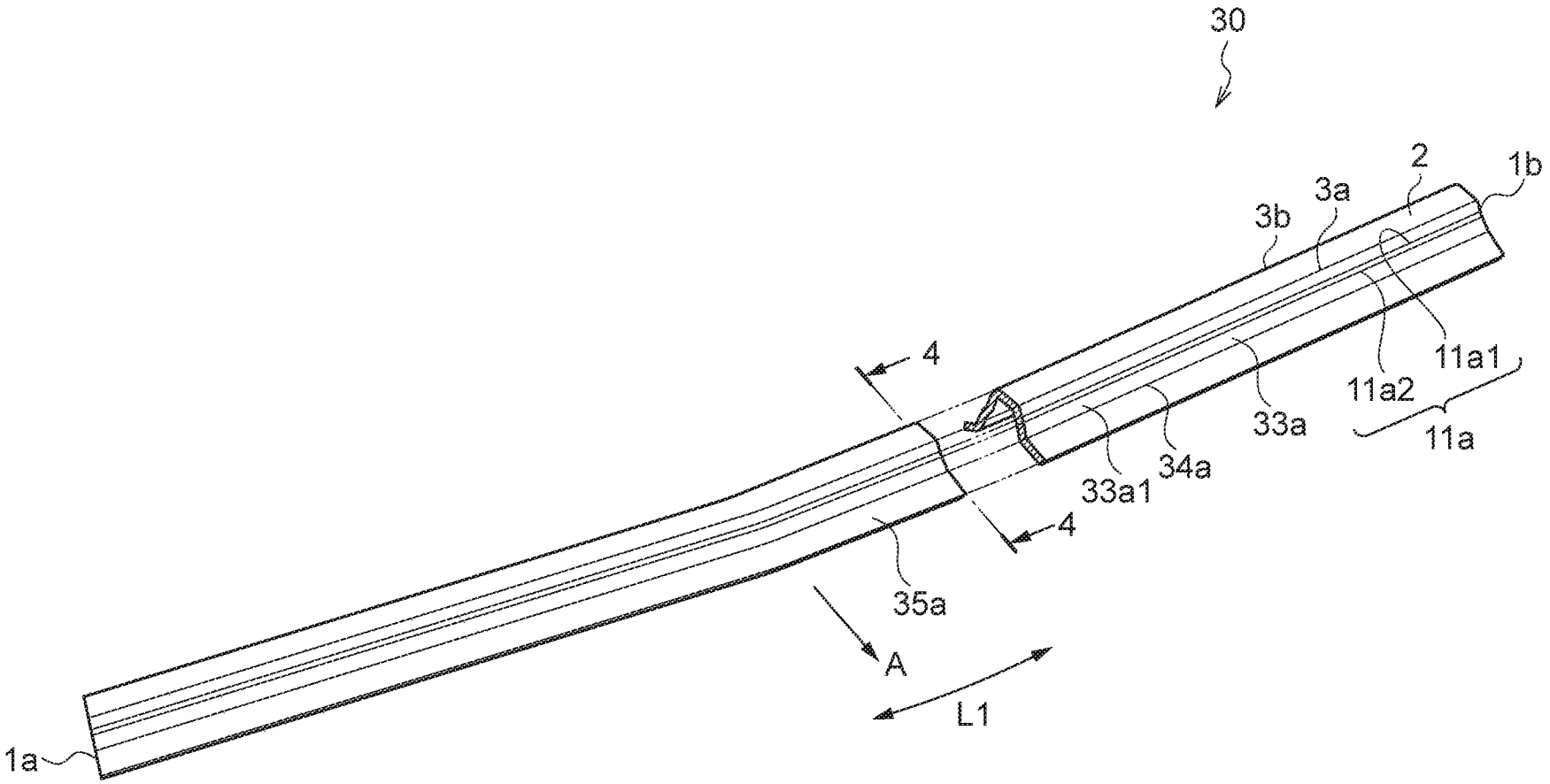
FIG. 21 is a perspective view illustrating an intermediate formed component of the third exemplary embodiment, and includes a lateral cross-section across a length direction.
Figure 23:
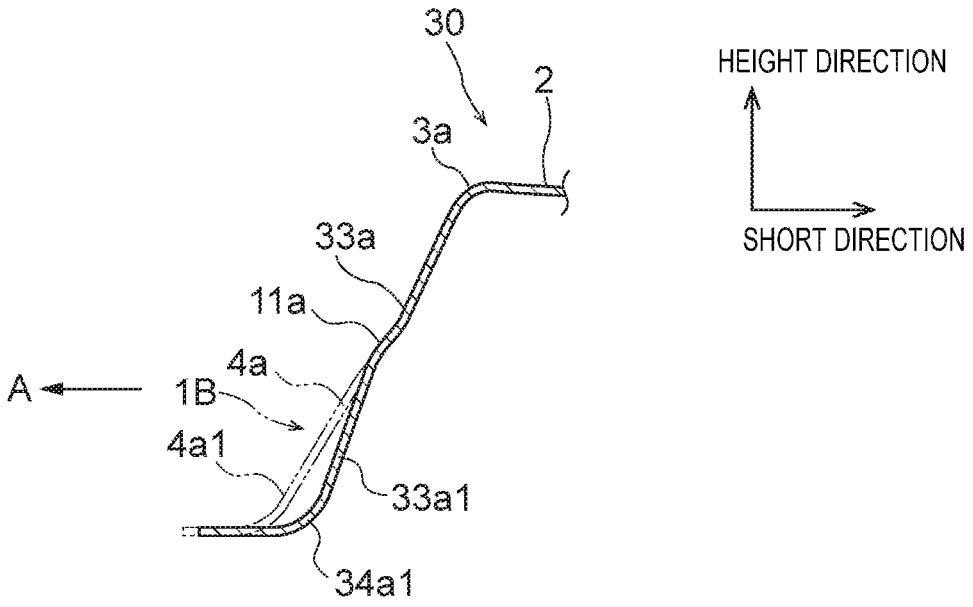
FIG. 23 is a schematic diagram in which part of the lateral cross-section of FIG. 22 (solid line) is overlaid with part of the cross-section of FIG. 20 (double-dotted dashed line).

As illustrated in FIG. 21, FIG. 22, and FIG. 23, the second press device 19B has a function of pressing the intermediate formed component 30, this being a forming target, so as to move a portion 33*a*1 of the intermediate formed component 30 further to the other end side than the step 11*a* formed to the vertical wall 33*a*, namely on the concave ridge line 34*a* side, toward the opposite side to the side on which the vertical walls 33*a*, 33*b* face each other, namely the opposite side to the facing side, and namely the arrow A direction side in the drawings.

Figure 26:
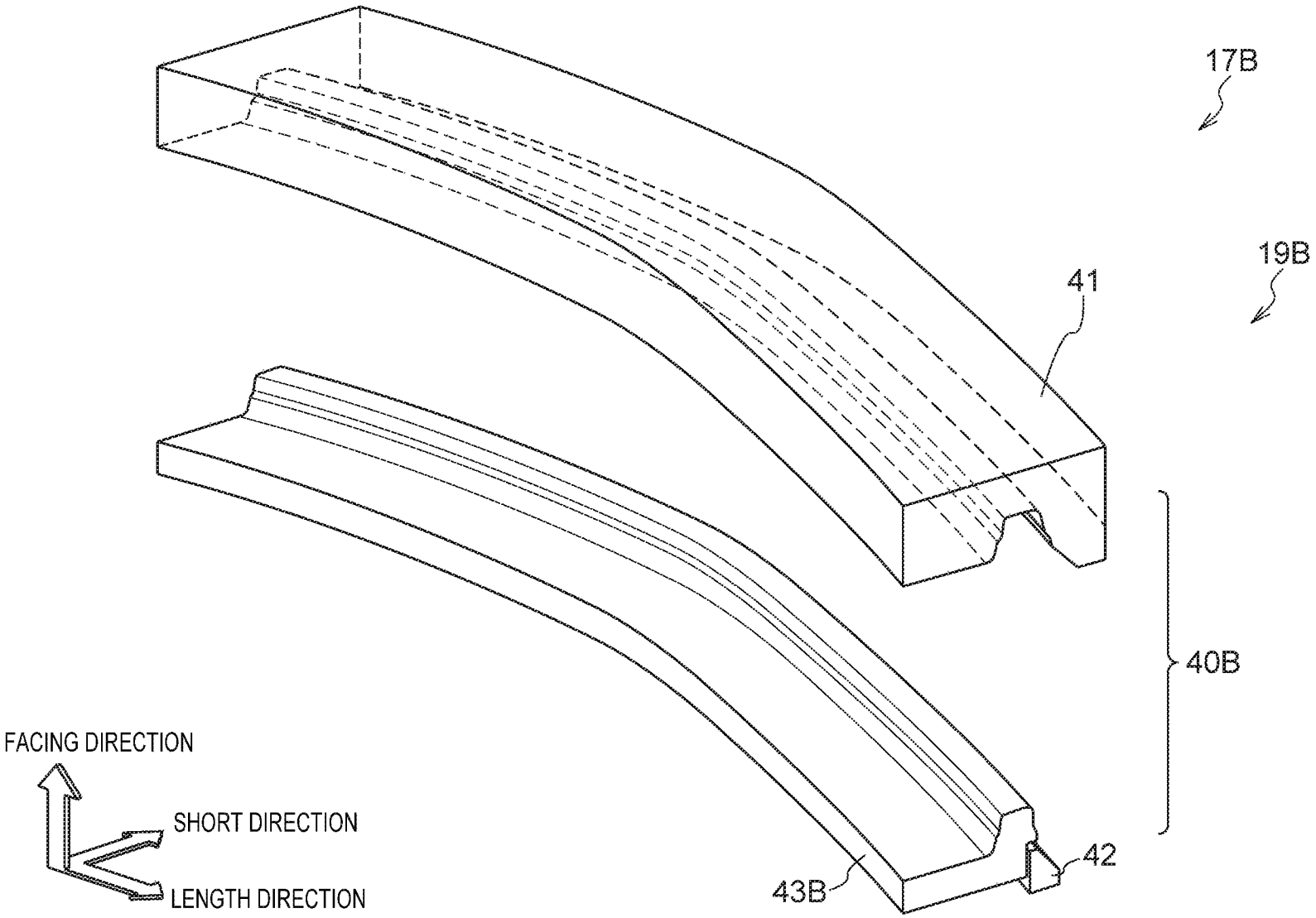
FIG. 26 is a perspective view of a mold of a second press device employed in a second process of the roof member manufacturing method of the third exemplary embodiment.
Figure 27:
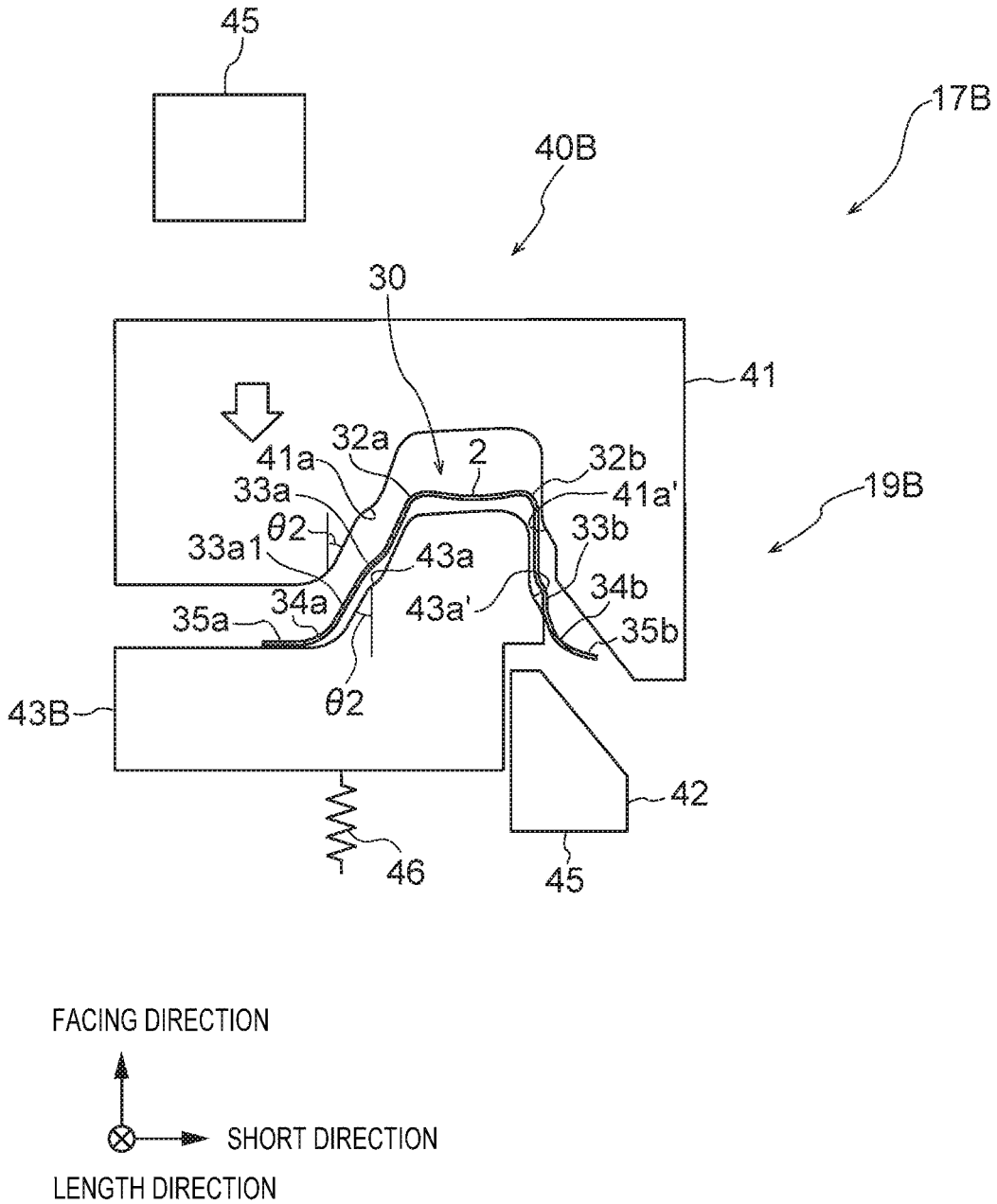
FIG. 27 is a lateral cross-section of a second press device employed in the second process of the roof member manufacturing method of the third exemplary embodiment, and an intermediate formed component.

As illustrated in FIG. 27, the second press device 19B is configured including a second mold 40B and a second moving device 45. As illustrated in FIG. 26 and FIG. 27, the second mold 40B includes an upper mold 41, a lower mold 43B, and a holder 42. The upper mold 41 is disposed on the upper side, and the lower mold 43B is disposed on the lower side. The lower mold 43B is biased from the lower side by a spring 46. Moreover, in the second press device 19B, in a state in which the intermediate formed component 30 has been fitted onto the lower mold 43B, the upper mold 41 is moved toward the lower mold 43B side by the second moving device 45 so as to change the angles of the two flanges 35*a*, 35*b* of the intermediate formed component 30.

Moreover, as illustrated in FIG. 27, as viewed along the length direction of the lower mold 43B, both side faces of the lower mold 43B are formed with respective steps 43*a*. Moreover, curved faces configuring the two side faces of the groove in the upper mold 41 are respectively formed with steps 41*a* following the steps 43*a*. Note that the steps 41*a* are an example of a second step. The shapes of the steps 43*a* are the same as the shapes of the steps 22*a* of the first press device 18. The steps 43*a* are formed at positions corresponding to the steps 22*a*, namely at positions overlapping the steps 11*a*, 11*a*' of the intermediate formed component 30. Moreover, the shapes of the steps 41*a* are the same as the shapes of the steps 21*a* of the first press device 18. The steps

41*a* are formed at positions corresponding to the step 22*a*', namely at positions overlapping the steps 11*a*, 11*a*' of the intermediate formed component 30. Note that as illustrated in FIG. 27, when the upper mold 41 is viewed along the length direction of the upper mold 41, the groove width becomes progressively wider from the groove bottom toward the open side of the groove, namely from the upper side toward the lower side. When the lower mold 43B is viewed along the length direction of the lower mold 43B, the width of the projecting portion becomes progressively narrower from the lower side toward the upper side. Moreover, the shape of the lower mold 43B is a shape that fits together with the shape of the groove in the upper mold 41 during mold closure.

In a state in which the intermediate formed component 30 has been fitted onto the lower mold 43B, when the second moving device 45 moves the upper mold 41 toward the lower mold 43B, the intermediate formed component 30 is pressed so as to form the roof member 1B. Accompanying formation of the intermediate formed component 30, the portion 33*a*1 of the vertical wall 33*a* further toward the other end side than the step 36*a* is moved toward the opposite side to (outer side of) the side on which the vertical walls 33*a*, 33*b* face each other (facing side). Accordingly, the angle of inclination θ2 of a portion of the lower mold 43B further toward the lower side than the step 43*a* with respect to the up-down direction, namely with respect to the direction in which the upper mold 21 and the lower mold 22 face each other, is greater than the angle of inclination θ1. Note that since the shape of the groove in the upper mold 41 and the shape of the projection portion of the lower mold 43B are configured as described above, the steps 43*a*, 41*a* are inclined such that as viewed across the short direction of the top plate 2, spacings across which the respective steps 43*a*, 41*a* face each other are larger, namely such that a facing width becomes wider, at the opening side than at the top plate 2 side. From another perspective, the steps 41*a*, 41*a*' are inclined such that the spacing across which the steps 41*a*, 41*a*' face each other is larger at the opening side than at the top plate 2 side.

Explanation has been given above regarding the second press device 19B. However, from another perspective, the second press device 19B can be described in the following manner. Namely, the upper mold 41 is formed with an example of a second groove, this being an elongated groove configured including a second groove-bottom face configuring a groove-bottom face having the same shape as the first groove-bottom configuring the groove-bottom face of the upper mold 21 of the first press device 18 as viewed along the mold closing direction, and second side faces configured by side faces each having one end connected to one of the two short direction ends of the second groove-bottom face and facing each other. Moreover, a second curved face configuring at least one of the second side faces is a second curved face that curves as viewed along the mold closing direction, namely, the direction in which the upper mold 41 and the lower mold 43B face each other, and that is formed with a second step at a position corresponding to the first step. Moreover, the angle θ2 by which a portion of the second curved face further toward the other end side than the second step is inclined with respect to the mold closing direction is larger than the angle θ1 by which the portion of the first curved face further toward the other end side than the first step is inclined with respect to the mold closing direction. Moreover, the lower mold 43B is configured so as to fit together with the shape of the second groove during mold closure. Namely, the shape of the lower mold 43B is a shape that fits together with the second groove during mold closure.

The foregoing was an explanation regarding configuration of the press apparatus 17B of the present exemplary embodiment.

Roof Member Manufacturing Method

Next, explanation follows regarding a manufacturing method of the roof member 1B of the present exemplary embodiment, with reference to the drawings. The manufacturing method of the roof member 1B of the present exemplary embodiment is performed employing the press apparatus 17B. Moreover, the manufacturing method of the roof member 1B of the present exemplary embodiment includes a first process, this being a process performed using the first press device 18, and a second process, this being a process performed using the second press device 19B.

First Process

In the first process, the blank BL is disposed in the gap between the upper mold 21 and the lower mold 22. Next, an operator operates the first press device 18 such that the upper mold 21 is moved toward the lower mold 22 side by the first moving device, and the blank BL is drawn so as to press the blank BL. Namely, in the first process, the upper mold 21 and the lower mold 22 are employed to press the blank BL, this being a forming target. The intermediate formed component 30 is formed from the blank BL as a result. The intermediate formed component 30 is then removed from the first mold 20, thereby completing the first process.

Second Process

The intermediate formed component 30 is then fitted onto the lower mold 43B of the second mold 40B of the second press device 19B. Next, the operator operates the second press device 19B such that the upper mold 41 is moved toward the lower mold 43B side by the second moving device, thereby pressing the intermediate formed component 30. Namely, in the second process, the blank BL that was formed using the upper mold 21 and the lower mold 22 in the first process is pressed. The roof member 1B is thereby formed from the intermediate formed component 30 as a result. Namely, in the second process, the intermediate formed component 30 is pressed, and of the vertical walls 4*a*, 4*b* configuring the curved walls, portions on the opposite side of the steps 11*b*, 11*b*' to the side connected to the convex ridge lines 3*a*, 3*b* are moved toward the opposite side to the facing side on which the vertical walls 4*a*, 4*b* face each other. The roof member 1B is then removed from the second mold 40B, thereby completing the second process. With this, the manufacturing method of the roof member 1B of the present exemplary embodiment is completed.

The foregoing was an explanation concerns the manufacturing method of the roof member 1B of the present exemplary embodiment.

Advantageous Effects

Next, explanation follows regarding advantageous effects of the present exemplary embodiment, described later, drawing comparison to a non-illustrated comparative embodiment, described later, of the present exemplary embodiment. In the following explanation of the comparative embodiment, when the components and the like employed are the same as the components and the like employed in the present exemplary embodiment, the reference signs for these components and the like are carried over as-is, even though they are not illustrated in the drawings. Note that a roof member of the comparative embodiment corresponds to Comparative Example 5B in the table of FIG. 27, described later.

In the comparative embodiment, the blank BL is pressed by the second press device 19B to form the roof member. The comparative embodiment is the same as the present exemplary embodiment with the exception of this point.

According to the evaluation results for Comparative Example 5B, as illustrated in the table in FIG. 32, leading end portion bending was 4.38 mm, rear end portion bending was 5.85 mm, and the average bend amount was 5.12 mm.

Figure 28:
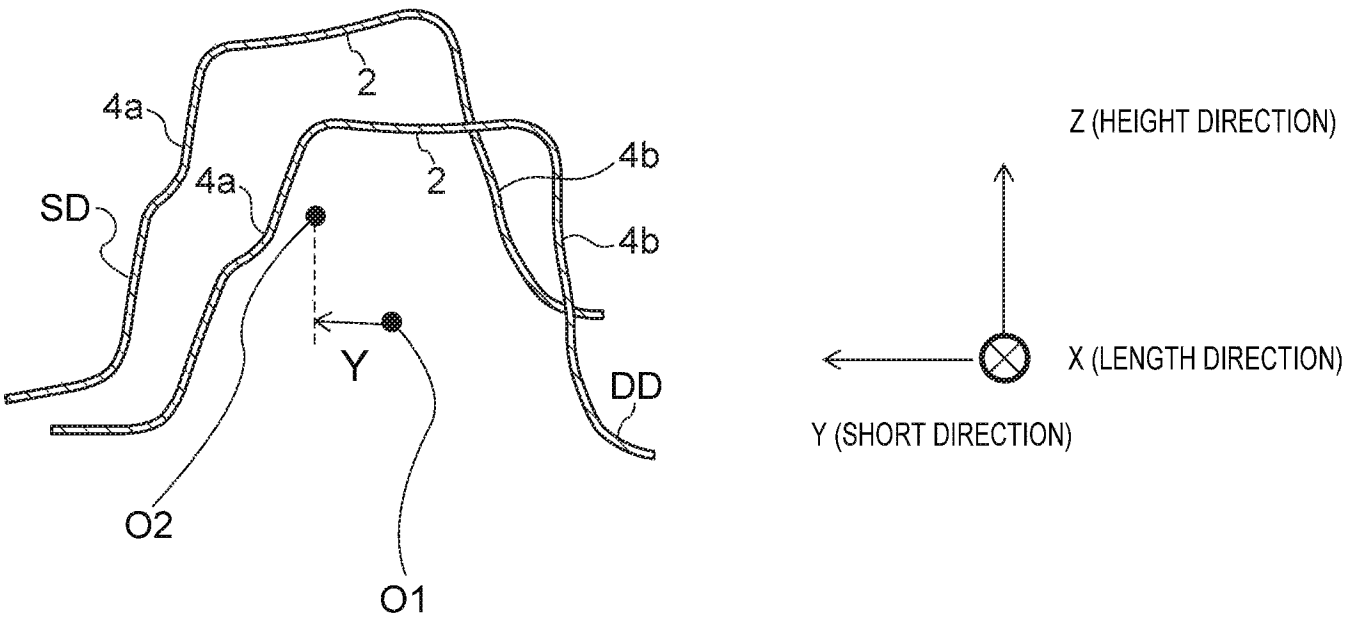
FIG. 28 is a diagram to explain an evaluation method for bending in the third exemplary embodiment.

Note that in the evaluation of leading end portion bending and rear end portion bending, data SD for roof members produced using simulations based on the roof member manufacturing method of the comparative embodiment, and data SD for roof members 1B produced using simulations based on the roof member manufacturing method of the present exemplary embodiment, was compared against design data DD. Specifically, using a computer, not illustrated in the drawings, cross-sections of length direction central portions of the top plate 2 were aligned, namely, a best fit was found. As illustrated in FIG. 28, bending was taken to be the amount of offset in the width direction of center positions of a leading end portion and a rear end portion in the measured data SD from center positions of the leading end portion and rear end portion in the design data DD. The average value of the leading end portion bending value and the rear end portion bending value was taken as the average bend amount.

By contrast, according to the evaluation of Example 9B of the present exemplary embodiment, as illustrated in the table of FIG. 32, for a roof member 1B produced using a simulation based on the manufacture of a roof member of the present exemplary embodiment, leading end portion bending was 5.02 mm, rear end portion bending was 4.34 mm, and the average bend amount was 4.68 mm. Namely, it may be said that Example 9B suppresses the occurrence of short direction bending of the top plate 2 caused by spring-back better than Comparative Example 5B.

The reason that the occurrence of bending as viewed from the top plate 2 side is better suppressed in the present exemplary embodiment than in the comparative embodiment is speculated to be as follows. Namely, in the comparative embodiment, as described above, the blank BL is pressed by the second press device 19B to form the roof member. As viewed from the top plate 2 side, the vertical wall 4*a* of the roof member is configured by a curved face curving in a convex shape bowing toward the opposite side to the side facing the vertical wall 4*b*. Moreover, the vertical wall 4*b* is inclined with respect to the up-down direction, namely the plate thickness direction of the top plate 2. Accordingly, in the comparative embodiment, when the roof member is pressed and removed from the second mold 40B, compressive stress in the length direction of the top plate 2 acts at the outer surface of the vertical wall 4*a*. In particular, as illustrated in FIG. 19 and FIG. 20, a portion 4*a*1 of the vertical wall 4*a* located further to the concave ridge line 5*a* side than the step 11*a* is further from the convex ridge line 3*a* than a portion 4*a*2 of the vertical wall 4*a* located further to the convex ridge line 3*a* side than the step 11*a*. Accordingly, compressive stress acting in the length direction of the top plate 2 is greater at the outer surface of the portion 4*a*1 than at the outer surface of the portion 4*a*2. It is speculated that the occurrence of bending of the roof member of the comparative embodiment as viewed from the top plate 2 side is as a result of the above. By contrast, as illustrated in FIG. 23, in the present exemplary embodiment, in the second process, further toward the other end side than the step 11*a* formed in the vertical wall 33*a* of the intermediate formed component 30, namely the portion 33*a*1 on the concave ridge line 34*a* side, is moved toward the opposite side to the side on which the vertical walls 33*a*, 33*b* face each other, namely the opposite side to the facing side, namely the arrow A direction side in the drawings, and becomes the portion 4*a*1. Accordingly, the present exemplary embodiment attains a state in which compressive stress acting in the length direction of the portion 4*a*1 is reduced in comparison to in the comparative embodiment. As a result, in the present exemplary embodiment, the desired shape is easier to achieve than in the comparative embodiment following bending caused by compressive stress acting at the outer surface of the portion 4*a*1. In other words, compared to the comparative embodiment, the present exemplary embodiment facilitates formation within permissible bending values following bending caused by compressive stress acting at the outer surface of the portion 4*a*1.

Figure 31:
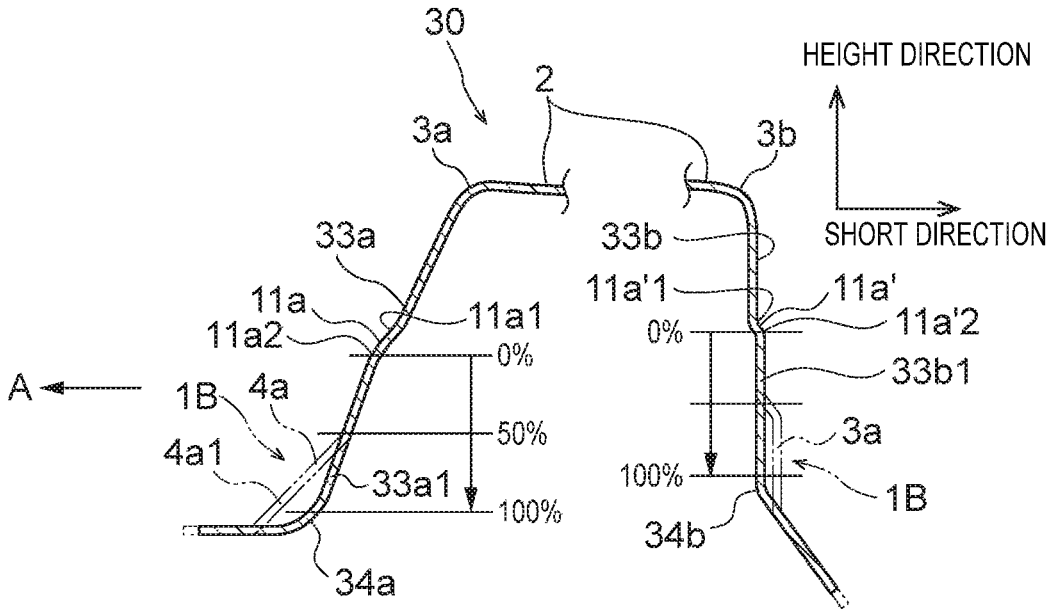
FIG. 31 is a diagram to explain an outside vertical wall change start point and an inside vertical wall change start point in an Example and a Comparative Example of the third exemplary embodiment.

Accordingly, according to the present exemplary embodiment, in the second process, the occurrence of short direction bending of the top plate 2 as a result of spring-back is better suppressed than in cases in which the vertical wall 33*a* of the intermediate formed component 30 is not moved toward the opposite side to the side on which the vertical walls 33*a*, 33*b* face each other. Moreover, in the present exemplary embodiment, as illustrated in FIG. 31, residual tensile stress in a portion of the vertical wall 4*a* further toward the lower side than the step 11*a* and residual compressive stress in a portion of the vertical wall 4*b* further to the lower side than the step 11*a*' can be reduced in comparison to in cases in which the vertical wall 33*a* of the intermediate formed component 30 is not moved toward the opposite side to the side on which the vertical walls 33*a*, 33*b* face each other. From another perspective, in cases in which the vertical wall 33*a* of the intermediate formed component 30 is not moved toward the opposite side to the side on which the vertical walls 33*a*, 33*b* face each other, for example, it is not possible to selectively reduce residual stress in a specific portion of the vertical wall (for example, a portion at the lower side of the vertical wall). However, the present exemplary embodiment may be said to enable a reduction in residual compressive stress at the portions of the vertical walls 4*a*, 4*b* further to the lower side than the steps 11*a*, 11*a*', namely at specific portions of the vertical walls 4*a*, 4*b*. In particular, the present exemplary embodiment may be said to be effective in the point of enabling a selective reduction in residual stress in this lower side portion across the entirety of the vertical walls 4*a*, 4*b* in cases in which a large residual stress occurs at portions further to the lower side than the steps 11*a*, 11*a*'. Moreover, in the present exemplary embodiment, in the second process, out of the vertical wall 4*a*, the portion 33*a*1 located further away from the convex ridge line 3*a* is moved toward the opposite side to the side on which the vertical walls 33*a*, 33*b* face each other, such that the advantageous effect of suppressing short direction bending of the top plate 2 as a result of spring-back becomes even more apparent.

The foregoing was an explanation regarding the advantageous effects of the present exemplary embodiment.

Fourth Exemplary Embodiment

Next, explanation follows regarding the fourth exemplary embodiment. First, explanation follows regarding configuration of a roof member 1C of the present exemplary embodiment illustrated in FIG. 29 and FIG. 30. Explanation then follows regarding configuration of a press apparatus, not illustrated in the drawings, of the present exemplary embodiment. This will be followed by explanation regarding a manufacturing method of the roof member of the present exemplary embodiment. This will then be followed by explanation regarding advantageous effects of the present exemplary embodiment. Note that the following explanation concerns portions of the present exemplary embodiment differing from those of the third exemplary embodiment. In the following explanation, when the reference signs used for components and the like in the present exemplary embodiment are similar to the reference signs used for components and the like in the first to the third exemplary embodiments, the reference signs for these components and the like are carried over as-is.

Roof Member Configuration

First, explanation follows regarding configuration of the roof member 1C of the present exemplary embodiment, with reference to the drawings. Note that the roof member 1C is an example of a pressed component and a specific pressed component.

Figure 29:
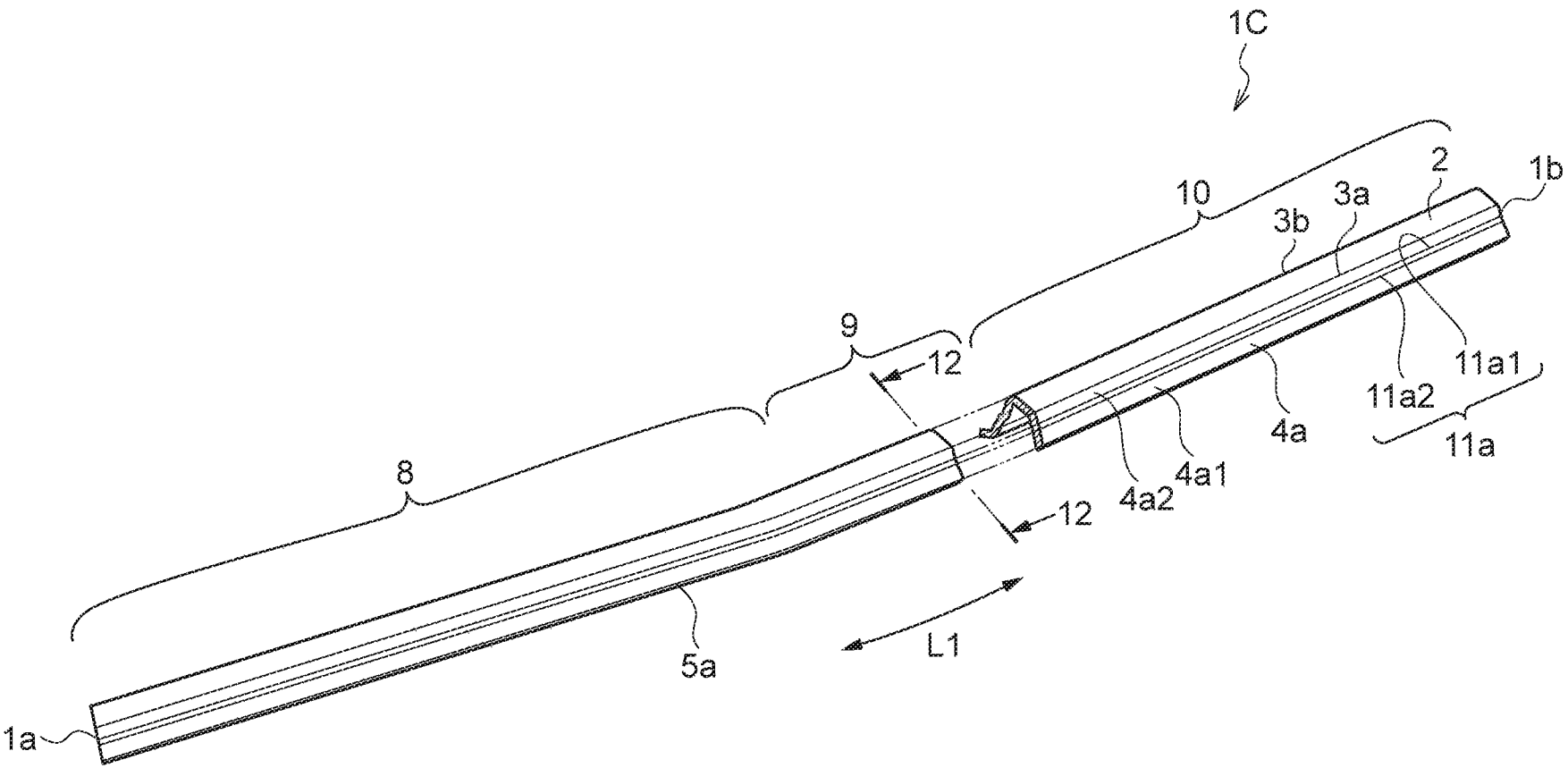
FIG. 29 is a perspective view illustrating a roof member of a fourth exemplary embodiment, and includes a lateral cross-section across a length direction.
Figure 30:
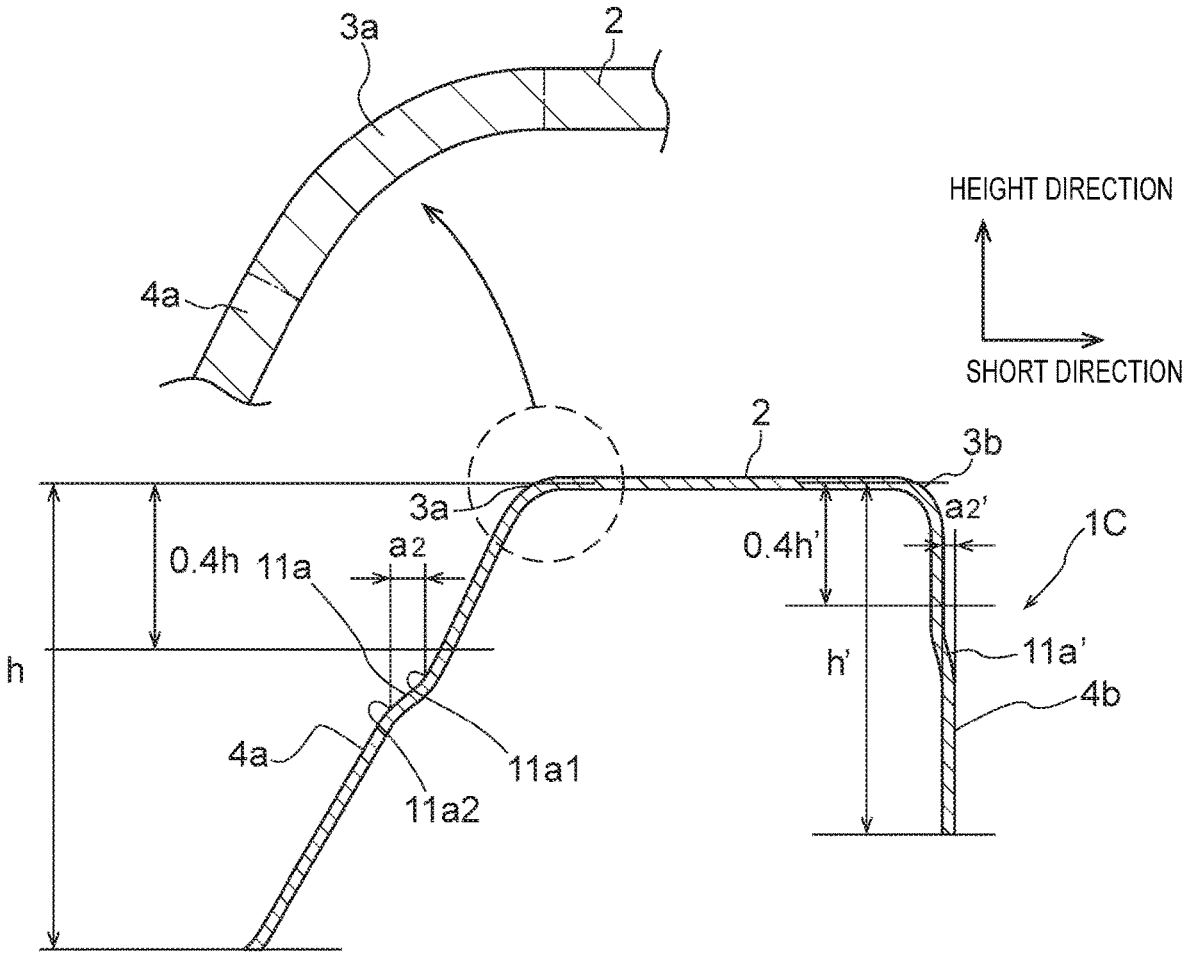
FIG. 30 is a cross-section taken along line 12-12 in FIG. 29, and illustrates a roof member of the fourth exemplary embodiment in cross-section.

As illustrated in FIG. 29 and FIG. 30, the roof member 1C of the present exemplary embodiment does not include the flanges 6*a*, 6*b* of the third exemplary embodiment, illustrated in FIG. 19 and FIG. 20. With the exception of this point, the roof member 1C of the present exemplary embodiment has the same configuration as the roof member 1B of the third exemplary embodiment.

Press Apparatus Configuration

Next, explanation follows regarding the press apparatus of the present exemplary embodiment. The press apparatus, not illustrated in the drawings, of the present exemplary embodiment, is used to manufacture the roof member 1C.

A first press device, not illustrated in the drawings, of the present exemplary embodiment differs from the first press device 18 of the third exemplary embodiment illustrated in FIG. 24 and FIG. 25 in that it does not include the holders 23, 24. With the exception of this point, the first press device of the present exemplary embodiment has the same configuration as the press apparatus 17B of the third exemplary embodiment. Moreover, an intermediate formed component formed by the first press device has the same configuration as the intermediate formed component 30A of the second exemplary embodiment. Namely, the intermediate formed component of the present exemplary embodiment is configured by a member having a gutter-shaped lateral cross-section profile as viewed along the length direction of the top plate 2.

Roof Member Manufacturing Method

Next, explanation follows regarding the manufacturing method of the roof member 1C of the present exemplary embodiment. The manufacturing method of the roof member 1C of the present exemplary embodiment is the same as that of the third exemplary embodiment, with the exception of the point that the first press device of the present exemplary embodiment is employed instead of the first press device 18 of the third exemplary embodiment. Note that in the present exemplary embodiment, in the first process, the blank BL is pressed by bending to form the intermediate formed component, and in the second process, the intermediate formed component is pressed by bending to form the roof member 1C.

Advantageous Effects

Advantageous effects of the present exemplary embodiment is the same as the advantageous effects of the third exemplary embodiment, as illustrated in the table of FIG. 33, described later.

The foregoing was an explanation regarding the advantageous effects of the present exemplary embodiment.

Examples of the Third and Fourth Exemplary Embodiments

Next, explanation follows regarding simulations of Examples and Comparative Examples of the third and fourth exemplary embodiments, with reference to the drawings. Note that in the following explanation, when the reference signs used for components and the like are similar to the reference signs used for components and the like in the third and fourth exemplary embodiments and in the comparative embodiments, the reference signs for these components and the like are carried over as-is.

As illustrated in the table of FIG. 32, in the present simulation, bending at the front end portion 1*a* and the rear end portion 1*b*, as well as the average bend amount, were evaluated for roof members 1B of Examples 1B to 19B, these being produced using simulations based on the roof member manufacturing method of the third exemplary embodiment, and for roof members of Comparative Examples 1B to 6B, these being produced using simulations based on the roof member manufacturing method of the comparative embodiment described above. Moreover, in the present simulation, as illustrated in the table of FIG. 33, bending at the front end portion 1*a* and the rear end portion 1*b*, as well as the average bend amount, were evaluated for roof members 1 of Examples 20B to 37B, these being produced using simulations based on the roof member manufacturing method of the fourth exemplary embodiment, and for roof members of Comparative Examples 7B to 12B, these being produced using simulations based on the roof member manufacturing method of the comparative embodiment described above.

Explanation Regarding the Table of FIG. 32

The table of FIG. 32 lists simulation parameters and evaluation results for Examples 1B to 19B and Comparative Examples 1B to 6B, each of which is configured with a hat-shape. Note that in the table of FIG. 32, "plate thickness" is the thickness of the blank BL employed in the simulation. "Strength" is the tensile strength of the blank BL employed in the simulation. The "outside vertical wall change start point (%)" represents the start position of the portion 33*a*1 when the protrusion 11*a*2 of the intermediate formed component 30 is taken as a reference (0%), and the height direction position of the other end of the portion 33*a*1, namely the end portion connected to the concave ridge line 34*a*, is taken as 100%. For example, FIG. 31 illustrates a case in which the outside vertical wall change start point is 50%. Moreover, when the outside vertical wall change start point (%) is given as "–", this is in reference to the fact that there is no change start point, namely that the portion 33*a*1 is not moved in the second process. The "inside vertical wall change start point (%)" represents the start position of a portion 33*b*1 further toward the lower side than the protrusion 11*a*'2 when the protrusion 11*a*'2 of the intermediate formed component 30 is taken as a reference (0%) and the height direction position of the other end of the portion 33*b*1, namely of the end portion connected to the concave ridge line 34*b*, is taken as 100%. For example, FIG. 31 illustrates a case in which the inside vertical wall change start point is 50%. Moreover, when the inside vertical wall change start point (%) is given as "–", this is in reference to the fact that there is no change start point, namely that the portion 33*b*1 is not moved in the second process. Accordingly, when forming the roof member 1B illustrated in FIG.

31, only the second press device differs from the second press device 19B of the press apparatus 17 of the third exemplary embodiment. More specifically, the second press device is configured such that when a cross-section of the second die is projected onto a cross-section of the first die, on the second curved face of the second die, at least a portion located further toward the other end side than the second step is further toward the outside than a portion of the first curved face located further toward the other end side than the first step. Namely, the second press device has a function of pressing the intermediate formed component 30, this being a forming target, and moving the portion 33*b*1 located further to the other end side than the step 11*a*' formed to the vertical wall 33*b* of the intermediate formed component 30, namely located on the concave ridge line 34*b* side, toward the opposite side to the side on which the vertical walls 33*a*, 33*b* face each other, namely toward the opposite side to the facing side.

The roof members of Comparative Examples 1B to 4B are examples of the comparative embodiment of the third exemplary embodiment described above. The roof members of Examples 1B to 19B are examples of the roof member 1B of the third exemplary embodiment.

Evaluation Results and Interpretation

From the table of FIG. 32, it is apparent that the roof members 1B of the Examples underwent less bending or experienced smaller amounts of bending than the roof members of the Comparative Examples when the Examples and the Comparative Examples have the same parameters for plate thickness and strength. For example, when Example 1B is compared against Comparative Example 1B, or when Example 3B is compared against Comparative Example 2B, in each case the Example underwent less bending or experienced a smaller amount of bending than the corresponding Comparative Example. Namely, these examples may be considered to exhibit the operation and advantageous effects of the third exemplary embodiment.

Moreover, when Example 14B is compared against Comparative Example 5B, Example 14B underwent less bending or experienced a smaller amount of bending than Comparative Example 5B. In Example 14B, the portion 33*b*1 of the vertical wall 4*b* located further to the lower side than the step 11*a*' is moved toward the opposite direction to the facing direction of the vertical walls 33*a*, 33*b*. The vertical wall 4*b* configures a curved face curving in a concave shape opening toward the opposite side to the side facing the vertical wall 4*b* as viewed from the top plate 2. Moreover, in the roof member of Example 14B, it may be expected that after tensile stress has acted in and caused bending of the outer surface of the portion 33*b*1 that has been moved, the desired shape would be easier to achieve than in Comparative Example 5B, and in the roof members of Example 5B and Example 9B it may be expected that after tensile stress has acted in and caused bending of the outer surface of the portion 33*b*1 that has been moved, the desired shape would be easier to achieve than in Comparative Example 5B. In other words, in the case of the roof member of Example 14B and in the cases of the roof members of Example 5B and Example 9B, in comparison to Comparative Example 5B, the outer surface of the portion 33*b*1 that has been moved is easier to form within the permissible bending value range after being acted on and bent by tensile stress.

Explanation Regarding the Table of FIG. 33

The table of FIG. 33 lists simulation parameters and evaluation results for Examples 20B to 37B and for Comparative Examples 7B to 12B, each of which is configured with a gutter-shaped profile.

The roof members of Comparative Examples 7B to 12B are examples of a comparative embodiment of the third exemplary embodiment described above. The roof members of Examples 20B to 37B are examples of the roof member 1B of the third exemplary embodiment.

Evaluation Results and Interpretation

From the table of FIG. 33, it is apparent that the roof members of the Examples underwent less bending or experienced a smaller amount of bending than the roof members of the Comparative Examples when the Examples and the Comparative Examples have the same parameters for plate thickness and strength. For example, when Example 20B is compared against Comparative Example 7B, or when Example 21B is compared against Comparative Example 8B, in each case, the Example underwent less bending or experienced a smaller amount of bending than the corresponding Comparative Example. Namely, Example 20B and Example 21B may be considered to exhibit the operation and advantageous effects of the fourth exemplary embodiment.

Moreover, when Example 31B is compared against Comparative Example 11B, Example 31B underwent less bending or experienced a smaller amount of bending than Comparative Example 11B. In Example 31B, the portion 33*b*1 of the vertical wall 4*b* located further to the lower side than the step 11*a*' is moved toward the opposite direction to the facing direction of the vertical walls 33*a*, 33*b*. The vertical wall 4*b* configures a curved face curving in a concave shape toward the opposite side to the side facing the vertical wall 4*b* as viewed from the top plate 2. Moreover, in the roof member of Example 31B, it may be expected that after tensile stress has acted in and caused bending of the outer surface of the portion 33*b*1 that has been moved, the desired shape would be easier to achieve than in Comparative Example 11B. In other words, in the case of the roof member of Example 31B, in comparison to Comparative Example 11B, the outer surface of the portion 33*b*1 that has been moved is easier to form within the permissible bending value range after being acted on and bent by tensile stress.

The foregoing was an explanation regarding Examples of the third and fourth exemplary embodiments.

The present disclosure has been explained above using the first to fourth exemplary embodiments, these being specific exemplary embodiments. However, configurations other than those of the first to fourth exemplary embodiments described above are also included within the technical scope of the present disclosure. For example, the following configurations are also included within the technical scope of the present disclosure.

In the first and second exemplary embodiments and the Examples, explanation has been given using the roof members 1, 1A as examples of the pressed component. However, the pressed component may be an automotive component other than the roof members 1, 1A as long as it is manufactured by pressing so as to satisfy the conditions of Equation 1. Moreover, the pressed component may also be a component other than an automotive component as long as it is manufactured by pressing so as to satisfy the conditions of Equation 1.

In the first and second exemplary embodiments and in the Examples thereof, explanation has been given in which the vertical walls 4*a*, 4*b* configuring curved walls are respectively formed with the steps 11*a*, 11*a*'. However, as long as the step 36*a* or 36*a*' is formed to either one of the vertical walls 4*a*, 4*b*, the step 36*a* or 36*a*' need not be formed to the other of the vertical walls 4*a*, 4*b*.

In the first and second exemplary embodiments and in the Examples thereof, explanation has been given in which the vertical walls 4*a*, 4*b* are configured as curved walls. However, as long as either one of the vertical walls 4*a*, 4*b* is a curved wall, and the step 11*a* or 11*a*' manufactured by the manufacturing method of the roof member 1 or 1A of the respective exemplary embodiments is formed as a step on that curved wall, then there is no need for the other of the vertical walls 4*a*, 4*b* to be a curved wall. For example, the other of the vertical walls 4*a*, 4*b* may be a wall running along the length direction in a straight line shape.

In the first and second exemplary embodiments and in the Examples thereof, explanation has been given in which the projection width a1 of the step of the curved wall formed in the first process is narrowed in the second process to a2, this being narrower than a1. However, in the second process, as long as the projection width a1 of the step formed in the first process is narrowed, the step formed in the first process may be eliminated in the second process. Namely, in the present disclosure, "narrowing the projection width of the step" encompasses eliminating the projection width of the step, in other words, eliminating the step itself.

In the third and fourth exemplary embodiments and their Examples, explanation has been given using the roof members 1B, 1C as examples of the pressed component. However, the pressed component may be an automotive component other than the roof members 1B, 1C as long as its manufacture includes a process in which an intermediate formed component is pressed such that a portion of a curved wall further toward another end side than a step is moved toward the opposite side to a facing side. Moreover, the pressed component may also be a component other than an automotive component as long as it includes a process in which an intermediate formed component is pressed such that a portion of a curved wall further toward another end side than a step is moved toward the opposite side to a facing side.

In the third and fourth exemplary embodiments and their Examples, explanation has been given in which the vertical walls 4*a*, 4*b* are configured as curved walls. However, as long as either one of the vertical walls 4*a*, 4*b* is a curved wall, and its formation includes a process of pressing an intermediate formed component such that a portion of the curved wall further toward another end side than a step is moved toward the opposite side to a facing side, the other out of the vertical walls 4*a*, 4*b* need not be a curved wall. For example, the other out of the vertical walls 4*a*, 4*b* may be a wall running along the length direction in a straight line shape.

In the first and second exemplary embodiments and in the Examples thereof, as illustrated in FIG. 12, explanation has been given in which the intermediate formed component 30 is pressed so as to narrow the width of the projection width a1 of the steps 11*a*, 11*a*' of the vertical walls 33*a*, 33*b* in the second process that follows the first process. However, other forming may also be performed in the second process as long as, at a minimum, the intermediate formed component 30 is pressed so as to narrow the width of the projection width a1 of the steps 11*a*, 11*a*' of the vertical walls 33*a*, 33*b* in the second process of the first and second exemplary embodiments and of the Examples thereof. For example, in the second process of the first and second exemplary embodiments and the Examples thereof, the second process of the third and fourth exemplary embodiments and the Examples thereof may be performed. Namely, after the blank BL is pressed to form the intermediate formed component 30 in the first process, in the second process, the width of the projection width a1 of the steps 11*a*, 11*a*' of the intermediate formed component 30 may be narrowed, and the portions 33*a*1 of the vertical walls 33*a*, 33*b* further toward the other end side (concave ridge line 34*a* side) than the steps 11*a*, 11*a*' of the vertical walls 33*a*, 33*b* may be moved toward the opposite side (the arrow A direction side in the drawings) to the side on which the vertical walls 33*a*, 33*b* face each other (the facing side). Such modified examples may be said to exhibit the first and second advantageous effects of the first and second exemplary embodiments as well as the advantageous effects of the third and fourth exemplary embodiments.

As illustrated in FIG. 12, in the first and second exemplary embodiments and the Examples thereof, explanation has been given in which the intermediate formed component 30 is pressed so as to narrow the width of the projection width a1 of the steps 11*a*, 11*a*' of the vertical walls 33*a*, 33*b* in the second process that follows the first process. However, in the second process of the first and second exemplary embodiments and the Examples thereof, other forming may be performed after the first process and before the second process, or after the second process, as long as at a minimum, the intermediate formed component 30 is pressed so as to narrow the width of the projection width a1 of the steps 11*a*, 11*a*' of the vertical walls 33*a*, 33*b* of the intermediate formed component 30. For example, the second process of the third and fourth exemplary embodiment and the Examples thereof may be performed after the first process and before the second process of the first and second exemplary embodiments and the Examples thereof. Moreover, for example, the second process of the third and fourth exemplary embodiments and the Examples thereof may be performed after the second process of the first and second exemplary embodiments and the Examples thereof. Such modified examples may be said to exhibit the first and second advantageous effects of the first and second exemplary embodiments as well as the advantageous effects of the third and fourth exemplary embodiments.

Supplement

The following additional disclosure is a generalization from the present specification.

Namely, a first aspect of the additional disclosure is

"A manufacturing method for a pressed component in which:

a blank configured by sheet steel having a tensile strength of from 440 MPa to 1600 MPa is subjected to a first pressing using a punch, a die, and a holder so as to manufacture an intermediate formed component that has a substantially hat-shaped lateral cross-section profile configured by a top plate present extending along a length direction, two ridge lines respectively connected to both sides of the top plate, two vertical walls respectively connected to the two ridge lines, two concave ridge line portions respectively connected to the two vertical walls, and two flanges respectively connected to the two concave ridge line portions, and that includes a curved portion curved from one end portion to another end portion in the length direction in both plan view and side view when disposed in an orientation in which the top plate is positioned at an upper portion; and the intermediate formed component is subjected to a second pressing employing a punch, a die, and a holder, wherein the pressed component:

has a substantially hat-shaped lateral cross-section profile configured by a top plate present extending along a length direction and having a width W, two ridge lines respectively connected to both sides of the top plate, two vertical walls respectively connected to the two ridge lines, two concave ridge line portions respectively connected to the two vertical walls, and two flanges respectively connected to the two concave ridge line portions, includes a curved portion curved from one end portion to another end portion in the length direction in both plan view and side view when disposed in an orientation in which the top plate is positioned at an upper portion;

is configured by a first portion on a side in the length direction including the one end portion, a third portion on a side in the length direction including the other end portion, and a second portion contiguously connected to both the first portion and the third portion, the radius of curvature being smaller than the radius of curvature of the first portion and the radius of curvature of the third portion; and is formed with a step on at least one vertical wall out of the two vertical walls, the step being formed in a range within 60% of a total height from the flange, having a projection width a2, and running along the length direction; and wherein in the first pressing, at least one vertical wall out of the two vertical walls of the intermediate formed component is formed with a step, the step being formed within a range of 60% of a total height from the flange, and having a projection width a1 as defined by Equation (A) and Equation (B) below, and in the second pressing, forming is performed such that the projection width of the step becomes a2.

$$a1 \geq a2 \quad \text{(A)}$$

$$a1 \leq 0.2W \quad \text{(B)}$$

Moreover, a second aspect of the additional disclosure is "A manufacturing method for a pressed component in which:

a blank configured by sheet steel having a tensile strength of from 440 MPa to 1600 MPa is subjected to a first pressing using a punch, a die, and a holder so as to manufacture an intermediate formed component that has a substantially hat-shaped lateral cross-section profile configured by a top plate present extending along a length direction, two ridge lines respectively connected to both sides of the top plate, two vertical walls respectively connected to the two ridge lines, two concave ridge line portions respectively connected to the two vertical walls, and two flanges respectively connected to the two concave ridge line portions, and that includes a curved portion curved from one end portion to another end portion in the length direction in both plan view and side view when disposed in an orientation in which the top plate is positioned at an upper portion; and the intermediate formed component is subjected to a second pressing employing a punch, a die, and a holder, wherein the pressed component:

has a substantially hat-shaped lateral cross-section profile configured by a top plate present extending along a length direction, two ridge lines respectively connected to both sides of the top plate, two vertical walls respectively connected to the two ridge lines, two concave ridge line portions respectively connected to the two vertical walls, and two flanges respectively connected to the two concave ridge line portions, includes a curved portion curved from one end portion to another end portion in the length direction in both plan view and side view when disposed in an orientation in which the top plate is positioned at an upper portion;

is configured by a first portion on a side in the length direction including the one end portion, a third portion on a side in the length direction including the other end portion, and a second portion contiguously connecting the first portion and the third portion together, the radius of curvature being smaller than the radius of curvature of the first portion and the radius of curvature of the third portion; and is formed with a step on at least one vertical wall out of the two vertical walls, the step being formed in a range within 60% of a total height from the flange, having a projection width a2, and running along the length direction; and wherein in the first pressing, the vertical wall and the flange on an inner side of the curved portion are formed such that an angle DI1 formed between the vertical wall and the flange on the inner side of the curved portion of the intermediate formed component satisfies Equation (C) below, and in the second pressing, the vertical wall formed on the inner side of the curved portion of the intermediate formed component forms the vertical wall on an inner side of the curved portion of the pressed component, and the flange on the inner side of the curved portion of the intermediate formed component forms the flange on the inner side of the curved portion.

$$1.0 \times DI2 \leq DI1 \leq 1.2 \times DI2 \quad \text{(C)}$$

wherein DI2 refers to an angle formed between the vertical wall and the flange on the inner side of the curved portion of the pressed component."

Moreover, a third aspect of the additional disclosure is "A manufacturing method for a pressed component configured including an elongated top plate, ridge line portions at both short direction ends of the top plate, and a pair of vertical walls facing each other in a state in which one end of each of the vertical walls is connected to the respective ridge line portions and at least one of the vertical walls configuring a curved wall curving as viewed from an upper side of the top plate, the manufacturing method comprising:

a first process of pressing a blank to form an intermediate formed component configured including the top plate, the ridge line portions at both ends, and a pair of vertical walls facing each other in a state in which one end of each of the vertical walls is connected to the respective ridge line and at least one of the vertical walls configuring a curved wall curving as viewed from the upper side of the top plate, such that a step projecting out toward the opposite side to a facing side on which the vertical walls face each other is formed to the curving wall so as to run along the length direction of the top plate; and a second process of pressing the intermediate formed component such that a portion of the curved wall on another end side of the step is moved toward the opposite side to the facing side."

The disclosures of Japanese Patent Application Nos. 2015-087504 and 2015-087505, filed on Apr. 22, 2015, the disclosure of Japanese Patent Application No. 2016-056041, filed on Mar. 18, 2016, and the disclosure of Japanese Patent Application No. 2016-057267, filed on Mar. 22, 2016, are incorporated in their entirety by reference herein.

All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. A manufacturing method for a pressed component configured including an elongated top plate, ridge lines at both short direction ends of the top plate, and vertical walls facing each other in a state extending from the respective ridge lines and at least one of the vertical walls configuring a curved wall curving as viewed from an upper side of the top plate, the manufacturing method comprising: a first process of pressing a blank to form an intermediate formed component configured including the top plate, the ridge lines at both ends, and the vertical walls, and in which a step projecting toward an opposite side to a side on which the vertical walls face each other is formed to the curved wall so as to run along a length direction of the top plate; and a second process of performing at least one out of pressing the intermediate formed component so as to narrow a projection width of the step, or pressing the intermediate formed component so as to move a portion of the curved wall on an opposite side of the step to a portion of the curved wall on the top plate side of the step toward the opposite side to the side on which the vertical walls face each other, wherein the first process is performed by a first press device and the second process is performed by a second press device;

wherein the first press device presses a blank using a first die and a first punch so as to form the intermediate formed component, and the second press device presses the intermediate formed component with a second die and a second punch, wherein in the first press device, an elongated first groove configured including an elongated first groove-bottom face and first side faces connected to both short direction ends of the first groove-bottom face is formed in the first die, at least one of the first side faces configures a first curved face that is curved as viewed along a mold closing direction, and that is formed with a first step at a position at a specific depth at a distance of not less than 40% of a depth of the first groove from the first groove-bottom face, the first step having a width of not more than 20% of a short direction width of the first groove-bottom face and running along a length direction of the first side face, and the shape of the first punch is a shape that fits together with the shape of the first groove during mold closure; and in the second press device, an elongated second groove configured including an elongated second groove-bottom face and second side faces connected to both short direction ends of the second groove-bottom face is formed in the second die, at least one of the second side faces configures a second curved face that is curved as viewed along the mold closing direction, and that is formed with a second step at a position at the specific depth from the second groove-bottom face, the step running along a length direction of the second side face, the second step is narrower in width than the first step, and a separation distance between the second groove-bottom face and the second step in the short direction of the second groove-bottom face is longer than a separation distance between the first groove-bottom face and the first step in the short direction of the first groove-bottom face, and the shape of the second punch is a shape that fits together with the shape of the second groove during mold closure.

2. The pressed component manufacturing method of claim 1, wherein, in the first process, taking a position of the top plate as a reference, a portion of the curved wall at a distance of not less than 40% of a height from the top plate position to a lower end of the curved wall is formed with a step having the projection width of not more than 20% of a short direction width of the top plate.

3. The pressed component manufacturing method of claim 1, wherein, in cases in which at least the projection width of the step is narrowed in the second process, in the second process an angle of a portion of the curved wall further to the top plate side than the step is changed in order to narrow the projection width of the step formed in the first process.

4. The pressed component manufacturing method of claim 1, wherein, in a cross-section of the second die projected onto a cross-section of the first die, at least part of a portion of the second curved face at an opposite side of the second step to a portion on the second groove-bottom face side is located further outside than a portion of the first curved face at an opposite side of the first step to a portion on the second groove-bottom face side.

* * * * *